US009360187B2

(12) United States Patent
Matsuura

(10) Patent No.: US 9,360,187 B2
(45) Date of Patent: Jun. 7, 2016

(54) LIGHT SOURCE

(75) Inventor: Shigeki Matsuura, Hamamatsu (JP)

(73) Assignee: HAMAMATSU PHOTONICS K. K., Hamamatsu-shi, Shizuoka (JP)

( * ) Notice: Subject to any disclaimer, the term of this patent is extended or adjusted under 35 U.S.C. 154(b) by 295 days.

(21) Appl. No.: 13/877,361

(22) PCT Filed: Aug. 17, 2011

(86) PCT No.: PCT/JP2011/068601

§ 371 (c)(1),
(2), (4) Date: May 7, 2013

(87) PCT Pub. No.: WO2012/046509

PCT Pub. Date: Apr. 12, 2012

(65) Prior Publication Data

US 2013/0215618 A1 Aug. 22, 2013

(30) Foreign Application Priority Data

Oct. 4, 2010 (JP) ..... P2010-224850
Oct. 4, 2010 (JP) ..... P2010-224852
Oct. 4, 2010 (JP) ..... P2010-224853
Oct. 4, 2010 (JP) ..... P2010-224859

(51) Int. Cl.

| | |
|---|---|
| ***F21V 21/00*** | (2006.01) |
| ***F21V 7/04*** | (2006.01) |
| ***H01J 61/02*** | (2006.01) |
| ***H01J 63/08*** | (2006.01) |
| ***H01J 63/04*** | (2006.01) |

(52) U.S. Cl.

CPC ..... *F21V 7/043* (2013.01); *H01J 61/025* (2013.01); *H01J 63/04* (2013.01); *H01J 63/08* (2013.01)

(58) Field of Classification Search

CPC ..... F21V 7/043; H01J 61/025; H01J 63/08; H01J 61/68; H01J 3/10; H01J 5/48; H01J 65/04

See application file for complete search history.

(56) References Cited

U.S. PATENT DOCUMENTS 3,107,296 A * 10/1963 Hine ..... 250/494.1
3,200,253 A * 8/1965 Geier ..... 250/493.1
3,656,845 A * 4/1972 Koch-Bossard et al. ..... 353/42
3,691,390 A * 9/1972 Chow et al. ..... 250/553
3,950,075 A * 4/1976 Cook et al. ..... 385/93
4,149,086 A * 4/1979 Nath ..... 250/504 R
4,233,493 A * 11/1980 Nath ..... 606/16
4,241,998 A * 12/1980 Farkas et al. ..... 356/319

(Continued)

FOREIGN PATENT DOCUMENTS

CN 1557013 12/2004
JP 4-57066 B2 9/1992

(Continued)

*Primary Examiner* — Anne Hines
*Assistant Examiner* — Jose M Diaz
(74) *Attorney, Agent, or Firm* — Drinker Biddle & Reath LLP

(57) ABSTRACT

This light source 1 is provided with a luminescent cylinder 3A housing a luminescent part 2 to generate light; a light guide cylinder 3B connected to the luminescent cylinder 3A on a one end side, and configured to guide the light generated by the luminescent part 2, to an exit window 4 provided on the other end side; and a cylindrical reflective cylinder 9 inserted and fixed between the exit window 4 of the light guide cylinder 3B and a portion connecting the luminescent cylinder 3A and the exit window 4, and having an inner wall surface as a reflective surface 9*a* to reflect the light.

24 Claims, 56 Drawing Sheets

(56) References Cited

U.S. PATENT DOCUMENTS

| | | | | |
|---|---|---|---|---|
| 4,823,043 | A | 4/1989 | Roberts et al. | |
| 5,099,399 | A * | 3/1992 | Miller et al. | 362/580 |
| 5,382,773 | A * | 1/1995 | Kurihara et al. | 219/121.7 |
| 5,426,308 | A * | 6/1995 | Sudduth et al. | 250/504 H |
| 5,486,984 | A * | 1/1996 | Miller | 362/560 |
| 5,860,723 | A * | 1/1999 | Domas et al. | 362/346 |
| 5,908,418 | A * | 6/1999 | Dority et al. | 606/40 |
| 5,967,653 | A * | 10/1999 | Miller et al. | 362/580 |
| 6,637,913 | B2 * | 10/2003 | Sei et al. | 362/373 |
| 6,885,134 | B2 * | 4/2005 | Kurashima et al. | 313/46 |
| 6,905,214 | B2 * | 6/2005 | Tani | 353/56 |
| 6,911,108 | B2 * | 6/2005 | Sarmiento | 156/272.2 |
| 7,141,927 | B2 * | 11/2006 | Manning | 313/573 |
| 7,211,813 | B2 * | 5/2007 | Jensen | 250/504 H |
| 7,223,002 | B2 * | 5/2007 | Miller et al. | 362/551 |
| 7,999,477 | B2 * | 8/2011 | Ito et al. | 313/634 |
| 2004/0032740 | A1 * | 2/2004 | Kurashima et al. | 362/373 |
| 2004/0041984 | A1 * | 3/2004 | Tani et al. | 353/20 |
| 2006/0017025 | A1 * | 1/2006 | Jensen | 250/504 R |
| 2006/0239013 | A1 * | 10/2006 | Olsson et al. | 362/362 |
| 2007/0217201 | A1 * | 9/2007 | Drozdowicz | 362/287 |
| 2008/0170392 | A1 * | 7/2008 | Speier et al. | 362/227 |
| 2010/0156263 | A1 * | 6/2010 | Ito | H01J 5/48 313/110 |
| 2011/0266950 | A1 * | 11/2011 | Jenek | H01J 61/68 313/616 |

FOREIGN PATENT DOCUMENTS

| | | | |
|---|---|---|---|
| JP | 5-17918 | U | 3/1993 |
| JP | 07-006737 | A | 1/1995 |
| JP | 2007-012471 | A | 1/2007 |
| JP | 2007-048629 | A | 2/2007 |
| JP | 2008-311068 | A | 12/2008 |
| JP | 2009-216824 | A | 9/2009 |
| JP | 2010-027268 | A | 2/2010 |
| WO | WO 2007/018206 | | 2/2007 |

* cited by examiner (a)

(b)

(a)

(b)

(a)

(b)

(a)

(b)

LIGHT SOURCE

TECHNICAL FIELD

The present invention relates to a light source to emit light generated inside.

BACKGROUND ART

Research has been conducted heretofore on structures to efficiently emit light from a light source. For example, the deuterium lamp described in Patent Literature 1 below has a shield cover arranged so as to surround an anode and a cathode in a discharge container and the Patent Literature proposes a structure in which a light reflector is provided in part of the shield cover.

CITATION LIST

Patent Literatures

Patent Literature 1: Japanese Patent Application Laid-open No. H07-6737

Patent Literature 2: Japanese Patent Application Laid-open No. 2008-311068

Patent Literature 3: Japanese Patent Application Laid-open No. 2010-27268

Patent Literature 4: Japanese Utility Model Application Laid-open No. H05-17918

Patent Literature 5: Japanese Patent Publication No. H04-57066

SUMMARY OF INVENTION

Technical Problem

In the foregoing conventional deuterium lamp, however, loss of light is likely to occur between the discharge part including the anode and the cathode, and a light extraction window, resulting in insufficient extraction efficiency of light.

The present invention has been accomplished in view of this problem and it is therefore an object of the present invention to provide a light source capable of achieving stable improvement in extraction efficiency of light from an exit window.

Solution to Problem

In order to solve the above problem, a light source according to an aspect of the present invention comprises: a first housing which houses a luminescent part to generate light; a second housing which is connected to the first housing on a one end side and configured to guide the light generated from the luminescent part, to an exit window provided on the other end side; and a cylindrical member which is inserted and fixed between the exit window of the second housing and a portion connecting the first housing and the second housing, and which has an inner wall surface formed as a reflective surface to reflect the light.

In the light source of this configuration, the light emitted from the luminescent part in the first housing is guided into the cylindrical member inserted in the second housing connected to the first housing, and is then emitted from the exit window provided in the second housing. Since the inner wall surface of the cylindrical member is formed as the reflective surface herein, the light emitted from the luminescent part is guided from the one end side to the other end side of the second housing while being totally reflected by the reflective surface inside the cylindrical member, so that the light emitted from the luminescent part can be guided to the exit window of the second housing, without loss. Since the inner wall itself of the cylindrical member is the reflective surface, it is feasible to prevent degradation of performance and generation of foreign matter due to delamination or dropout or the like of the reflective surface, thereby achieving extension of service life. This allows the extraction efficiency of the light from the exit window to be improved on a stable basis.

Advantageous Effect of Invention

The present invention has achieved stable improvement in extraction efficiency of light from the exit window.

DESCRIPTION OF EMBODIMENTS

Figure 1:
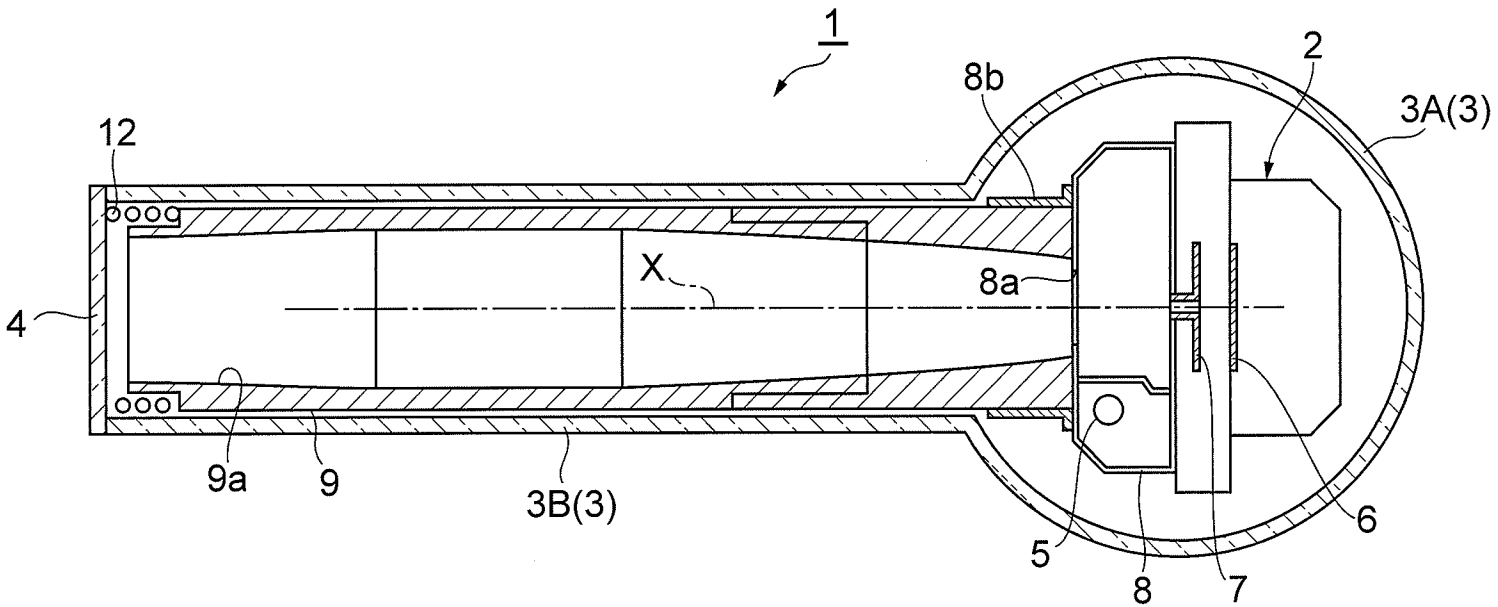
FIG. 1 is a sectional view showing a configuration of a light source according to the first embodiment of the present invention.

The preferred embodiments of the light source according to the present invention will be described below in detail with reference to the drawings. Identical or equivalent portions will be denoted by the same reference signs in the description of the drawings, without redundant description. Each drawing was prepared for the description and depicted so as to emphasize an object to be described, in particular. For this reason, it should be noted that a dimensional ratio of each member in the drawings does not always agree with an actual one.

First Embodiment

FIG. 1 is a sectional view showing a configuration of a light source according to the first embodiment of the present invention. The light source 1 shown in the same drawing is a so-called deuterium lamp used as a light source for analytical equipment such as a photoionization source of a mass spectrometer or as a light source for vacuum electricity removal.

This light source 1 is provided with a hermetic container 3 of glass in which a luminescent cylinder (first housing) 3A of a substantially cylindrical shape housing a luminescent part 2 to induce discharge of deuterium gas to generate light, is integrally connected to a light guide cylinder (second housing) 3B of a substantially cylindrical shape kept in communication with the luminescent cylinder 3A and projecting along the optical axis X of light generated by the luminescent part 2, from the side wall of the luminescent cylinder 3A. In this hermetic container 3 deuterium gas is enclosed under the pressure of about several hundred Pa. More specifically, the light guide cylinder 3B is integrated in communication with the luminescent cylinder 3A on a one end side in the direction along the optical axis X and is sealed on the other end side by an exit window 4 to emit the light generated from the luminescent part 2, to the outside. A material of this exit window 4 is, for example, $MgF_2$ (magnesium fluoride), LiF (lithium fluoride), silica glass, or sapphire glass.

The luminescent part 2 housed in the luminescent cylinder 3A is composed of a cathode 5, an anode 6, a discharge path limiter 7 arranged between the anode 6 and the cathode 5 and having an aperture formed in a central region, and a housing case 8 arranged so as to surround these. In a surface of this housing case 8 on the light guide cylinder 3B side, a light passage port 8*a* of a rectangular shape for extraction of the light generated by the luminescent part 2 is formed so as to face the exit window 4 of the light guide cylinder 3B and, a fixing ring (fixing member) 8*b* consisting of a wall part extending in a circular shape along the side wall of the light guide cylinder 3B is fixed so as to surround the light passage port 8*a*. When a voltage is applied between the cathode 5 and the anode 6, the luminescent part 2 induces ionization and discharge of the deuterium gas existing between them, to form a plasma state and the discharge path limiter 7 narrows it into a high-density plasma state, thereby to generate light (ultraviolet light), which is emitted from the light passage port 8*a* of the housing case 8 into the direction along the optical axis X.

The foregoing luminescent part 2 is held in the luminescent cylinder 3A by a stem pin (not shown) standing on a stem part disposed on an end face of the luminescent cylinder 3A. Namely, this light source 1 is a side-on type light source in which the optical axis X intersects with the tube axis of the luminescent cylinder 3A.

Figure 2:
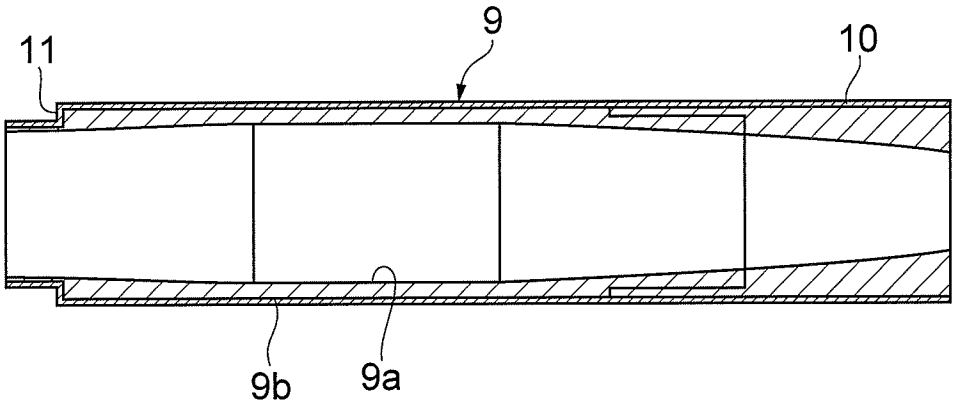
FIG. 2 is a sectional view of a reflective cylinder in FIG. 1.

An aluminum reflective cylinder (metal member) 9 of a substantially cylindrical shape is inserted and fixed between the exit window 4 in the hermetic container 3 of this configuration and a portion connecting the luminescent cylinder 3A and the light guide cylinder 3B. This reflective cylinder 9 is, as shown in FIG. 2, a combination of metal block members of aluminum and is formed in a substantially cylindrical shape having an outside diameter smaller than an inside diameter of the light guide cylinder 3B.

An inner wall surface of the reflective cylinder 9 itself is formed as a reflective surface 9*a* which is a curved surface or a multistep surface with inclination angles varying stepwise, along the central axis of the reflective cylinder 9. Namely, this reflective surface 9*a* is formed so that the two ends of the reflective cylinder 9 in the central-axis direction are tapered so as to be able to converge the light at a desired surface or point outside the exit window 4. More specifically, the reflective surface 9*a* is formed as inclined with respect to the central axis of the reflective cylinder 9, i.e., with respect to the optical axis X so that the diameter of the space surrounded by the reflective surface 9*a* gradually decreases from a longitudinal central region of the reflective cylinder 9 toward the end on the luminescent cylinder 3A side. Furthermore, the reflective surface 9*a* is formed as inclined with respect to the central axis of the reflective cylinder 9 so that the diameter of the space surrounded by the reflective surface 9*a* gradually decreases from the longitudinal central region of the reflective cylinder 9 toward the end on the exit window 4 side. The tapered structure of the reflective surface 9*a* may be provided at either one of the two ends of the reflective cylinder 9 in the central-axis direction, instead of that at the two ends; for example, the reflective surface 9*a* may be formed in the tapered shape as described above, only on the luminescent part 2 side (one end side), while the reflective surface 9*a* is formed in parallel to the central axis of the reflective cylinder 9 on the exit window 4 side (the other end side). This reflective surface 9*a* is set so as to be able to converge the light at the desired surface or point or diverge the light. This reflective surface 9*a* is processed in a mirror surface state capable of regularly reflecting the light generated by the luminescent part 2 and is formed, for example, by cutting the metal block members, polishing an inner wall thereof by a polishing method such as buffing, chemical polishing, electropolishing, or a derivative thereof, or by a polishing method as a complex thereof, and thereafter subjecting the surface to a washing treatment or a vacuum treatment or the like to remove an impurity gas component. In the present embodiment the reflective cylinder 9 is composed of a combination of two members and, when the reflective surface 9*a* is formed of a plurality of metal block members as in this configuration, a ratio of length and inside diameter (aspect ratio) of each metal block member can be set smaller, so as to facilitate achievement of desired flatness during processing and shaping, thereby enhancing mirror accuracy of the reflective surface 9*a*.

Furthermore, a thermal radiation film 10 containing a material with high thermal emissivity is formed over almost the entire area of an outer wall surface 9*b* of the reflective cylinder 9. The material of this thermal radiation film 10 to be used is one with the thermal emissivity higher than that of the material of the reflective cylinder 9, e.g., aluminum oxide. The thermal radiation film 10 herein is formed over almost the entire surface of the reflective cylinder 9, but it may be formed in part of the outer wall surface 9*b* of the reflective cylinder 9 on the one end side. The thermal radiation film 10 is formed, for example, by depositing the material forming the thermal radiation film 10, on the outer wall surface 9*b* of the reflective cylinder 9 by evaporation, coating, or the like, but, particularly, in the case where the reflective cylinder 9 is made of aluminum as in the present embodiment, a layer of aluminum oxide as the thermal radiation film 10 may be formed by oxidizing the outer wall surface 9*b* of the reflective cylinder 9.

A cut portion 11 cut in a circular shape so as to form a stepped projection is formed along the outer wall surface 9*b*, in a peripheral edge region on the longitudinal other end side of the outer wall surface 9*b* of the reflective cylinder 9. This cut portion 11 is provided for positioning the reflective cylinder 9 in the hermetic container 3.

Figure 3:
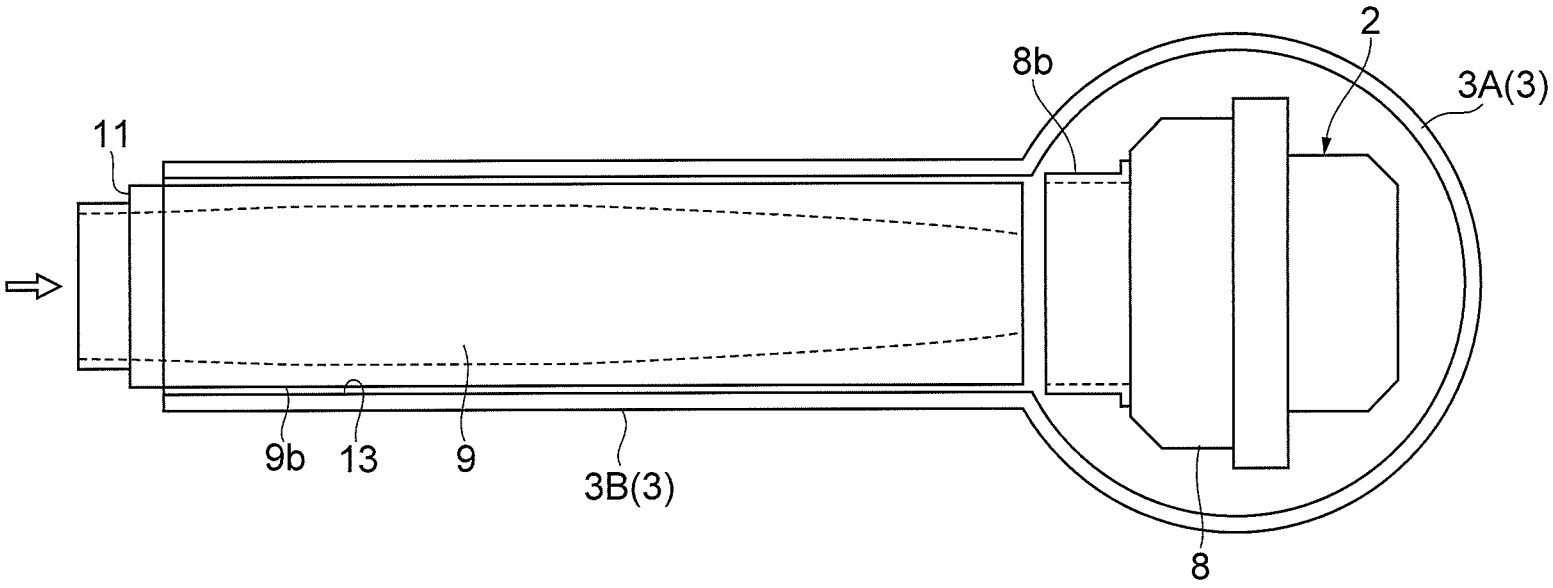
FIG. 3 is a side view showing an assembling state of the reflective cylinder in the light source in FIG. 1.

The reflective cylinder 9 of this configuration is inserted along the tube axis (optical axis X) of the light guide cylinder 3B from the edge region opposite to the edge region with the cut portion 11 therein until the edge region comes into contact with the housing case 8 of the luminescent part 2 and, after a spring member 12 is attached along the outer wall surface 9*b* to the cut portion 11, the light guide cylinder 3B is sealed by the exit window 4 (FIG. 1 and FIG. 3). At this time, the reflective cylinder 9 is fitted into the fixing ring 8*b* of the housing case 8 in a state in which the outer wall surface 9*b* thereof is separated from the inner wall surface 13 of the light guide cylinder 3B (FIG. 3). This spring member 12 is a member for positioning of the reflective cylinder 9, which is comprised of a metal member, e.g., stainless steel or an Inconel material with high thermal resistance, and which is arranged between the cut portion 11 and the exit window 4, with a function to urge the reflective cylinder 9 from the exit window 4 side toward the luminescent part 2 along the optical axis X, thereby to press the reflective cylinder 9 against the housing case 8. By this, the reflective cylinder 9 is positioned in the direction along the optical axis X and in the direction perpendicular to the optical axis X, in a state in which the reflective cylinder 9 is separated from the light guide cylinder 3B between the exit window 4 and the luminescent part 2 in the hermetic container 3 and located in close proximity to the luminescent part 2.

In the light source 1 described above, the light emitted from the luminescent part 2 in the luminescent cylinder 3A is guided to the interior of the cylindrical reflective cylinder 9 inserted in the light guide cylinder 3B connected to the luminescent cylinder 3A, thereby to be emitted from the exit window 4 provided in the light guide cylinder 3B. Since the inner wall surface of the reflective cylinder 9 is formed as the reflective surface 9*a* herein, the light emitted from the luminescent part 2 is guided from the one end side to the other end side of the light guide cylinder 3B while being totally reflected by the reflective surface 9*a* inside the reflective cylinder 9, so that the light emitted from the luminescent part 2 can be guided to the exit window 4 of the light guide cylinder 3B, without loss. At this time, by properly setting the inclination angles of the reflective surface 9*a*, the output light outside the exit window 4 can be distributed as any of parallel light, diverging light, and converging light and uniformity of light intensity can be enhanced on a predetermined illumination target surface. In conjunction therewith, the efficiency of extraction of the light from the exit window 4 improves, so as to increase a total light amount of the output light and a light amount on the illumination target surface. In the case of the conventional deuterium lamps, a light radiation pattern from the exit window tends to vary according to the distance from the exit window to cause an omission where radiant light is weak, whereas the light source 1 achieves reduction in occurrence of such an omission of the light radiation pattern. Since the reflective cylinder 9 itself is comprised of the metal members of aluminum blocks or the like, for example, unlike the case where a reflective film of metal or the like is formed inside the reflective cylinder 9, it is feasible to prevent degradation of performance and generation of foreign matter due to delamination or dropout or the like of the reflective surface 9*a* caused by a difference between coefficients of expansion of the constituent materials with repetitions of increase and decrease of temperature, and thereby to achieve extension of service life. Since it becomes easier to process the reflective surface with high mirror accuracy, the generated light can be effectively converged and, in addition, the generated ultraviolet light is not transmitted, so as not to cause deterioration due to the ultraviolet light, thereby achieving more efficient extraction of the generated light.

Furthermore, since the outer wall surface 9*b* of the reflective cylinder 9 is separated from the inner wall surface 13 of the light guide cylinder 3B, it is feasible to prevent positional deviation of the reflective cylinder 9 and breakage of the reflective cylinder 9 or the light guide cylinder 3B, because of a difference of coefficients of thermal expansion between the reflective cylinder 9 and the light guide cylinder 3B.

Since the two ends of the reflective surface 9*a* of the reflective cylinder 9 are formed in the taper shape, angles of reflection of light on the reflective surface 9*a* become large, so as to reduce the number of reflections, which can ensure stable improvement in extraction efficiency of light from the exit window 4.

Since the reflective cylinder 9 is urged by the spring member 12 as the positioning member of the metal member to be fitted into the fixing ring 8*b* of the housing case 8 so as to be positioned in the hermetic container 3, it is not deteriorated by the generated ultraviolet light, whereby the position of the reflective cylinder 9 is kept stable relative to the hermetic container 3, so as to maintain the extraction efficiency of light from the exit window 4. By adopting the structure to push the reflective cylinder against the housing case 8 by the spring member 12, it is feasible to stably fix the reflective cylinder 9 relative to the hermetic container 3 and to absorb positional deviation thereof relative to the luminescent cylinder 3A by the spring member 12 even with occurrence of thermal expansion along the central-axis direction of the reflective cylinder 9.

Furthermore, since the thermal radiation film 10 is formed over almost the entire area of the outer wall surface 9*b* of the reflective cylinder 9, a region at lower temperature than the surroundings and the enclosed gas can be formed on the inner surface of the reflective cylinder 9, and the lower-temperature region can capture the foreign matter such as sputtered substance from the luminescent cylinder 3A, so as to prevent the foreign matter from diffusing and attaching to the exit window 4 and prevent reduction of optical transmittance caused thereby. In the case where the thermal radiation film 10 is formed in part of the outer wall surface 9*b* near the luminescent cylinder 3A, the thermal emissivity on the one end side of the outer wall surface 9*b* becomes larger than that on the other end side of the outer wall surface 9*b*, and as a result, the sputtered substance becomes likely to be deposited at positions away from the exit window 4, which reduces contamination of the exit window 4.

When the light source 1 of this configuration is applied as a photoionization source to a mass spectrometer (MS) such as a gas chromatography mass spectrometer (GC/MS) or a liquid chromatography mass spectrometer (LC/MS), it ensures enhancement of converging performance and increase of light amount, which eliminates a need for locating the window of the light source 1 close to a sample discharge port, reducing the following demerits. Namely, if there is no optical system in the light source, the position of the window will need to be set closer to the sample discharge port in order to improve sensitivity, and high sample temperature can cause such demerits as adverse effect on a sealant of the window material and infeasibility of proximity arrangement. If the position of the window is set closer to the sample discharge port, the window material and an optical system installed in close proximity thereto outside the window of the light source can be contaminated with a sample and/or a solvent, so as to result in degradation of measurement sensitivity.

Second Embodiment

Figure 4:
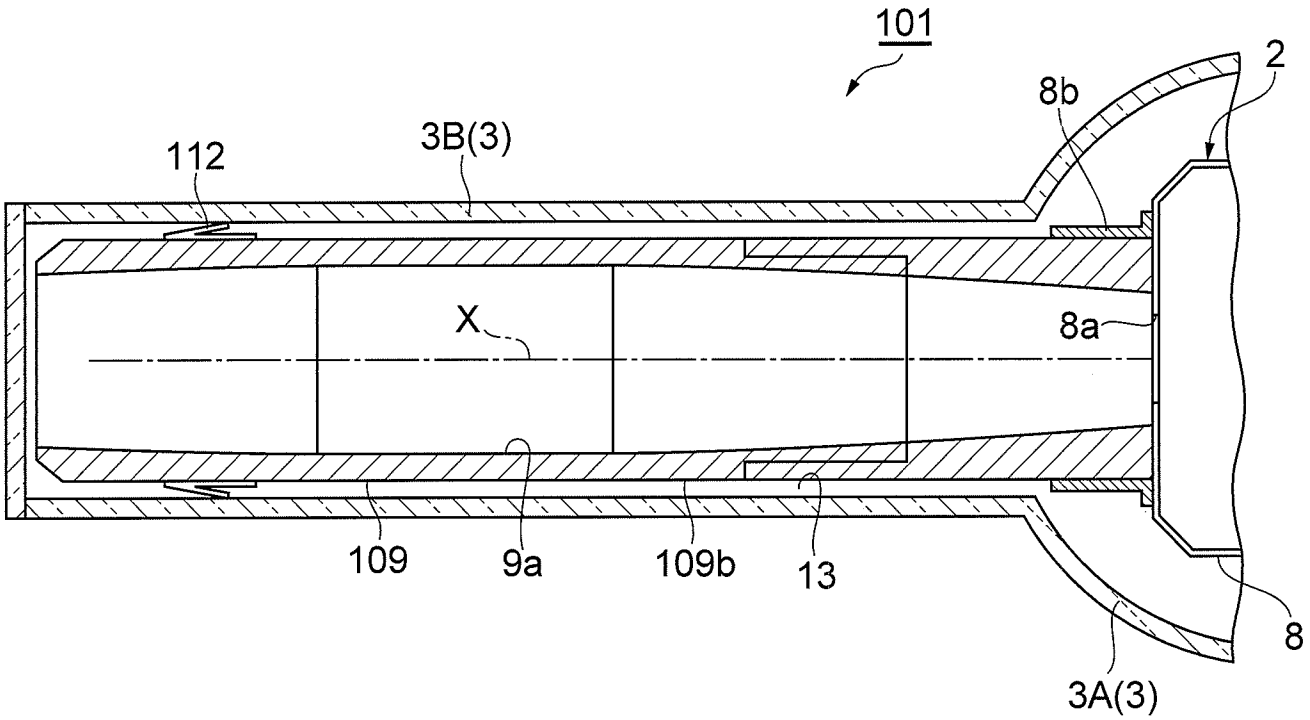
FIG. 4 is a sectional view showing a configuration of a light source according to the second embodiment of the present invention.
Figure 5:
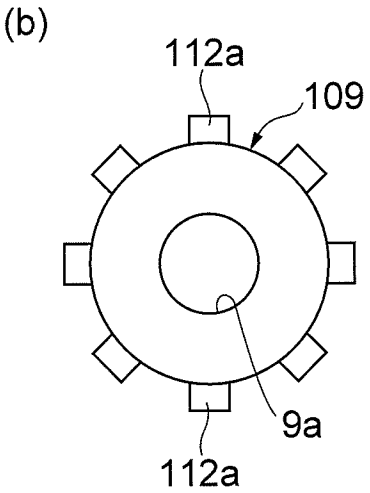
FIG. 5(*a*) is a side view of a reflective cylinder in FIG. 4 and FIG. 5(*b*) a front view of the reflective cylinder in FIG. 4.
Figure 5:
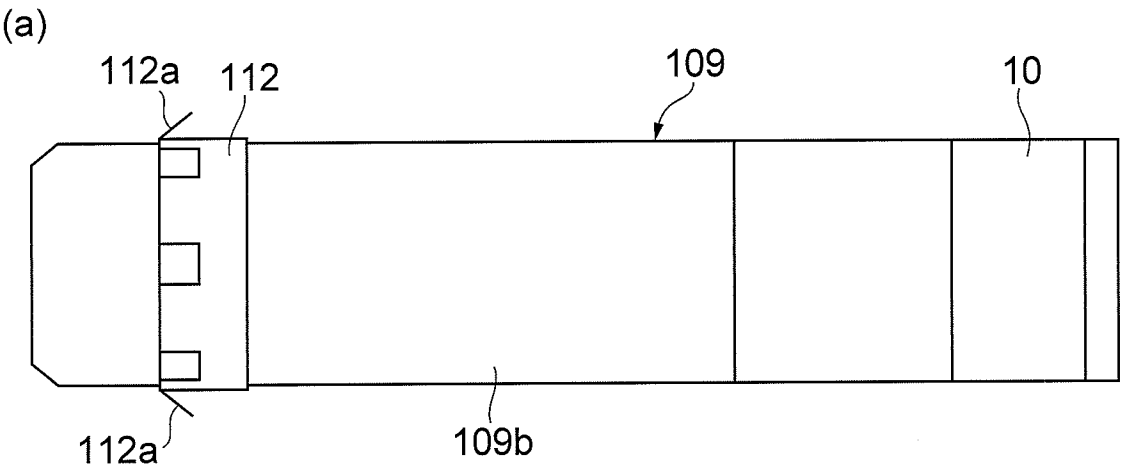

FIG. 4 is a sectional view showing a configuration of a light source according to the second embodiment of the present invention, FIG. 5(*a*) a side view of a reflective cylinder in FIG. 4, and FIG. 5(*b*) a front view of the reflective cylinder in FIG. 4. The light source 101 shown in the same drawings is different in the positioning structure of the reflective cylinder 9 from that in the first embodiment.

Specifically, a metal band 112 as a positioning member is fixed to the reflective cylinder 109 set inside the light source 101, at an end of its outer wall surface 109*b* on the exit window 4 side. In this metal band 112, a plurality of claws 112*a* with spring action are formed along the outer periphery of the reflective cylinder 109, and the metal band 112 is welded at its end by lap welding to be fixed on the outer wall surface 109*b*. The reflective cylinder 109 of this configuration is inserted into the hermetic container 3 along the inner wall surface 13 of the light guide cylinder 3B and is fixed so that the outer wall surface 109*b* is separated from the inner wall surface 13 except for the metal band 112. By this structure, the reflective cylinder 109 is urged at its end against the fixing ring 8*b* of the housing case 8 by spring forces of the claws 112*a* of the metal band 112, to be positioned in the direction along the optical axis X in the hermetic container 3. In conjunction therewith, the reflective cylinder 109 is also positioned in the directions perpendicular to the optical axis X in a state in which the outer wall surface 109*b* thereof and the inner wall surface 13 of the light guide cylinder 3B are separated from each other at a fixed distance, by the claws 112*a* of the metal band 112. If a groove is formed in the width of the metal band in the region of the reflective cylinder 109 where the metal band 112 is mounted, the distance from the metal band 112 to the inner wall surface 13 of the light guide cylinder 3B can be set larger without increase in the inside diameter of the light guide cylinder 3B and angles of the claws 112*a* can be increased, with the result of increase in the spring forces of the claws 112*a*.

The light source 101 of this configuration can also prevent the positional deviation of the reflective cylinder 109 and the breakage of the reflective cylinder 109 or the light guide cylinder 3B because of the difference of coefficients of thermal expansion between the reflective cylinder 109 and the light guide cylinder 3B. Since the reflective cylinder 109 is urged into the fixing ring 8*b* of the housing case 8 by the metal band 112 as the positioning member to be positioned in the hermetic container 3, it is feasible to stabilize the position of the reflective cylinder 109 relative to the hermetic container 3 and ensure sufficient extraction efficiency of light from the exit window 4.

Third Embodiment

Figure 6:
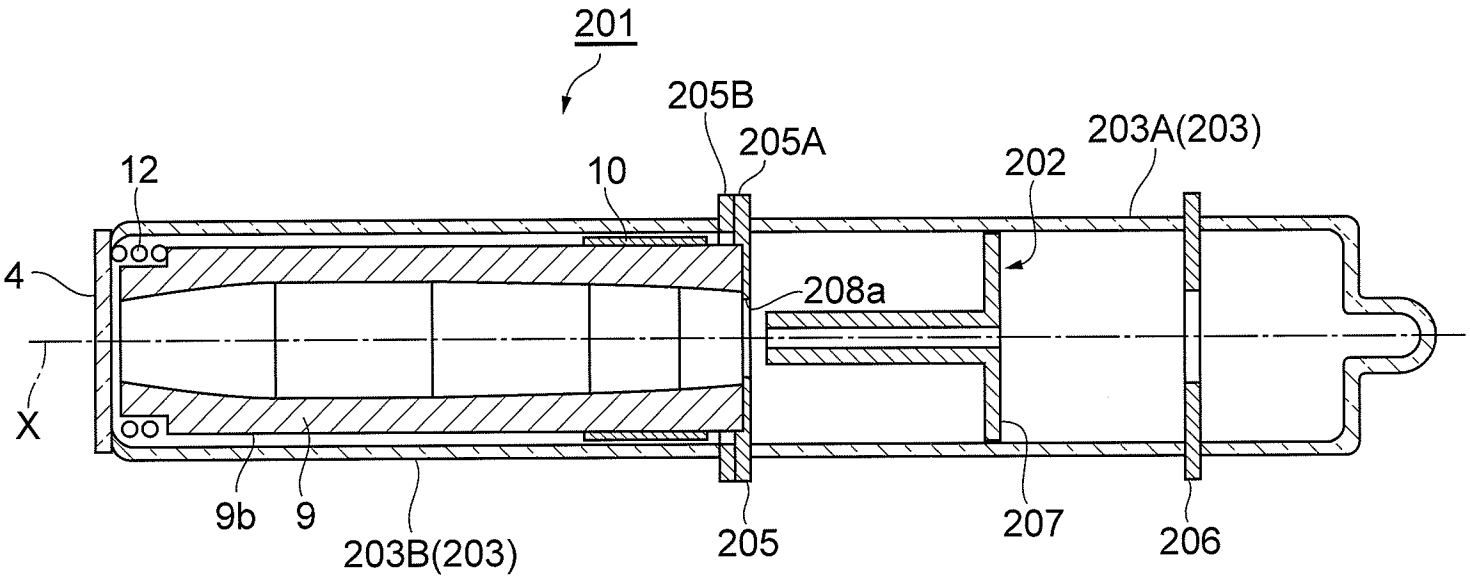
FIG. 6 is a sectional view showing a configuration of a light source according to the third embodiment of the present invention.

FIG. 6 is a sectional view showing a configuration of a light source according to the third embodiment of the present invention. The light source 201 shown in the same drawing is an example of application of the present invention to a capillary discharge tube.

The light source 201 is provided with a hermetic container 203 in which a luminescent cylinder 203A and a light guide cylinder 203B are connected. Enclosed in this luminescent cylinder 203A is a luminescent part 202 composed of a cathode 205, an anode 206, and a capillary 207 arranged between the anode 206 and the cathode 205. A gas such as hydrogen ($H_2$), xenon (Xe), argon (Ar), or krypton (Kr) is enclosed in the hermetic container 203. When a voltage is applied between the cathode 205 and the anode 206, the luminescent part 202 of this configuration induces ionization and discharge of the gas existing between them, and resultant electrons are converged in the capillary 207 to form a plasma state, whereby light is emitted along the optical axis X toward the light guide cylinder 203B. For example, in the case where the enclosed gas is Kr and the material of the exit window 4 used is $MgF_2$, the light can be emitted at the wavelength of 117/122 nm; in the case where the enclosed gas is Ar and the material of the exit window 4 used is LiF, the light can be emitted at the wavelength of 105 nm.

This cathode 205 also functions as a connection member arranged at the part to separate the luminescent cylinder 203A and the light guide cylinder 203B from each other. Particularly, the cathode 205 has a light passage port 208*a* of a circular shape provided for extraction of light generated by the luminescent part 202, and consists of a double structure of a fixing ring member 205A serving as a fixing member for positioning of the reflective cylinder 9 inserted so that the outer wall surface 9*b* thereof is separated from the inner wall surface of the light guide cylinder 203B, and a ring member 205B joined to the light guide cylinder 203B and the ring member 205A. Another member may be attached as a member for positioning of the reflective cylinder 9, to the cathode 205.

For incorporating the reflective cylinder 9 into the hermetic container 203 of the light source 201 as described above, the fixing ring member 205A and the ring member 205B of the cathode 205 are bonded by sealing to the luminescent cylinder 203A and to the light guide cylinder 203B, respectively. Then the reflective cylinder 9 is inserted so as to be separated from the inner wall surface of the light guide cylinder 203B while being fitted into a step portion of the fixing ring member 205A, and thereafter the fixing ring member 205A and the ring member 205B are stacked and vacuum-welded to be assembled. Another available assembly method is such that after the reflective cylinder 9 is welded and fixed to the cathode 205, the light guide cylinder 203B is joined in a vacuum-retainable state to the cathode 205.

The light source 201 of this configuration can also prevent the positional deviation of the reflective cylinder 9 and the breakage of the reflective cylinder 9 or the light guide cylinder 203B, because of the difference of coefficients of thermal expansion between the reflective cylinder 9 and the light guide cylinder 203B. Since the reflective cylinder 9 is urged into the fixing ring member 205A of the cathode 205 by the spring member 12 as the positioning member to be positioned in the hermetic container 203, it is feasible to stabilize the position of the reflective cylinder 9 relative to the hermetic container 203 and ensure sufficient extraction efficiency of light from the exit window 4 on a stable basis.

Since the thermal radiation film 10 is formed on the outer wall surface 9*b* on the one end side near the luminescent cylinder 203A, in the reflective cylinder 9, a portion at lower temperature than the surroundings and the enclosed gas can be formed inside the reflective cylinder 9 in close proximity to the luminescent part 202 and the lower-temperature portion can capture the foreign matter such as the sputtered substance from the luminescent cylinder 203A, so as to prevent the diffusion of the foreign matter to the exit window 4 and the reduction of optical transmittance caused thereby.

Fourth Embodiment

Figure 7:
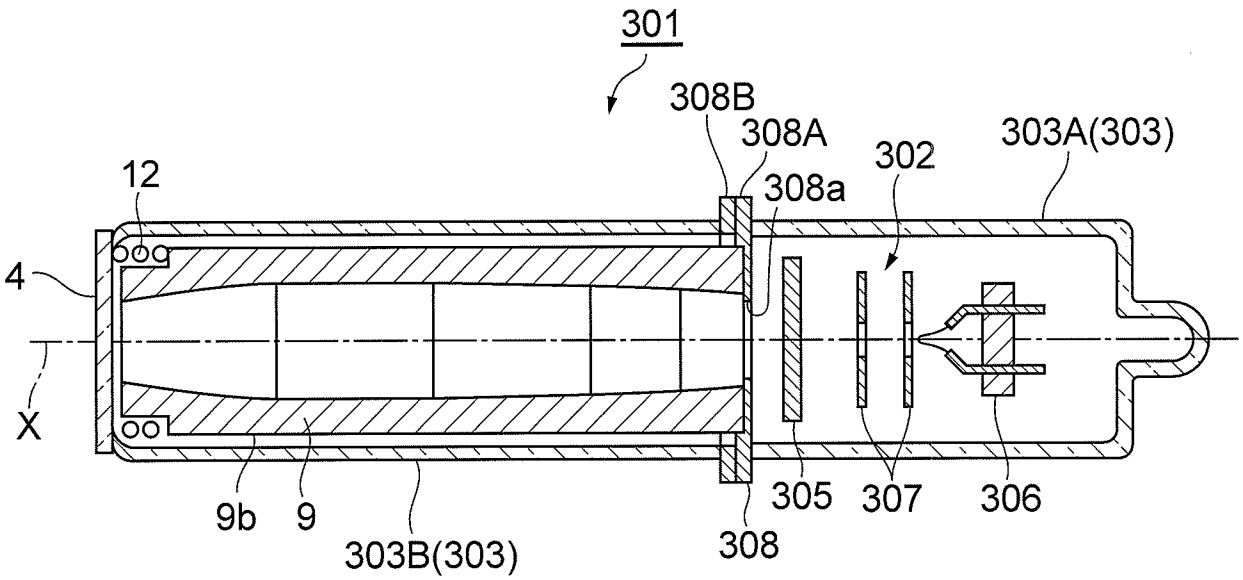
FIG. 7 is a sectional view showing a configuration of a light source according to the fourth embodiment of the present invention.

FIG. 7 is a sectional view showing a configuration of a light source according to the fourth embodiment of the present invention. The light source 301 shown in the same drawing is an example of application of the present invention to an electron excitation light source.

The light source 301 is provided with a hermetic container 303 in which a luminescent cylinder 303A and a light guide cylinder 303B are connected, and the interior thereof is maintained in high vacuum. Enclosed in this luminescent cylinder 303A is a luminescent part 302 composed of a solid-state luminescent target 305 having a crystal thin film such as AlGaN, an electron gun 306, and an electron lens part 307 arranged between the solid-state luminescent target 305 and the electron gun 306. In the luminescent part 302 of this configuration, an electron current created by the electron gun 306 is controlled by the electron lens part 307 to be accelerated toward the solid-state luminescent target 305 and then collided therewith. By this, the luminescent part 302 can emit light in the direction along the optical axis X toward the light guide cylinder 203B. For example, in the case where AlGaN is used as a crystal thin film material of the solid-state luminescent target 305, the light can be emitted in the wavelength region of about 200 to 300 nm.

The luminescent cylinder 303A and the light guide cylinder 303B forming the hermetic container 203 are coupled by a sealing ring member 308 with electrical conductivity and contact portions of the sealing ring member 308 with the luminescent cylinder 303A and the light guide cylinder 303B are joined in a vacuum-retainable state. This sealing ring member 308 has a light passage port 308*a* of a circular shape formed for extraction of light generated by the luminescent part 302 and consists of a double structure of a fixing ring member 308A as a fixing member for positioning of the reflective cylinder 9 inserted so that the outer wall surface 9*b* thereof is separated from the inner wall surface of the light guide cylinder 303B, and a ring member 308B joined to the light guide cylinder 303B and to the fixing ring member 308A. Another member may be attached as a member for positioning of the reflective cylinder 9, to the sealing ring member 308. The solid-state luminescent target 305 is kept in contact with and fixed to the fixing ring member 308A of this sealing ring member 308 and a potential is applied from the outside to the fixing ring member 308A to set the potential of the solid-state luminescent target 305. Since the solid-state luminescent target 305 is kept in contact with and fixed to the fixing ring member 308A, heat generated with incidence of electrons can be dissipated to the outside from the sealing ring member 308 and the reflective cylinder 9, so as to improve luminescent efficiency and device life. The potential of the solid-state luminescent target 305 may be set by another electrode which is separately provided.

The light source 301 of this configuration can also prevent the positional deviation of the reflective cylinder 9 and the breakage of the reflective cylinder 9 or the light guide cylinder 303B, because of the difference of coefficients of thermal expansion between the reflective cylinder 9 and the light guide cylinder 303B. Since the reflective cylinder 9 is urged into a step portion of the fixing ring member 308A of the sealing ring member 308 by the spring member 12 as the positioning member to be positioned in the hermetic container 303, it is feasible to stabilize the position of the reflective cylinder 9 relative to the hermetic container 303 and ensure sufficient extraction efficiency of light from the exit window 4 on a stable basis.

Fifth Embodiment

Figure 8:
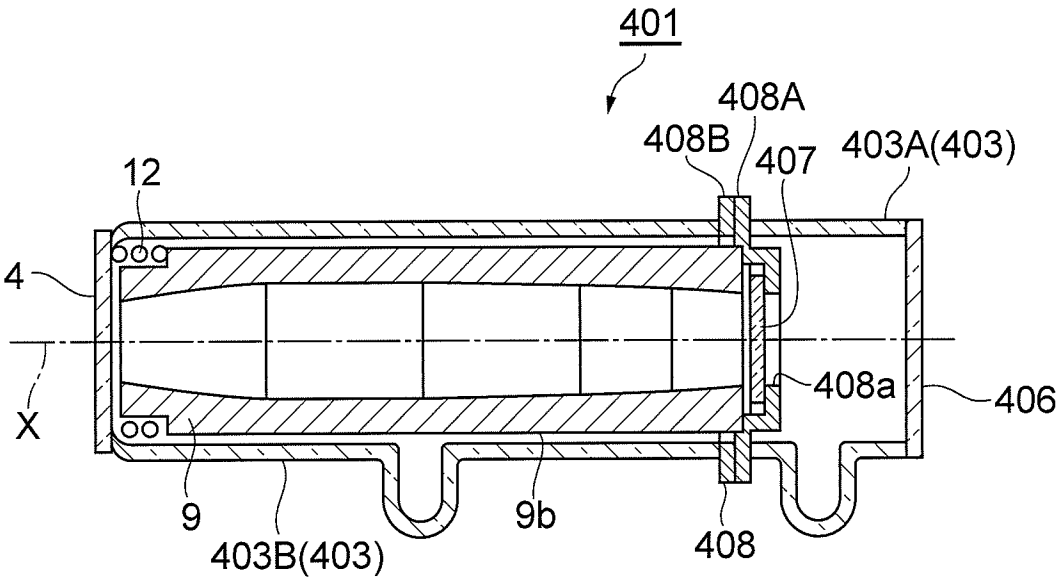
FIG. 8 is a sectional view showing a configuration of a light source according to the fifth embodiment of the present invention.

FIG. 8 is a sectional view showing a configuration of a light source according to the fifth embodiment of the present invention. The light source 401 shown in the same drawing is an example of application of the present invention to a laser excitation light source.

The light source 401 is provided with a hermetic container 403 in which a luminescent cylinder 403A and a light guide cylinder 403B are bonded as sealed with a bulkhead in between, a rare gas is enclosed inside the luminescent cylinder 403A, and an inert gas is enclosed inside the light guide cylinder 403B or the interior of the light guide cylinder 403B is kept in vacuum. An entrance window 406 is bonded as sealed to this luminescent cylinder 403A on the side opposite to the light guide cylinder 403B and the bulkhead on the light guide cylinder 403B side is provided with an exit window 407. The luminescent cylinder 403A itself with the entrance window 406 and the exit window 407 constitutes a luminescent part. Specifically, when a laser beam is injected from a laser light source not shown, along the optical axis X into the entrance window 406 of the luminescent cylinder 403A as described above, light is excited by the rare gas inside and the light is emitted along the optical axis X from the exit window 407. For example, in the case where the rare gas used is Xe and the injected beam is a third harmonic (355 nm) of Nd:YAG laser, the light can be emitted at the wavelength of 118 nm by third harmonic generation of Xe.

The bulkhead between the luminescent cylinder 403A and the light guide cylinder 403B is composed of a sealing ring member 408 and contact portions of the sealing ring member 408 with the luminescent cylinder 403A and the light guide cylinder 403B are joined in a vacuum-retainable state. This sealing ring member 408 has a light passage port 408*a* of a circular shape formed for extraction of the light generated in the luminescent cylinder 403A, through the exit window 407, and consists of a double structure of a fixing ring member 408A serving as a fixing member for positioning of the reflective cylinder 9 inserted so that the outer wall surface 9*b* thereof is separated from the inner wall surface of the light guide cylinder 403B, and a ring member 408B joined to the light guide cylinder 403B and to the fixing ring member 408A. Another member may be attached as a member for positioning of the reflective cylinder 9, to the sealing ring member 408.

The light source 401 of this configuration can also prevent the positional deviation of the reflective cylinder 9 and the breakage of the reflective cylinder 9 or the light guide cylinder 403B, because of the difference of coefficients of thermal expansion between the reflective cylinder 9 and the light guide cylinder 403B. Since the reflective cylinder 9 is urged into a step portion of the fixing ring member 408A of the sealing ring member 408 by the spring member 12 as the positioning member to be positioned in the hermetic container 403, it is feasible to stabilize the position of the reflective cylinder 9 relative to the hermetic container 403 and ensure sufficient extraction efficiency of light from the exit window 4 on a stable basis.

The structure of the light source 401 can dissipate heat generated by laser beam excitation to the outside from the sealing ring member 408 and the reflective cylinder 9, so as to improve the luminescent efficiency and device life.

The luminescent cylinder 403A may be constructed without the exit window 407 so as to keep the luminescent cylinder 403A and the light guide cylinder 403B at the same gas pressure.

Sixth Embodiment

Figure 9:
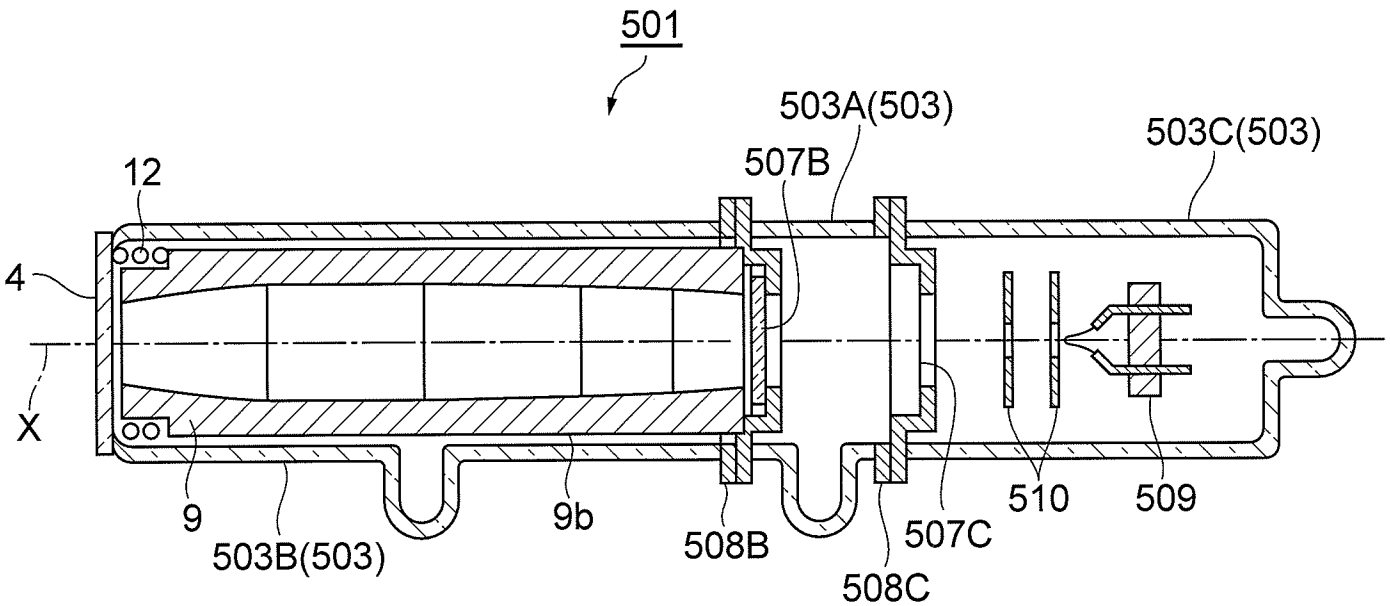
FIG. 9 is a sectional view showing a configuration of a light source according to the sixth embodiment of the present invention.

FIG. 9 is a sectional view showing a configuration of a light source according to the sixth embodiment of the present invention. The light source 501 shown in the same drawing, when compared to the fifth embodiment, is an example of application of the present invention to an electron excitation gas light source configured to excite the rare gas with electrons instead of the laser beam, so as to generate light.

The light source 501 is provided with a hermetic container 503 in which a light guide cylinder 503B and an electron generation cylinder 503C are connected to the two ends of a luminescent cylinder 503A. This luminescent cylinder 503A is bonded as sealed to the light guide cylinder 503B in which the reflective cylinder 9 is inserted and fixed so that the outer wall surface 9*b* of the reflective cylinder 9 is separated from an inner wall surface of the light guide cylinder 503B, through a sealing ring member 508B as a bulkhead, and is bonded as sealed to the electron generation cylinder 503C through a sealing ring member 508C as a bulkhead. A rare gas is enclosed inside the luminescent cylinder 503A, an inert gas is enclosed inside the light guide cylinder 503B or the interior thereof is kept in vacuum, and the interior of the electron generation cylinder 503C is kept in vacuum. This sealing ring member 508C is provided with an electron transmission window 507C made of a material with electron transmitting nature such as Si or SiN, and the sealing ring member 508B is provided with an exit window 507B. The structure of the sealing ring member 508B is the same as that of the sealing ring member 408 according to the fifth embodiment.

Enclosed inside the electron generation cylinder 503 forming a part of the hermetic container 503 is an electron gun 509 and an electron lens part 510 arranged between the electron transmission window 507C and the electron gun 509. In the electron generation cylinder 503C of this configuration, an electron current created by the electron gun 509 can be controlled by the electron lens part 510 to be accelerated along the optical axis X toward the electron transmission window 507C. When the electron current is then injected along the optical axis X into the luminescent cylinder 503A, light is excited by the rare gas inside, and the light is emitted along the optical axis X from the exit window 507B to be guided into the light guide cylinder 503B.

The light source 501 of this configuration can also prevent the positional deviation of the reflective cylinder 9 and the breakage of the reflective cylinder 9 or the light guide cylinder 503B, because of the difference of coefficients of thermal expansion between the reflective cylinder 9 and the light guide cylinder 503B. Since the reflective cylinder 9 is urged into a step portion of the sealing ring member 508B by the spring member 12 as the positioning member to be positioned in the hermetic container 503, it is feasible to stabilize the position of the reflective cylinder 9 relative to the hermetic container 503 and ensure sufficient extraction efficiency of light from the exit window 4 on a stable basis.

The structure of the light source 501 can dissipate heat generated by electron excitation, to the outside from the sealing ring member 508B and the reflective cylinder 9, so as to improve the luminescent efficiency and device life.

The luminescent cylinder 503A may be constructed without the exit window 507B so as to keep the luminescent cylinder 503A and the light guide cylinder 503B at the same gas pressure.

The present invention does not have to be limited to the above-described embodiments. For example, the foregoing embodiments showed the configuration wherein the reflective cylinder 9 was fixed as pressed against the positioning member disposed on the luminescent cylinder 3A, 203A, 303A, 403A, or 503A side, but it may be fixed directly to the positioning member by laser welding or the like.

Figure 10:
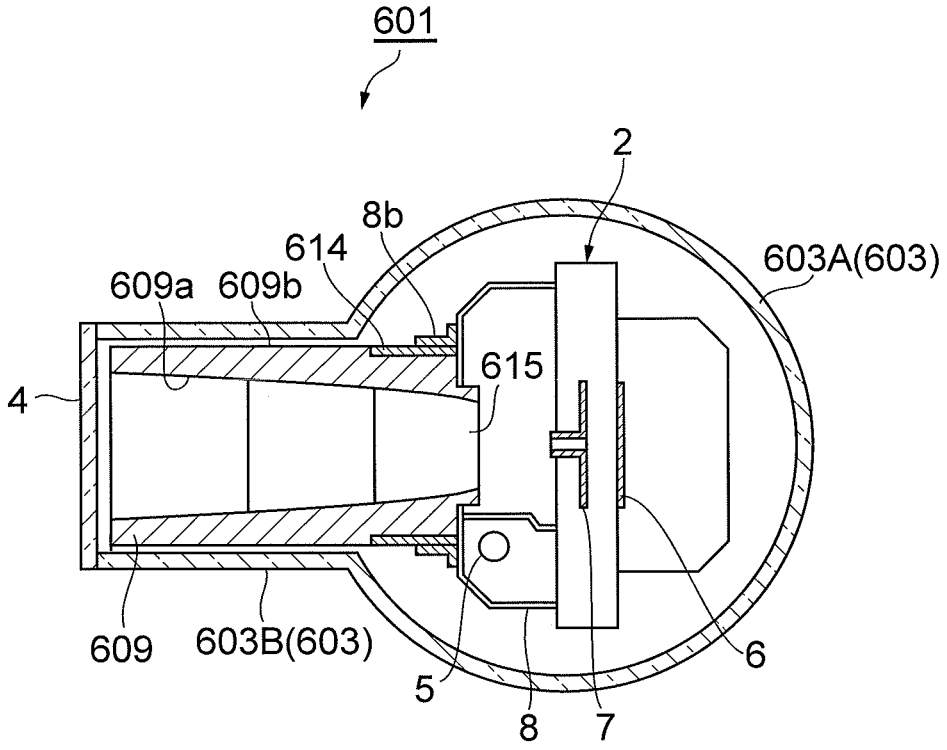
FIG. 10 is a sectional view showing a configuration of a light source according to a modification example of the present invention.

FIG. 10 shows a structure in which a reflective cylinder 609 is fixed to the housing case 8 of the luminescent part 2 by laser welding or spot welding, as light source 601 which is a modification example of the present invention. Particularly, a stainless steel ring 614 is fixed to an end of an external wall surface 609*b* of the reflective cylinder 609 and contact portions between the stainless steel ring 614 at the end and the fixing ring 8*b* of the housing case 8 are fused and secured to each other by laser welding or spot welding. In the light source 601 shown in the same drawing, a light guide cylinder 603B is formed in a short length and the reflective cylinder 609 is designed so as to match it, thereby to allow the distribution of emitted light to be parallel light or diffusion light and to enhance uniformity of light intensity on an illumination target surface. As in the light source 601, a projecting part 615 may be provided at the end of the reflective cylinder 609 on the luminescent cylinder 603A side so that the projecting part 615 is arranged to extend inside the housing case 8 and become closer to the discharge path limiter 7, in the range not to impede a current of charged particles. This configuration can increase the light amount from the exit window 4 and allows the capture of foreign matter such as the sputtered substance by the reflective cylinder 609, from the interior of the luminescent part 2, further preventing the adhesion of the sputtered substance onto the exit window 4 of low-temperature part.

The laser welding or spot welding shown in FIG. 10 may also be applied to the fixing of the reflective cylinder 9 in the third to sixth embodiments shown in FIGS. 6 to 9. In that case, it is preferable to fix a stainless steel ring to the end of the reflective cylinder 9 and weld the stainless steel ring to the fixing member, in the same manner as in FIG. 10.

A variety of shapes can be adopted for the structure for welding to be fixed at the tip of the reflective cylinder 609.

Figure 11:
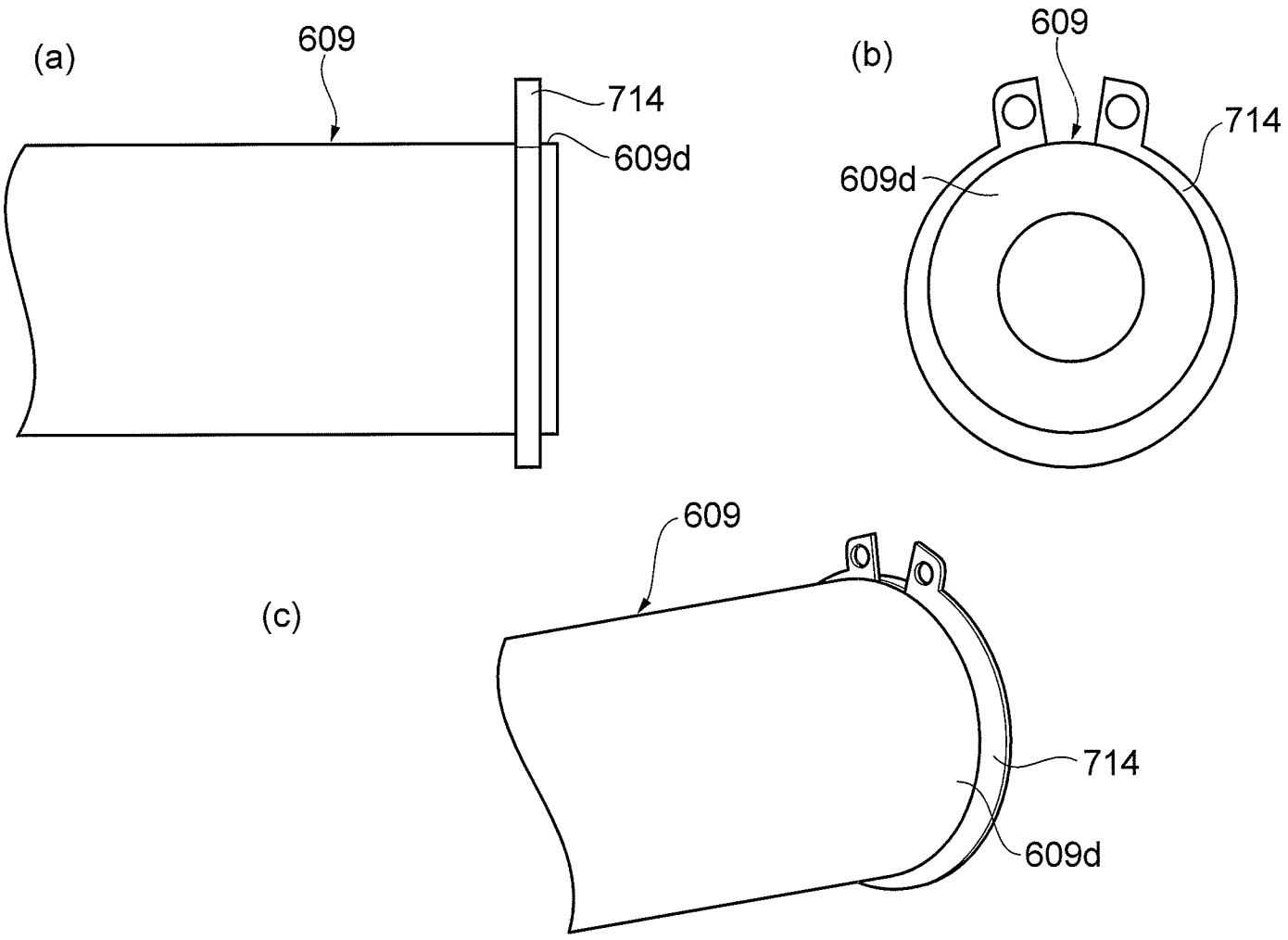
FIG. 11(*a*) is a side view of a reflective cylinder according to a modification example of the present invention, FIG. 11(*b*) an end view of the reflective cylinder in FIG. 11(*a*), and FIG. 11(*c*) a perspective view of the reflective cylinder in FIG. 11(*a*).

For example, as shown in FIG. 11, the reflective cylinder 609 may be fixed to the luminescent part 2 by fixing a retaining ring 714 such as a stainless steel C-shaped retaining ring to the outer periphery of the end 609*d* of the reflective cylinder 609 and welding the retaining ring 714 to a fixing member for the reflective cylinder which is provided in the housing case 8.

Figure 12:
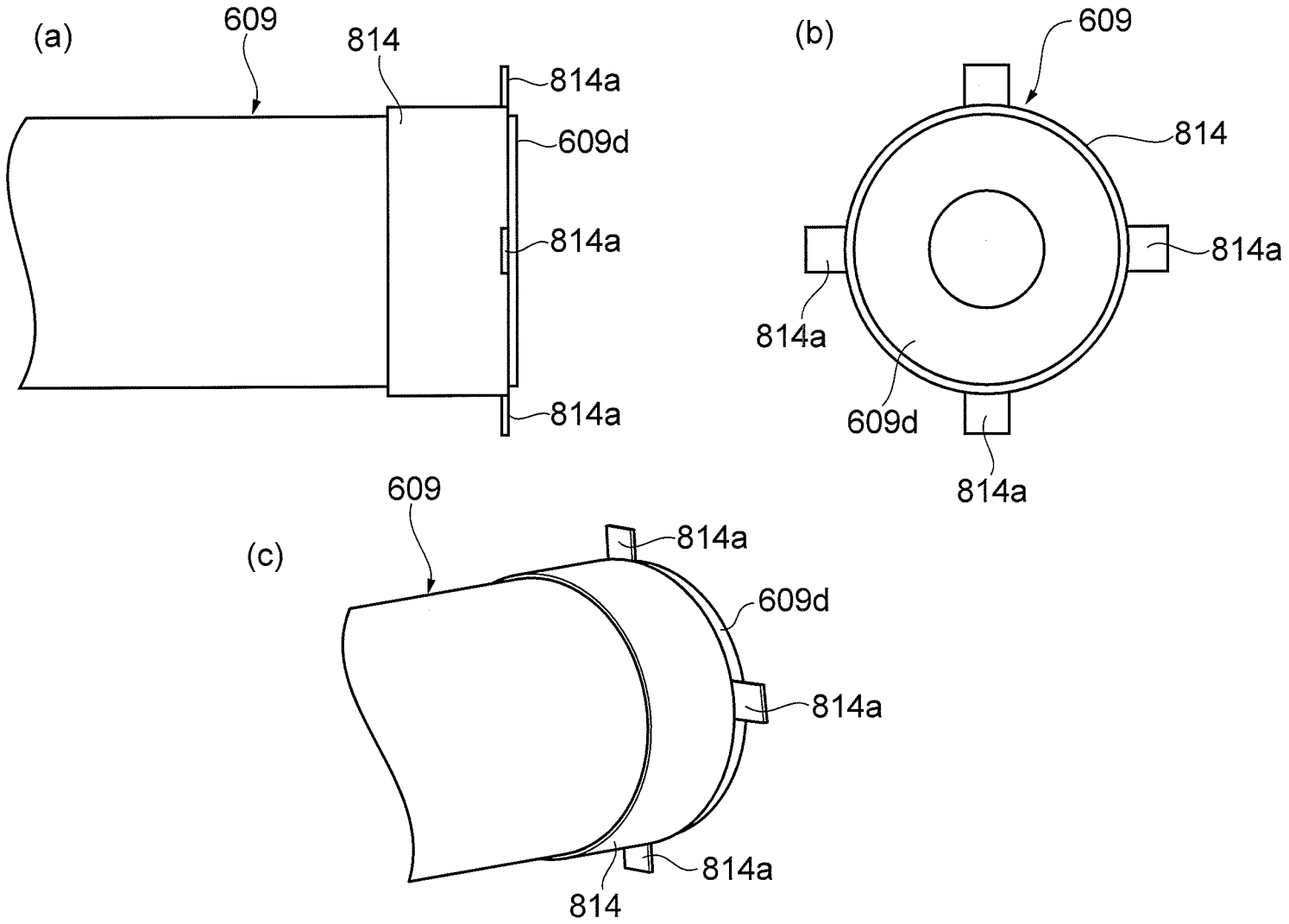
FIG. 12(*a*) is a side view of a reflective cylinder according to a modification example of the present invention, FIG. 12(*b*) an end view of the reflective cylinder in FIG. 12(*a*), and FIG. 12(*c*) a perspective view of the reflective cylinder in FIG. 12(*a*).

Furthermore, as shown in FIG. 12, it is also possible to adopt a configuration wherein a stainless steel sheet material 814 is wound in a belt shape around the outer periphery of the end 609*d* of the reflective cylinder 609 and their terminal ends are stacked and welded to be fixed. A plurality of flange portions 814*a* extending perpendicularly to the central axis of the reflective cylinder 609 are provided on the end 9*d* side of this sheet material 814 and the flange portions 814*a* and the fixing member are welded to fix the reflective cylinder 609. It is also possible to fix the reflective cylinder 609 by welding proximate portions between the sheet material 814 and the fixing member, without provision of the flange portions 814*a*.

Figure 13:
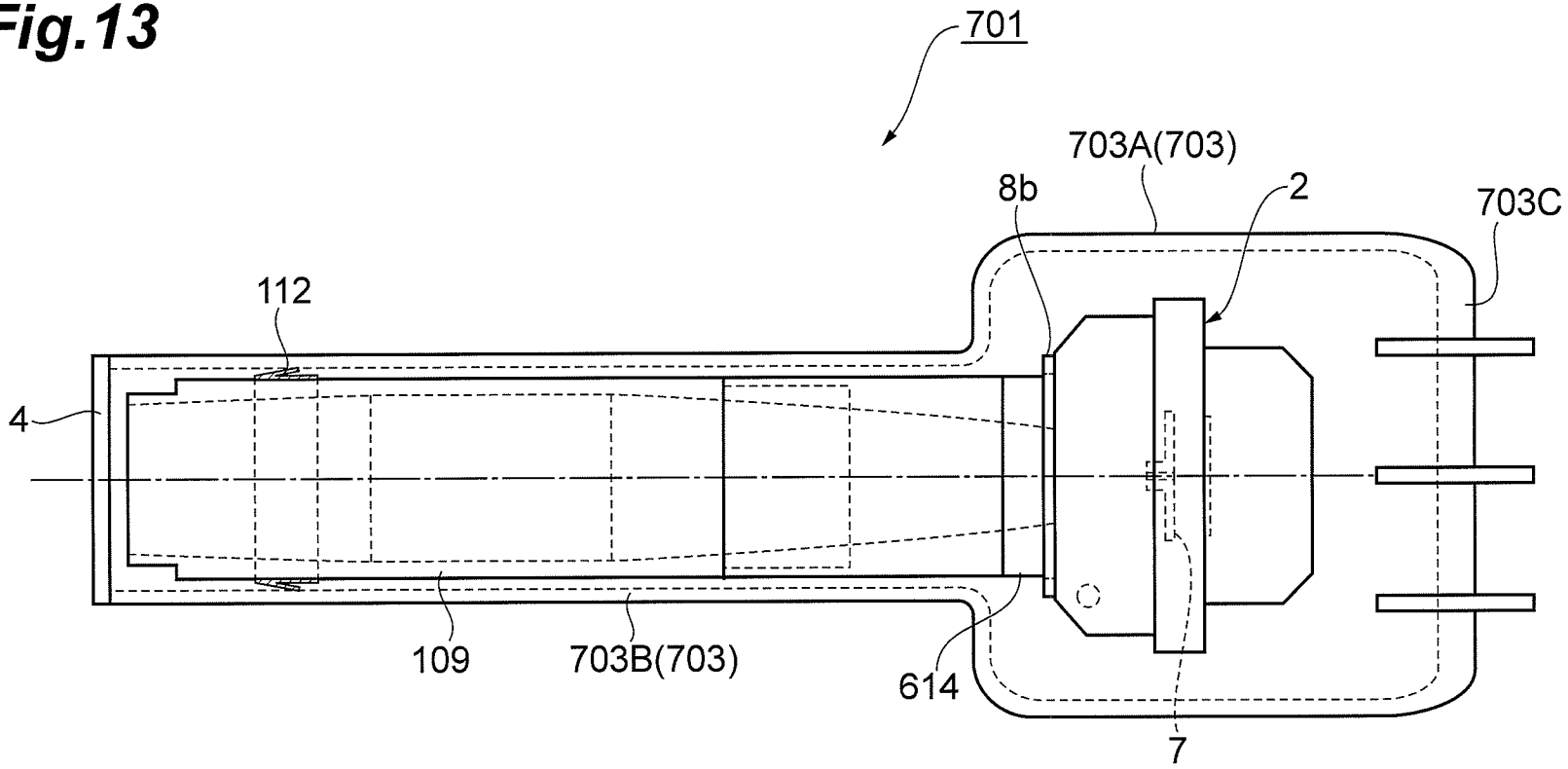
FIG. 13 is a side view showing a configuration of a light source according to a modification example of the present invention.

FIG. 13 shows a light source 701 as a deuterium lamp in which a stem 703C, a luminescent cylinder 703A, and a light guide cylinder 703B are arranged coaxially with the optical axis, as a modification example of the present invention. The light source 701 of this configuration can be assembled from the same axial direction. Particularly, the light source can be manufactured by fixing the reflective cylinder 109 to the fixing ring 8*b* of the luminescent part 2 to form an integrated combination, thereafter inserting the reflective cylinder 109 into a hermetic container 703 in which the light guide cylinder 703B and the luminescent cylinder 703A are integrated, and sealing the hermetic container 703 by the stem 703C. As in the case of the light source 601, the end ring 614 is forced onto this reflective cylinder 109 and fixed thereto and this end ring 614 and the fixing ring 8*b* are welded to fix the reflective cylinder 109. At the same time, the metal band 112 is fixed to the reflective cylinder 109 at the end of the outer wall surface 109*b* on the exit window 4 side, as in the case of the light source 101. This metal band 112 enhances the coaxiality of the light guide cylinder 703B and the reflective cylinder 109. Besides this fixing method, another fixing method may be adopted, e.g., a method of increasing the height of the fixing ring 8*b* and screw cutting the inserted part of the reflective cylinder 109 and the fixing ring 8*b* to fix them, or a method of forming tapped holes in the fixing ring 8*b*, inserting the reflective cylinder 109 into the fixing ring 8*b*, and then fixing them with screws or the like.

The thermal radiation film 10 is formed in part or in whole of the outer wall surface 9*b* of the reflective cylinder 9 in the light source 1, 101, or 201, but, conversely, a material with the thermal emissivity lower than that of the material of the reflective cylinder 9 may be formed on the portion of the outer wall surface 9*b* except for the end on the luminescent cylinder 3A or 203A side. This configuration relatively enhances heat radiation on the one end side and is expected to provide the same effect as the thermal radiation film 10. The material of the metal block member forming the one end side of the reflective cylinder 9 or 109 may be comprised of a material with the thermal emissivity larger than that of the material of the metal block member forming the other end side. The luminescent cylinder 3A, 203A, 303A, 403A, or 503A may be one having another luminescent form; e.g., it may use an excimer lamp.

Seventh Embodiment

Figure 14:
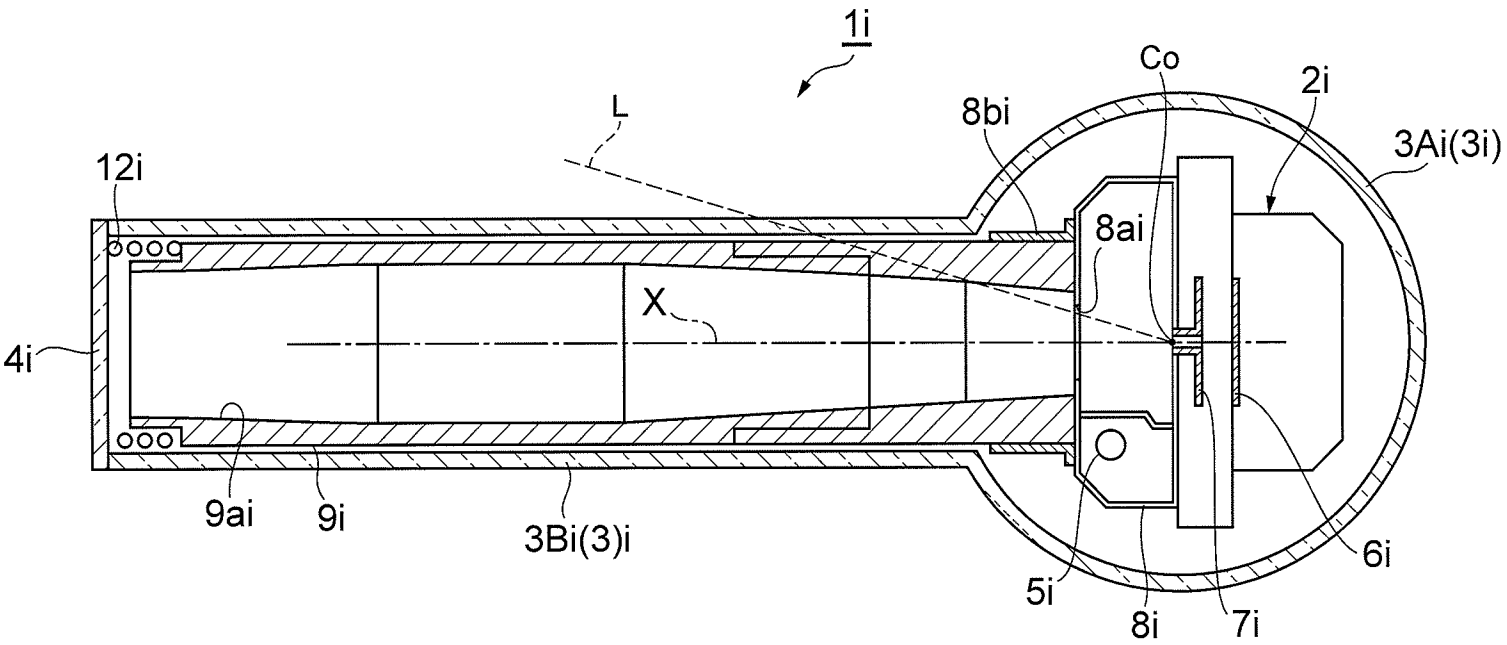
FIG. 14 is a sectional view showing a configuration of a deuterium lamp according to the seventh embodiment of the present invention.

FIG. 14 is a sectional view showing a configuration of a deuterium lamp according to the seventh embodiment of the present invention.

This deuterium lamp 1*i* is provided with a hermetic container 3*i* of glass in which a luminescent cylinder (first housing) 3Ai of a substantially cylindrical shape housing a luminescent part 2*i* to induce discharge of deuterium gas to generate light, is integrally connected to a light guide cylinder (second housing) 3Bi of a substantially cylindrical shape kept in communication with the luminescent cylinder 3Ai and projecting along the optical axis X of light generated by the luminescent part 2*i*, from the side wall of the luminescent cylinder 3Ai. In this hermetic container 3*i* deuterium gas is enclosed under the pressure of about several hundred Pa. More specifically, the light guide cylinder 3Bi is integrated in communication with the luminescent cylinder 3Ai on a one end side in the direction along the optical axis X and is sealed on the other end side by an exit window 4*i* to emit the light generated from the luminescent part 2*i*, to the outside. A material of this exit window 4*i* is, for example, $MgF_2$ (magnesium fluoride), LiF (lithium fluoride), silica glass, or sapphire glass.

The luminescent part 2*i* housed in the luminescent cylinder 3Ai is composed of a cathode 5*i*, an anode 6*i*, a discharge path limiter 7*i* arranged between the anode 6*i* and the cathode 5*i*, formed of an electrically-conductive high-melting-point metal in a central region, and having an aperture to limit a discharge path, and a housing case 8*i* arranged so as to surround these. In a surface of this housing case 8*i* on the light guide cylinder 3Bi side, a light passage port (aperture) 8*ai* of a rectangular shape for extraction of the light generated by the luminescent part 2*i* is formed so as to face the exit window 4*i* of the light guide cylinder 3Bi and, a fixing ring (fixing member) 8*bi* consisting of a wall part extending in a circular shape along the side wall of the light guide cylinder 3Bi is fixed so as to surround the light passage port 8*ai*. When a voltage is applied between the cathode 5*i* and the anode 6*i*, the luminescent part 2*i* induces ionization and discharge of the deuterium gas existing between them, to form a plasma state and the discharge path limiter 7*i* narrows it into a high-density plasma state, thereby to generate light (ultraviolet light), which is emitted from the light passage port 8*ai* of the housing case 8*i* into the direction along the optical axis X.

The foregoing luminescent part 2*i* is held in the luminescent cylinder 3Ai by a stem pin (not shown) standing on a stem part disposed on an end face of the luminescent cylinder 3Ai. Namely, this deuterium lamp 1*i* is a side-on type deuterium lamp in which the optical axis X intersects with the tube axis of the luminescent cylinder 3Ai.

Figure 15:
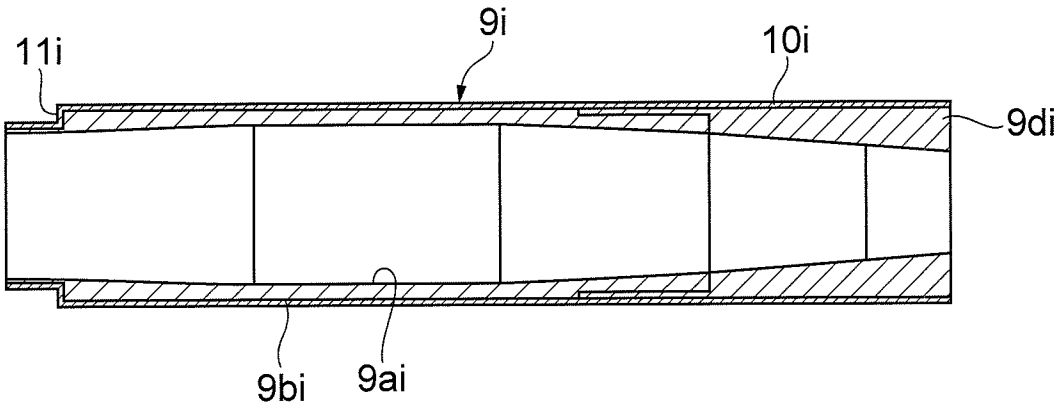
FIG. 15(*a*) is a sectional view of a reflective cylinder in FIG. 14 and FIG. 15(*b*) an end view of the reflective cylinder in FIG. 14.
Figure 15:
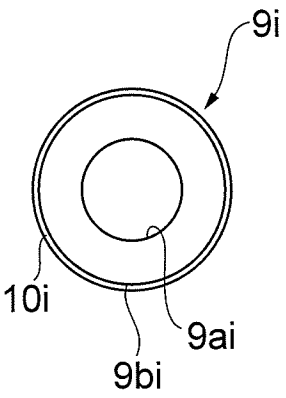

A reflective cylinder (cylindrical member) 9*i* of a substantially cylindrical shape is inserted and fixed between the exit window 4*i* in the hermetic container 3*i* of this configuration and a portion connecting the luminescent cylinder 3Ai and the light guide cylinder 3Bi. This reflective cylinder 9*i* is, as shown in FIG. 15, a combination of metal block members of aluminum and is formed in a substantially cylindrical shape having an outside diameter smaller than an inside diameter of the light guide cylinder 3Bi.

An inner wall surface of the reflective cylinder 9*i* itself is formed as a reflective surface 9*ai* which is a curved surface along the central axis of the reflective cylinder 9*i*, or a multi-step surface with inclination angles varying stepwise. Namely, this reflective surface 9*ai* is formed so that the two ends of the reflective cylinder 9*i* in the central-axis direction are tapered so as to be able to converge the light at a desired surface or point outside the exit window 4*i*. More specifically, the reflective surface 9*ai* is formed as inclined with respect to the central axis of the reflective cylinder 9*i*, i.e., with respect to the optical axis X so that the diameter of the space surrounded by the reflective surface 9*ai* gradually decreases from a longitudinal central region of the reflective cylinder 9*i* toward the end on the luminescent cylinder 3Ai side. Furthermore, the reflective surface 9*ai* is formed as inclined with respect to the central axis of the reflective cylinder 9*i* so that the diameter of the space surrounded by the reflective surface 9*ai* gradually decreases from the longitudinal central region of the reflective cylinder 9*i* toward the end on the exit window 4*i* side. The reflective surface 9*ai* is set at smaller angles of inclination to the optical axis X of the reflective surface 9*ai* than a line L connecting a luminescent center $C_0$ located at the center of the aperture of the discharge path limiter 7*i* of the luminescent part 2*i*, and the end on the luminescent part 2*i* side of the reflective surface 9*ai*. For example, the inclination angle of the reflective surface 9*ai* in the stage closest to the luminescent center $C_0$ side is set in the range of 2 to 15°, while the inclination angle of the line L to the optical axis X is in the range of 10 to 30°. The tapered structure of the reflective surface 9*ai* may be provided at either one of the two ends of the reflective cylinder 9*i* in the central-axis direction, instead of that at the two ends; for example, the reflective surface 9*ai* may be formed in the tapered shape as described above, only on the luminescent part 2*i* side (one end side), while the reflective surface 9*ai* is formed in parallel to the central axis of the reflective cylinder 9*i* on the exit window 4*i* side (the other end side).

This reflective surface 9*ai* is processed in a mirror surface state capable of regularly reflecting the light generated by the luminescent part 2*i* and is formed, for example, by cutting the metal block members, polishing an inner wall thereof by a polishing method such as buffing, chemical polishing, electropolishing, or a derivative thereof, or by a polishing method as a complex thereof, and thereafter subjecting the surface to a washing treatment or a vacuum treatment or the like to remove an impurity gas component. In the present embodiment the reflective cylinder 9*i* is composed of a combination of two members and, when the reflective surface 9*ai* is formed of a plurality of metal block members as in this configuration, a ratio of length and inside diameter (aspect ratio) of the reflective surface 9*ai* of each metal block member can be set smaller, so as to facilitate achievement of desired flatness during processing and shaping, thereby enhancing the mirror accuracy of the reflective surface 9*ai*.

Furthermore, a thermal radiation film 10*i* containing a material with high thermal emissivity is formed over almost the entire area of an outer wall surface 9*bi* of the reflective cylinder 9*i*. The material of this thermal radiation film 10*i* to be used is one with the thermal emissivity higher than that of the material of the reflective cylinder 9*i*, e.g., aluminum oxide. The thermal radiation film 10*i* is formed, for example, by depositing the material forming the thermal radiation film 10*i*, on the outer wall surface 9*bi* of the reflective cylinder 9*i* by evaporation, coating, or the like, but, particularly, in the case where the reflective cylinder 9*i* is made of aluminum as in the present embodiment, a layer of aluminum oxide as the thermal radiation film 10*i* may be formed by oxidizing the outer wall surface 9*bi* of the reflective cylinder 9*i*.

A cut portion 11*i* cut in a circular shape so as to form a stepped projection is formed along the outer wall surface 9*bi*, in a peripheral edge region on the longitudinal other end side of the outer wall surface 9*bi* of the reflective cylinder 9*i*. This cut portion 11*i* is provided for positioning the reflective cylinder 9*i* in the hermetic container 3*i*.

Figure 16:
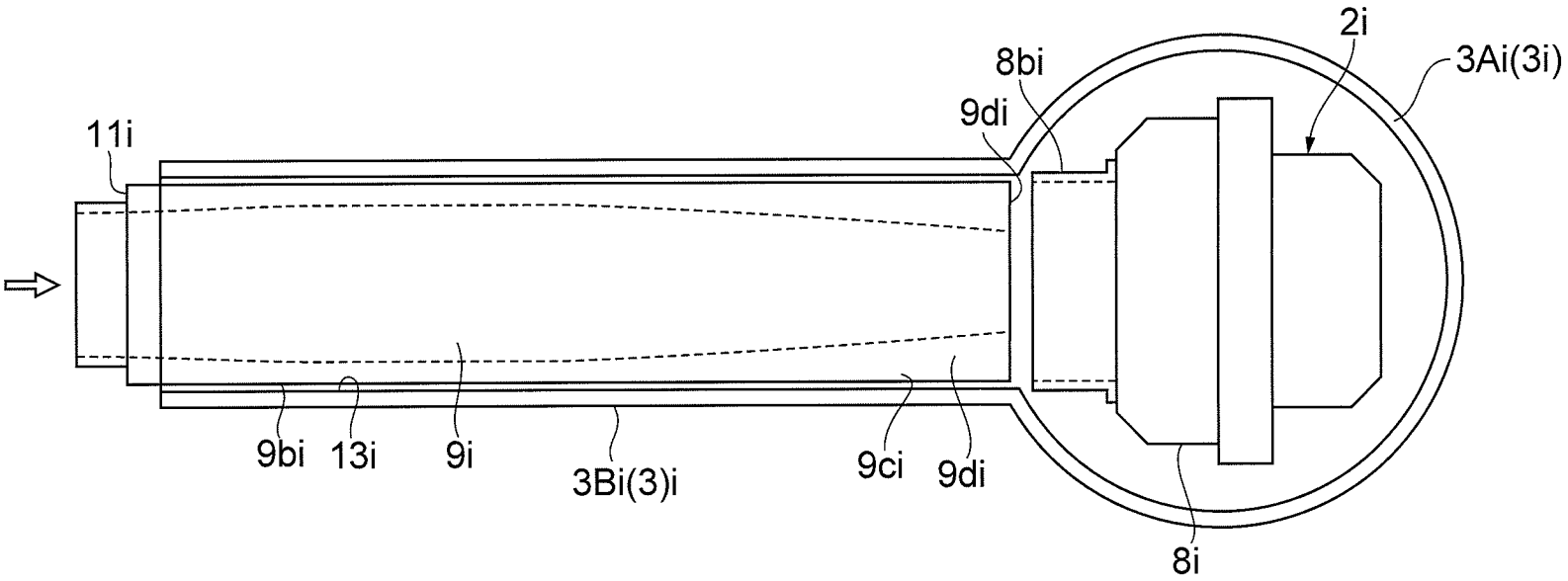
FIG. 16 is a side view showing an assembling state of the reflective cylinder in the deuterium lamp in FIG. 14.

The reflective cylinder 9*i* of this configuration is inserted along the tube axis (optical axis X) of the light guide cylinder 3Bi from the edge region 9*di* side until the edge region 9*di* on the one end side comes into contact with the housing case 8*i* of the luminescent part 2*i* and, after a spring member 12*i* is attached along the outer wall surface 9*bi* to the cut portion 11*i*, the other end side of the light guide cylinder 3Bi is sealed by the exit window 4*i* (FIG. 14 and FIG. 16). At this time, the reflective cylinder 9*i* is fitted into the fixing ring 8*bi* of the housing case 8*i* in a state in which the outer wall surface 9*bi* thereof is separated from the inner wall surface 13*i* of the light guide cylinder 3Bi (FIG. 16). This spring member 12*i* is a member for positioning of the reflective cylinder 9*i*, which is comprised of a metal member, e.g., stainless steel or an Inconel material with high thermal resistance, and which is arranged between the cut portion 11*i* and the exit window 4*i*, with a function to urge the reflective cylinder 9*i* from the exit window 4*i* side toward the luminescent part 2*i* along the optical axis X, thereby to press the reflective cylinder 9*i* against the housing case 8*i*. By this, the reflective cylinder 9*i* is positioned in a state in which the edge region 9*di* on the one end side is in contact with the housing container 8*i* of the luminescent part 2*i* and the other end side is inserted in the light guide cylinder 3Bi to be in close proximity to the exit window 4*i*, between the exit window 4*i* and the luminescent part 2*i* in the hermetic container 3*i*.

In the deuterium lamp 1*i* described above, the discharge path limiter 7*i* narrows the discharge caused between the cathode 5*i* and the anode 6*i* of the luminescent part 2*i* in the luminescent cylinder 3Ai to generate light, and the light generated by the luminescent part 2*i* is guided to the interior of the reflective cylinder 9*i* inserted from the exit window 4*i* of the light guide cylinder 3Bi in communication with the luminescent cylinder 3Ai to the luminescent part 2*i*, thereby to be emitted from the exit window 4*i*. Since the reflective surface 9*ai* is formed on the inner wall surface of the reflective cylinder 9*i* herein, the light emitted from the luminescent part 2*i* is guided from the one end side to the other end side of the light guide cylinder 3Bi while being reflected by the reflective surface 9*ai* inside the reflective cylinder 9*i*, so that the light emitted from the luminescent part 2*i* can be guided to the exit window 4*i* of the light guide cylinder 3Bi, without loss. In addition, since the two ends of the reflective surface 9*ai* are formed in the taper shape, the light can be converged at the predetermined position outside the exit window 4*i*. Furthermore, the efficiency of extraction of the light from the exit window 4*i* improves, so as to increase a total light amount of the output light and a light amount on the illumination target surface. In the case of the conventional deuterium lamps, a light radiation pattern from the exit window tends to vary according to the distance from the exit window to cause an omission where radiant light is weak, whereas the deuterium lamp 1*i* achieves reduction in occurrence of such an omission of the light radiation pattern. As a result, the generated light can be extracted efficiently.

Figure 17:
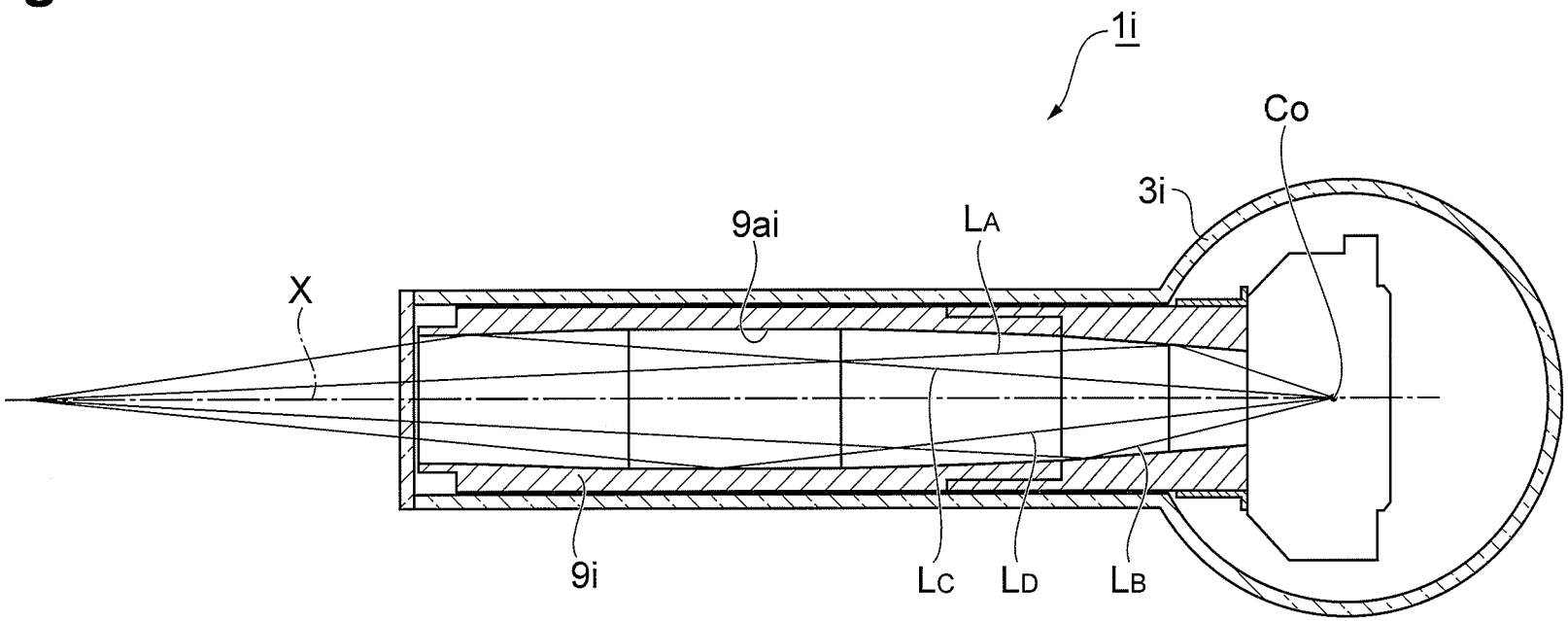
FIG. 17 is a drawing showing optical paths of light components in various light emission directions from a luminescent center in the deuterium lamp in FIG. 14.
Figure 29:
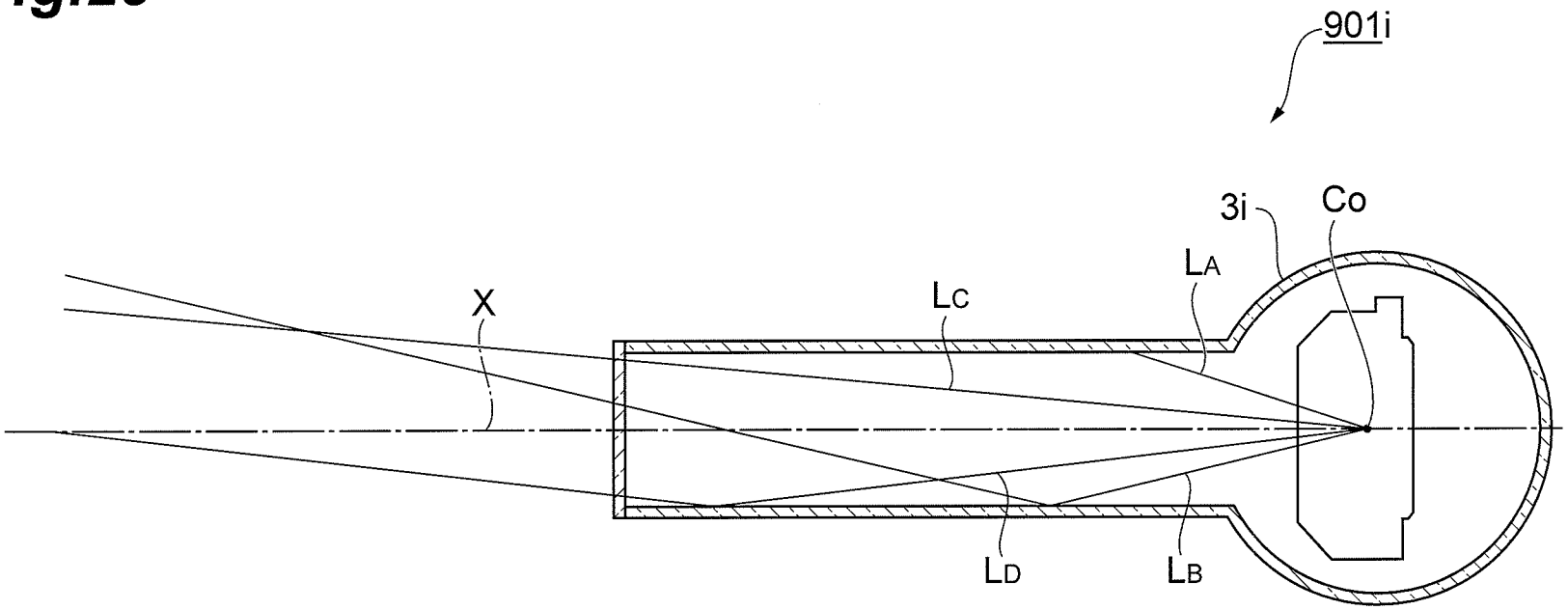
FIG. 29 is a drawing showing optical paths of light components in various light emission directions from a luminescent center in a deuterium lamp according to a comparative example of the present invention.

FIG. 17 is a drawing showing optical paths of light components in various light emission directions from the luminescent center $C_0$ in the deuterium lamp 1*i* and FIG. 29 a drawing showing optical paths of light components in various light emission directions from the luminescent center $C_0$ in a deuterium lamp 901*i* obtained by removing the reflective cylinder 9*i* from the deuterium lamp 1*i*.

As shown in FIG. 29, the light component $L_A$ with a large emission angle relative to the optical axis X is not totally reflected in the deuterium lamp 901*i* but is transmitted or absorbed by the hermetic container 3*i*. In contrast to it, in the deuterium lamp 1*i* as shown in FIG. 17, this light component $L_A$ is also totally reflected by the reflective surface 9*ai* to function as a forward irradiation component, increasing an amount of radiant light. Furthermore, since the reflective surface 9*ai* on the luminescent center $C_0$ side is tapered, reflected light can be converged around a desired position from the exit window 4*i* without forming diverging components.

The light components $L_B$, $L_D$, which are reflected by the hermetic container 3*i* to become diverging light in the case of the deuterium lamp 901*i*, can also be converged around the desired position in the case of the deuterium lamp 1*i*. Furthermore, since the reflective surface 9*ai* is tapered on the exit window 4*i* side in the deuterium lamp 1*i*, the light component $L_C$, which diverges from the exit window 4*i* in the case of the deuterium lamp 901*i* because of a small emission angle relative to the optical axis X, can be used as a converging component and the light component $L_D$ can be converged at an appropriate position around the desired position. As a result, the reflective surface 9*ai* of the reflective cylinder 9*i* can be formed in the structure capable of using many components of radiant light as converging components.

By adjusting the shape of the tapered portions in the reflective surface 9*ai* of the reflective cylinder 9*i*, the emitted light from the exit window 4*i* can also have a distribution with many parallel light components or a divergent distribution on the contrary, instead of the convergent distribution.

Since the reflective cylinder 9*i* itself is comprised of the metal members such as the metal block members of aluminum to facilitate processing of the reflective surface with high mirror accuracy, the generated light can be effectively converged. Furthermore, for example, unlike the case where the reflective film of metal or the like is formed inside the reflective cylinder 9*i*, it is feasible to prevent the degradation of performance and generation of foreign matter due to delamination or dropout or the like of the reflective surface 9*ai* caused by the difference between coefficients of expansion of the constituent materials with repetitions of increase and decrease of temperature, and thereby to achieve extension of service life. In addition, the generated ultraviolet light is not transmitted and the ultraviolet light does not cause deterioration, whereby the generated light can be extracted more efficiently.

Furthermore, since the outer wall surface 9*bi* of the reflective cylinder 9*i* is separated from the inner wall surface 13*i* of the light guide cylinder 3Bi, it is feasible to prevent the positional deviation of the reflective cylinder 9*i* and the breakage of the reflective cylinder 9*i* or the light guide cylinder 3Bi, because of the difference of coefficients of thermal expansion between the reflective cylinder 9*i* and the light guide cylinder 3Bi.

Since the reflective cylinder 9*i* is urged into the fixing ring 8*bi* of the housing case 8*i* by the spring member 12*i* as the positioning member of the metal member to be positioned in the hermetic container 3*i*, it is prevented from being deteriorated by the generated ultraviolet light, and it becomes easier to achieve positioning and axial alignment of the reflective cylinder 9*i* relative to the aperture of the discharge path limiter 7*i* of the luminescent part 2*i*, so as to improve position accuracy, which can ensure sufficient extraction efficiency of light from the exit window 4*i*. Furthermore, by adopting the structure to push the reflective cylinder against the housing case 8*i* by the spring member 12*i*, it is feasible to stably fix the reflective cylinder 9*i* to the hermetic container 3*i* and to absorb positional deviation thereof relative to the luminescent cylinder 3Ai by the spring member 12*i* even with occurrence of thermal expansion along the central-axis direction of the reflective cylinder 9*i*. It can also be contemplated herein that the radiant light distribution is adjusted by aligning the positional and angular relations between the light guide cylinder 3Bi and the aperture of the discharge path limiter 7*i* during sealing of the deuterium lamp, but it becomes difficult in this case to achieve position adjustment because of the large difference between depth positions of the exit window 4*i* and the aperture. In the present embodiment, the reflective cylinder 9*i* is introduced to stably determine the positional relationship between the light guide cylinder 3Bi and the reflective cylinder 9*i* and the alignment between the reflective cylinder 9*i* and the fixing ring 8*bi* results in also achieving the positional and angular relations between the reflective cylinder 9*i* and the aperture. Therefore, accurate alignment is achieved as to the positional relationship between the light guide cylinder 3Bi and the aperture.

Furthermore, since the thermal radiation film 10*i* is formed over almost the entire area of the outer wall surface 9*bi* of the reflective cylinder 9*i*, as shown in FIG. 15, a region at lower temperature than the surroundings and the enclosed gas can be formed on the inner surface of the reflective cylinder 9*i* in close proximity to the luminescent part 2*i* and the lower-temperature region can capture the foreign matter such as the sputtered substance from the luminescent cylinder 3Ai, so as to prevent diffusion of the foreign matter to the exit window 4*i* and reduction of optical transmittance caused thereby.

When the deuterium lamp 1*i* of this configuration is used a photoionization source in a mass spectrometer (MS) such as a gas chromatography mass spectrometer (GC/MS) or a liquid chromatography mass spectrometer (LC/MS), it is feasible to achieve high sensitivity, prevent contamination of the window material, and achieve a good time response characteristic. Firstly, the light amount on the irradiation target surface can be drastically increased so as to improve a probability of contact with a sample, whereby the sensitivity can be improved to a large extent (nearly ten times) in comparison to the conventional photoionization sources. It also becomes feasible to achieve convergence of light suitable for a variety of MSs, and the measurement sensitivity is enhanced on the following points. Specifically, in the case of MS, the light can be focused on an effective portion of an electric field distribution for introducing ions to a discriminator in an ionization chamber. In the case of GC/MS, the light can be effectively focused and introduced through an aperture of about several mm of the ionization chamber. In the case of LC/MS, the light can be focused around an aperture to introduce ions into the discriminator, to enhance an ion density, and the window of the photoionization source can be located away from a sample ejection port to prevent contamination of the window, while avoiding degradation of sensitivity even at the distant location from the ionization source because of the enhancement of light convergence more than before. Namely, the high-density light is guided onto a high-density sample part to enhance ionization efficiency, thereby achieving high sensitivity; the window of the photoionization source is located away from the sample ejection port, thereby preventing contamination of the window; the light is focused on the sample ejection port, thereby increasing the response speed.

Eighth Embodiment

Figure 18:
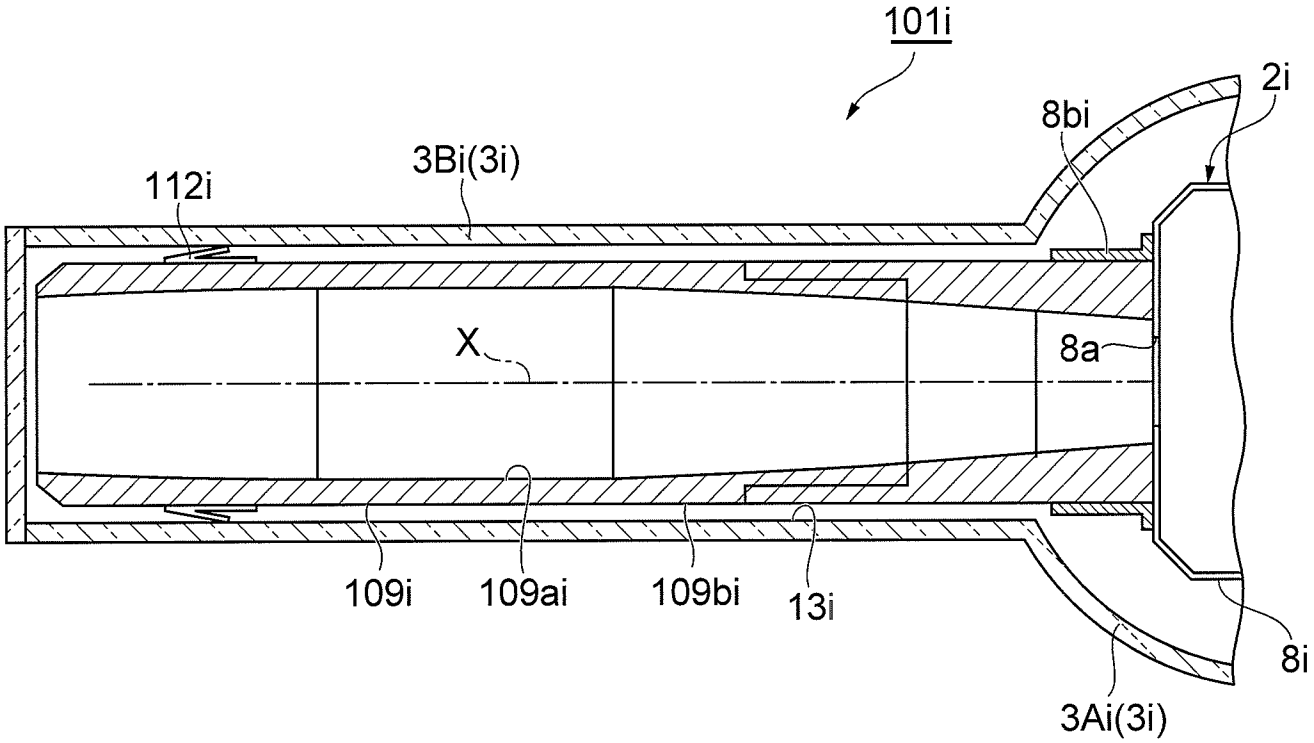
FIG. 18 is a sectional view showing a configuration of a deuterium lamp according to the eighth embodiment of the present invention.
Figure 19:
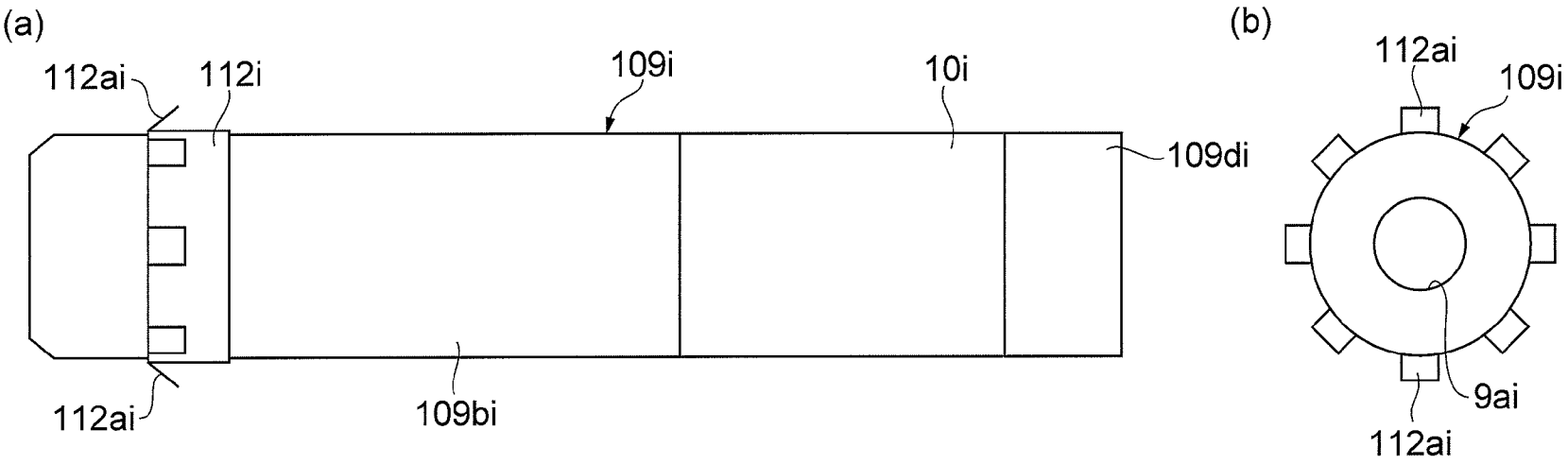
FIG. 19(*a*) is a side view of a reflective cylinder in FIG. 18 and FIG. 19(*b*) an end view of the reflective cylinder in FIG. 18.

FIG. 18 is a sectional view showing a configuration of a deuterium lamp according to the eighth embodiment of the present invention, FIG. 19(*a*) a side view of a reflective cylinder in FIG. 18, and FIG. 19(*b*) an end view of the reflective cylinder in FIG. 18. The deuterium lamp 101*i* shown in the same drawings is different mainly in the positioning structure of the reflective cylinder 109*i* from that in the seventh embodiment.

Specifically, a metal band 112*i* as a positioning member is fixed to the reflective cylinder 109*i* set inside the deuterium lamp 101*i*, at an end of its outer wall surface 109*bi* on the exit window 4*i* side. In this metal band 112*i*, a plurality of claws 112*ai* with spring action are formed along the outer periphery of the reflective cylinder 109*i*, and the metal band 112*i* is welded at its end by lap welding to be fixed on the outer wall surface 109*bi*. The reflective cylinder 109*i* of this configuration is inserted into the hermetic container 3*i* along the inner wall surface 13*i* of the light guide cylinder 3Bi and is fixed so that the outer wall surface 109*bi* is separated from the inner wall surface 13*i* except for the metal band 112*i*.

In this structure, the reflective cylinder 109*i* is urged at its edge region 109*di* on the one end side thereof against the fixing ring 8*bi* of the housing case 8*i* by spring forces of the claws 112*ai* of the metal band 112*i*, to be positioned in the direction along the optical axis X in the hermetic container 3*i*. In conjunction therewith, the reflective cylinder 109*i* is also positioned in the directions perpendicular to the optical axis X in a state in which the outer wall surface 109*bi* thereof and the inner wall surface 13*i* of the light guide cylinder 3Bi are separated from each other at a fixed distance, by the claws 112*ai* of the metal band 112*i*. If a groove is formed in the width of the metal band in the region of the reflective cylinder

109*i* where the metal band 112*i* is mounted, the distance from the metal band 112*i* to the inner wall surface 13*i* of the light guide cylinder 3Bi can be set larger without increase in the inside diameter of the light guide cylinder 3Bi and angles of the claws 112*ai* can be increased, with the result of increase in the spring forces of the claws 112*ai*.

The deuterium lamp 101*i* of this configuration can also prevent the positional deviation of the reflective cylinder 109*i* and the breakage of the reflective cylinder 109*i* or the light guide cylinder 3Bi, because of the difference of coefficients of thermal expansion between the reflective cylinder 109*i* and the light guide cylinder 3Bi. Since the reflective cylinder 109*i* is urged into the fixing ring 8*bi* of the housing case 8*i* by the metal band 112*i* as the positioning member to be positioned in the hermetic container 3*i*, it becomes easier to achieve the positioning and axial alignment of the reflective cylinder 9*i* relative to the aperture of the discharge path limiter 7*i* of the luminescent part 2*i*, so as to improve the position accuracy, which can ensure sufficient extraction efficiency of light from the exit window 4*i*. Particularly, in the present embodiment, the coaxiality of the reflective cylinder 9*i* and the light guide cylinder 3Bi can be maintained on a stable basis.

Since the two ends of the reflective surface 9*ai* are formed in the taper shape, the light can be efficiently extracted from the exit window 4*i* so as to converge the light at the predetermined position outside the exit window 4*i*, and the light amount of emitted light can be increased on the irradiation target surface.

Ninth Embodiment

Figure 20:
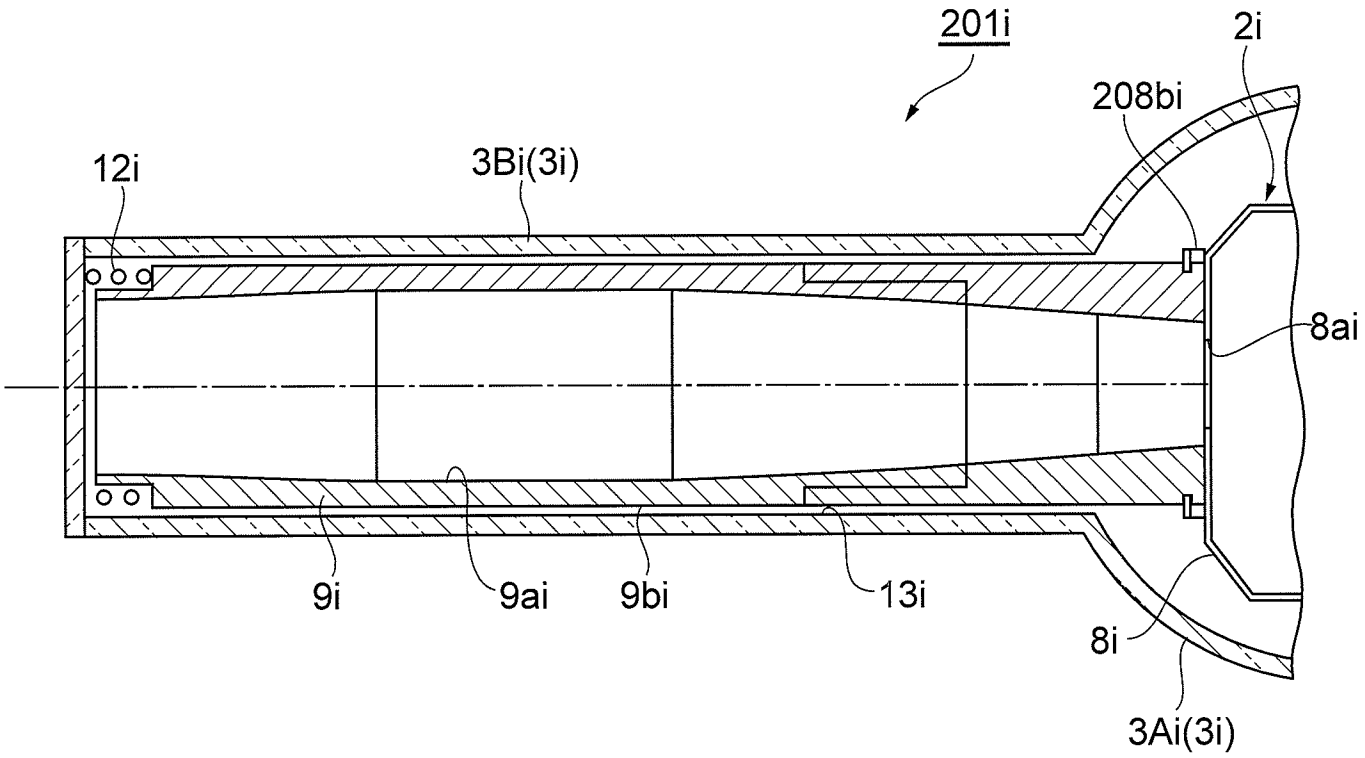
FIG. 20 is a sectional view showing a configuration of a deuterium lamp according to the ninth embodiment of the present invention.
Figure 21:
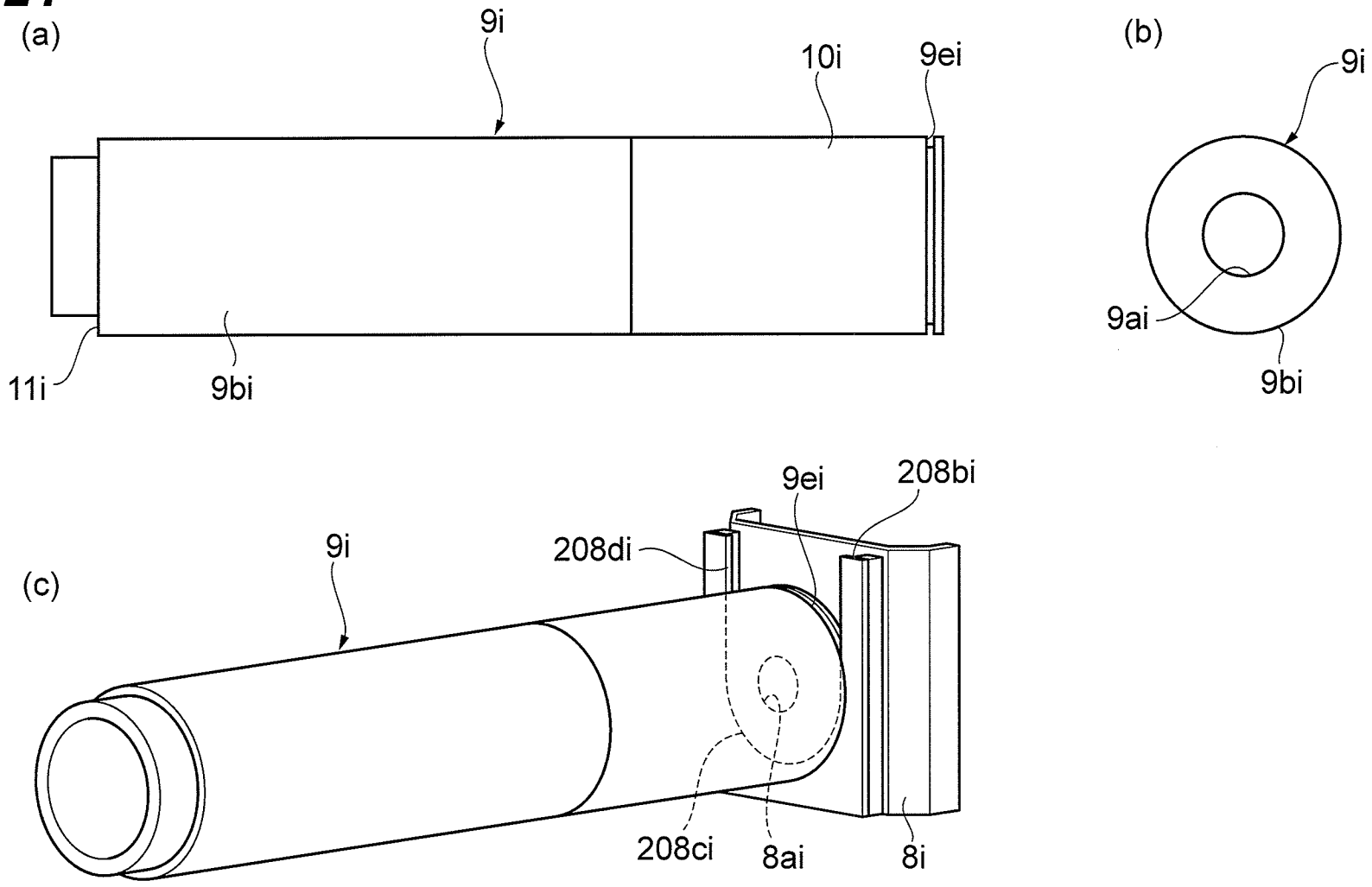
FIG. 21(*a*) is a side view of a reflective cylinder in FIG. 20, FIG. 21(*b*) an end view of the reflective cylinder in FIG. 20, and FIG. 21(*c*) a perspective view showing a state in which the reflective cylinder in FIG. 20 is fixed to a housing case.

FIG. 20 is a sectional view showing a configuration of a deuterium lamp according to the ninth embodiment of the present invention, FIG. 21(*a*) a side view of a reflective cylinder in FIG. 20, FIG. 21(*b*) an end view of the reflective cylinder in FIG. 20, and FIG. 21(*c*) a perspective view of the reflective cylinder in FIG. 20. The deuterium lamp 201*i* shown in the same drawings is different in the positioning structure on the luminescent part side of the reflective cylinder from that in the seventh embodiment.

Specifically, a groove 9*ei* is formed along the outer periphery of the reflective cylinder 9*i*, on the longitudinal one end side of the outer wall surface 9*bi* of the reflective cylinder 9*i* in the deuterium lamp 201*i*. Fixed to a surface of the housing case 8*i* of the luminescent part 2*i* on the light guide cylinder 3Bi side is a claw portion (fixing member) 208*bi* to fix the end of the reflective cylinder 9*i* by engagement of the groove 9*ei* of the reflective cylinder 9*i* therewith. This claw portion 208*bi* has a semicircular portion 208*ci* arranged so as to surround the light passage port 8*ai* of the housing case 8*i*, and opening ends 208*di* formed in a linear shape so as to extend from the semicircular portion 208*ci*, which are provided for insertion of the reflective cylinder 9*i* therein (FIG. 21(*c*)).

In this structure, the reflective cylinder 9*i* is inserted in a direction perpendicular to the central axis with the projection of the claw portion 208*bi* sliding along the groove 9*ei*, from the opening ends 208*di* of the claw portion 208*bi*, and is positioned relative to the housing case 8*i* after it is moved to the deep end of the semicircular portion 208*ci*. Optionally, a stopper for keeping the reflective cylinder 9*i* from returning to the opening ends 208*di* upon the insertion to the deep end of the semicircular portion 208*ci* may be provided at a part close to the outer periphery of the reflective cylinder 9*i* in the claw portion 208*bi*. Since the width of the groove 9*ei* has some margin for the claw portion 208*bi*, the reflective cylinder 9*i* is urged by the spring member 12*i* to be pushed against the housing case 8*i*, whereby it is positioned in the direction along the optical axis X in the hermetic container 3*i*. In conjunction therewith, as the reflective cylinder 9*i* is inserted into the semicircular portion 208*ci* of the claw portion 208*bi*, the reflective cylinder 9*i* is also positioned in the direction perpendicular to the optical axis X in a state in which the outer wall surface 9*bi* thereof is separated at a fixed distance from the inner wall surface 13*i* of the light guide cylinder 3Bi. In this case, if a spring member to urge the reflective cylinder 9*i* toward the housing case 8*i* is incorporated in the claw portion 208*bi*, the spring member 12*i* can be omitted.

The deuterium lamp 201*i* of this configuration can also prevent the positional deviation of the reflective cylinder 9*i* and the breakage of the reflective cylinder 9*i* or the light guide cylinder 3Bi, because of the difference of coefficients of thermal expansion between the reflective cylinder 9*i* and the light guide cylinder 3Bi. Since the longitudinal other end face of the reflective cylinder 9*i*, i.e., the surface opposed to the exit window 4*i* is separated from the exit window 4*i*, the glass material and the window material are prevented from breaking even with the difference of expansion of the materials due to temperature during assembly and manufacture and during operation.

The reflective cylinder 9*i* is urged by the spring member 12*i* as the positioning member to come into contact with the housing case 8*i* and is inserted into the claw portion 208*bi* to be positioned in the hermetic container 3*i*. This facilitates the positioning and axial alignment of the reflective cylinder 9*i* relative to the aperture of the discharge path limiter 7*i* of the luminescent part 2*i*, so as to improve the position accuracy, whereby the light can be efficiently extracted from the exit window 4*i*. Particularly, in the present embodiment, the coaxiality of the reflective cylinder 9*i* and the light guide cylinder 3Bi can also be maintained on a stable basis.

Since the two ends of the reflective surface 9*ai* are formed in the taper shape, the light can be extracted more efficiently from the exit window 4*i* while being converged at the predetermined position outside the exit window 4*i*, which can increase the light amount of the emitted light on the illumination target surface.

The present invention does not have to be limited to the above-described embodiments. For example, the reflective surface 9*ai* or 109*ai* was formed on the reflective cylinder 9*i* or 109*i* by polishing the inner wall of the metal members, but the reflective surface may be formed by evaporation or sputtering. Particularly, the reflective surface can be formed by preparing a base by cutting or molding of a metal member such as aluminum, or a member of glass, ceramic, or the like, polishing the base if necessary, and thereafter depositing an aluminum, rhodium, or dielectric multilayer film or the like on a mirror surface of the base by evaporation or sputtering. The reflective cylinder 9*i* or 109*i* was formed of a plurality of metal block members, but it may be formed as an integral body.

In the foregoing embodiments, the reflective cylinder 9*i* or 109*i* was fixed by pressing it against the fixing member provided on the luminescent cylinder 3Ai side, but it may be fixed directly to the fixing member by laser welding, spot welding, or the like. In this case, if it is difficult to weld the reflective cylinder directly to the fixing member, it is possible to adopt a method of fixing a weldable structure to the reflective cylinder by engagement or the like and welding the structure to the fixing member. In the case of the laser welding, it is also possible to perform the welding through the glass member of the luminescent cylinder 3Ai.

Figure 22:
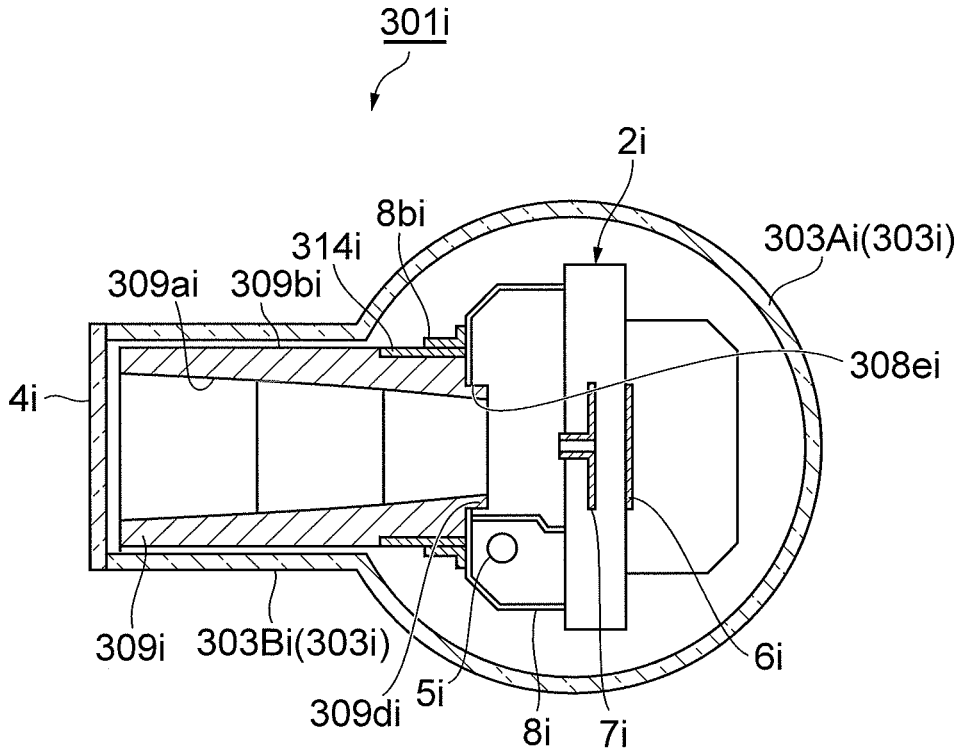
FIG. 22 is a sectional view showing a configuration of a deuterium lamp according to a modification example of the present invention.

FIG. 22 shows a structure in which a reflective cylinder 309*i* comprised of metal members of two different materials is fixed to the housing case 8*i* of the luminescent part 2*i* by laser welding or spot welding, as a deuterium lamp 301*i* which is a modification example of the present invention. Particularly, an end ring 314*i* of stainless steel is fixed to the outer periphery of an end 309*di* on the one end side of the reflective cylinder 309*i* of aluminum and contact portions between the end ring 314*i* and the fixing ring 8*bi* of the housing case 8*i* are fused and secured to each other by laser welding or spot welding. In the deuterium lamp 301*i* shown in the same drawing, the light guide cylinder 303Bi is set shorter, but the distribution of emitted light can also be parallel light or diverging light by designing the reflective cylinder 309*i* so as to match it, and the uniformity of light intensity on the illumination target surface can also be enhanced. As shown in the same drawing, a hole 308*ei* may be provided inside the fixing ring 8*bi* on the housing case 8*i* and the tip of the end 309*di* of the reflective cylinder 309*i* may be set in the hole 308*ei* so as to be located near the discharge path limiter 7*i* within the range not to impede the current of charged particles. In this configuration, the reflective cylinder 9*i* (reflective surface 9*ai*) is arranged in close proximity to the interior of the luminescent part 2*i*, whereby the light can be extracted more efficiently from the exit window 4*i*.

A variety of shapes can be adopted for the structure for welding to be fixed at the tip of the reflective cylinder 309*i*.

Figure 23:
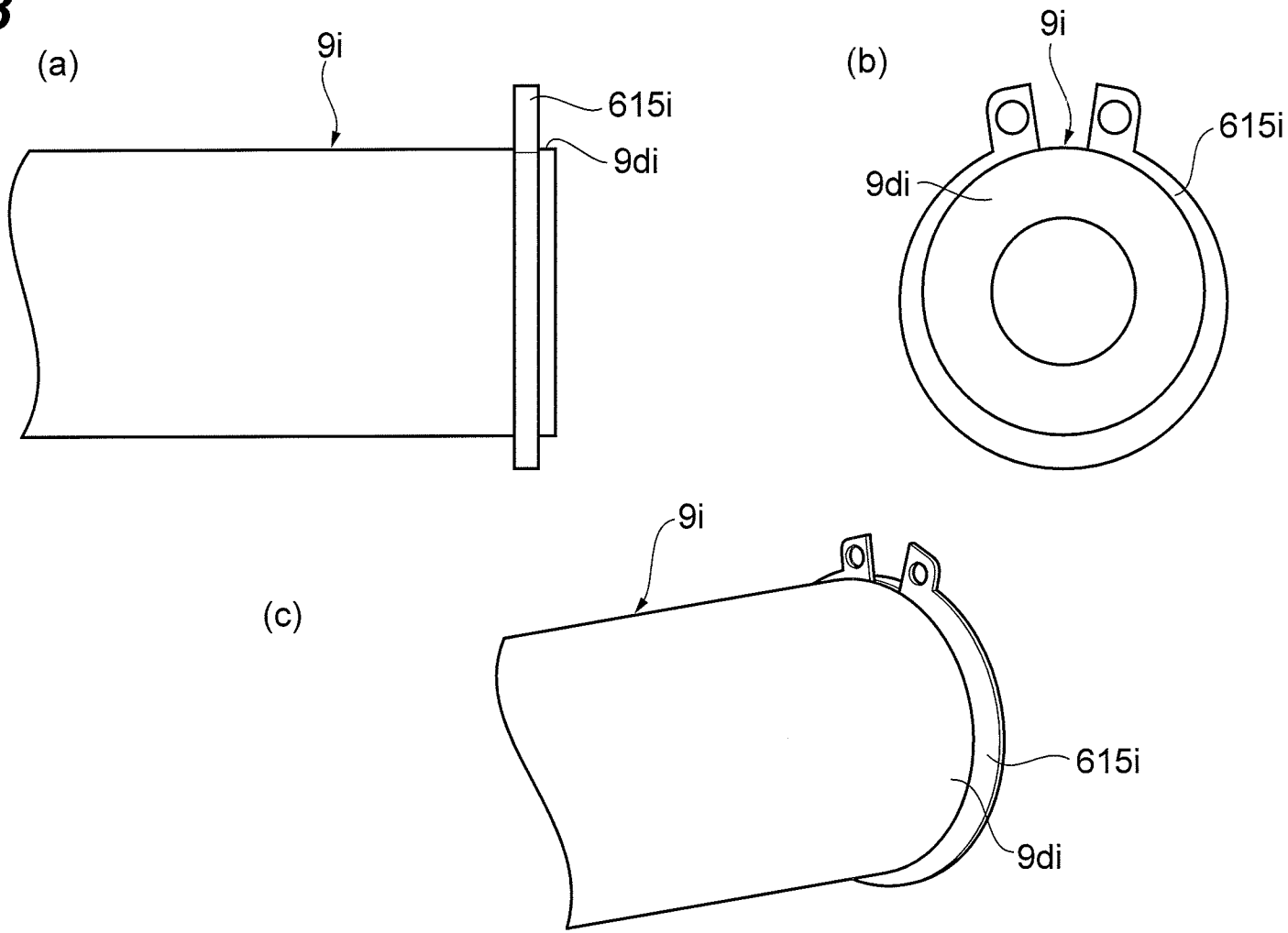
FIG. 23(*a*) is a side view of a reflective cylinder according to a modification example of the present invention, FIG. 23(*b*) an end view of the reflective cylinder in FIG. 23(*a*), and FIG. 23(*c*) a perspective view of the reflective cylinder in FIG. 23(*a*).

For example, as shown in FIG. 23, the reflective cylinder 9*i* may be fixed to the luminescent part 2*i* by fixing a retaining ring 615*i* such as a stainless steel C-shaped retaining ring to the outer periphery of the end 9*di* of the reflective cylinder 9*i* and welding the retaining ring 615*i* to a fixing member for the reflective cylinder which is provided in the housing case 8*i*.

Figure 24:
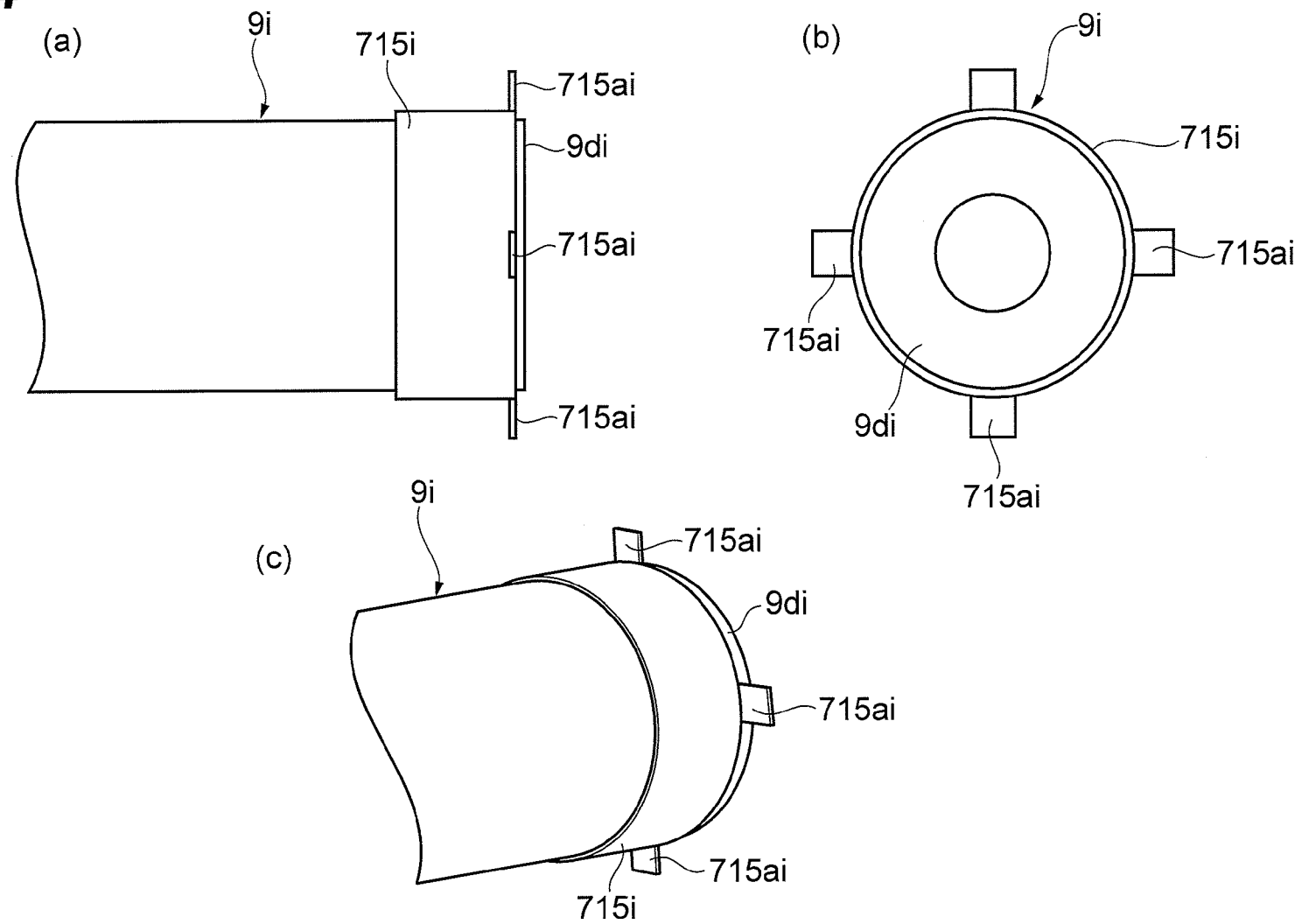
FIG. 24(*a*) is a side view of a reflective cylinder according to a modification example of the present invention, FIG. 24(*b*) an end view of the reflective cylinder in FIG. 24(*a*), and FIG. 24(*c*) a perspective view of the reflective cylinder in FIG. 24(*a*).

Furthermore, as shown in FIG. 24, it is also possible to adopt a configuration wherein a stainless steel sheet material 715*i* is wound in a belt shape around the outer periphery of the end 9*di* of the reflective cylinder 9*i* and their terminal ends are stacked and welded to be fixed. A plurality of flange portions 715*ai* extending perpendicularly to the central axis of the reflective cylinder 9*i* are provided on the end 9*di* side of this sheet material 715*i* and the flange portions 715*ai* and the fixing member are welded to fix the reflective cylinder 9*i*. It is also possible to fix the reflective cylinder 9*i* by welding proximate portions between the sheet material 715*i* and the fixing member, without provision of the flange portions 715*i*.

Figure 25:
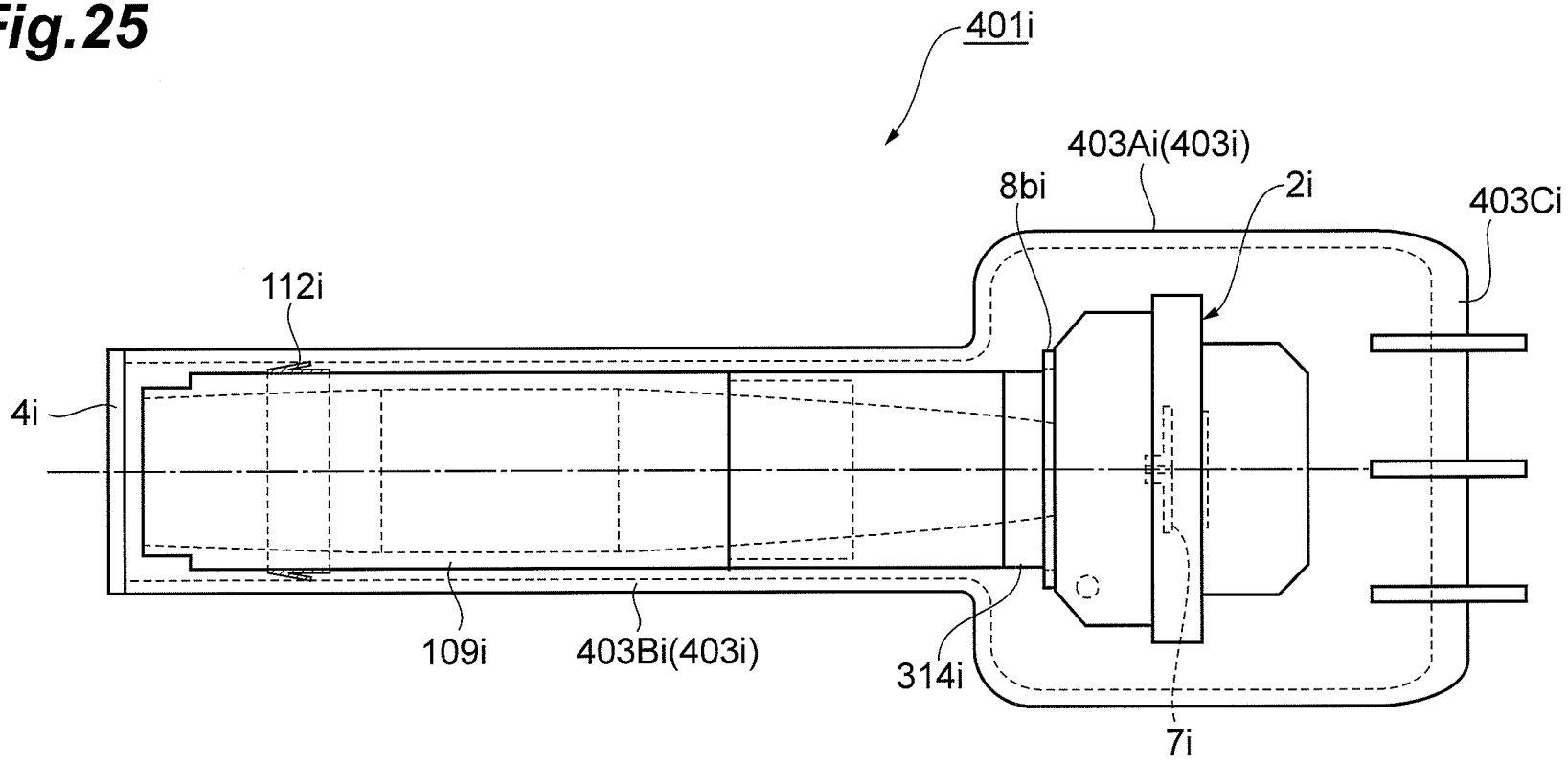
FIG. 25 is a side view showing a configuration of a deuterium lamp according to a modification example of the present invention.

FIG. 25 shows a deuterium lamp 401*i* in which a stem 403Ci, a luminescent cylinder 403Ai, and a light guide cylinder 403Bi are arranged coaxially with the optical axis, as a modification example of the present invention. The deuterium lamp 401*i* of this configuration can be assembled from the same axial direction. Particularly, the deuterium lamp can be manufactured by fixing the reflective cylinder 109*i* to the fixing ring 8*bi* of the luminescent part 2*i* to be integrated therewith, thereafter inserting the reflective cylinder 109*i* into a hermetic container 403*i* in which the light guide cylinder 403Bi and the luminescent cylinder 403Ai are integrated, and sealing the hermetic container 403*i* by the stem 403Ci. As in the case of the deuterium lamp 301*i*, the end ring 314*i* is forced onto this reflective cylinder 109*i* and fixed thereto and this end ring 314*i* and the fixing ring 8*bi* are welded to fix the reflective cylinder 109*i*. At the same time, the metal band 112*i* is fixed to the reflective cylinder 109*i* at the end of the outer wall surface 109*bi* on the exit window 4*i* side, as in the case of the deuterium lamp 101*i*. This metal band 112*i* enhances the coaxiality of the light guide cylinder 403Bi and the reflective cylinder 109*i*. Besides this fixing method, another fixing method may be adopted, e.g., a method of increasing the height of the fixing ring 8*bi* and screw cutting the inserted part of the reflective cylinder 109*i* and the fixing ring 8*bi* to fix them, or a method of forming tapped holes in the fixing ring 8*bi*, inserting the reflective cylinder 109*i* into the fixing ring 8*bi*, and then fixing them with screws or the like.

In the deuterium lamp 1*i*, 101*i*, 201*i*, 301*i*, or 401*i*, an aperture to penetrate to the reflective surface 9*ai*, 109*ai*, or 309*ai* may be formed in the outer wall surface 9*bi*, 109*bi*, or 309*bi* of the reflective cylinder 9*i*, 109*i*, or 309*i* on the luminescent cylinder 3Ai or 303Ai side (one end side) in the longitudinal direction.

Figure 26:
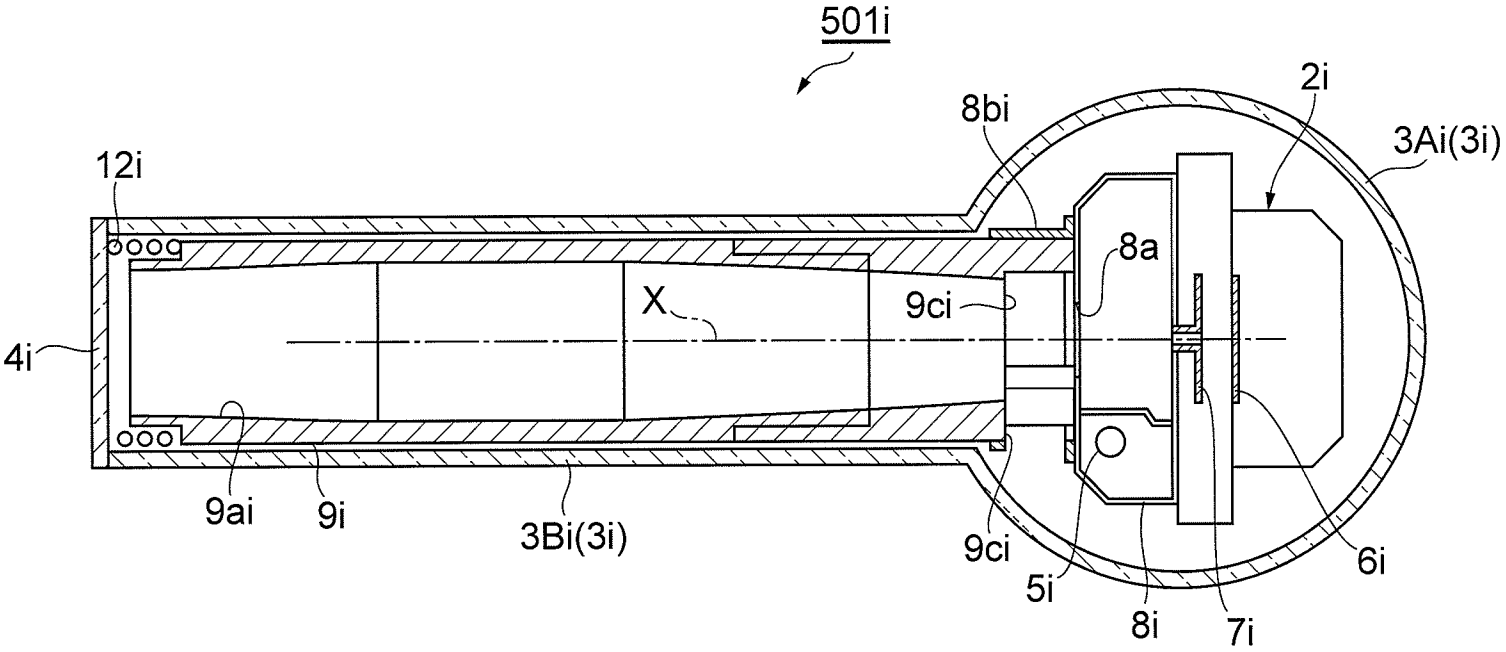
FIG. 26 is a sectional view showing a configuration of a deuterium lamp according to a modification example of the present invention.
Figure 27:
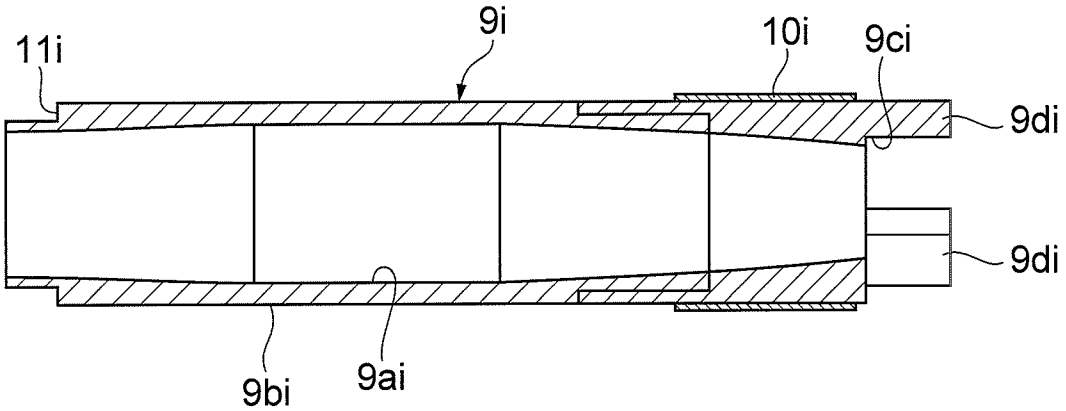
FIG. 27(*a*) is a sectional view of a reflective cylinder in FIG. 26 and FIG. 27(*b*) an end view of the reflective cylinder in FIG. 26.
Figure 27:
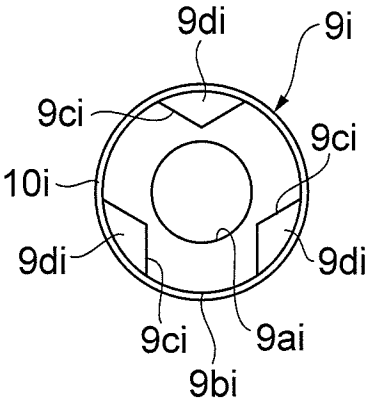
Figure 28:
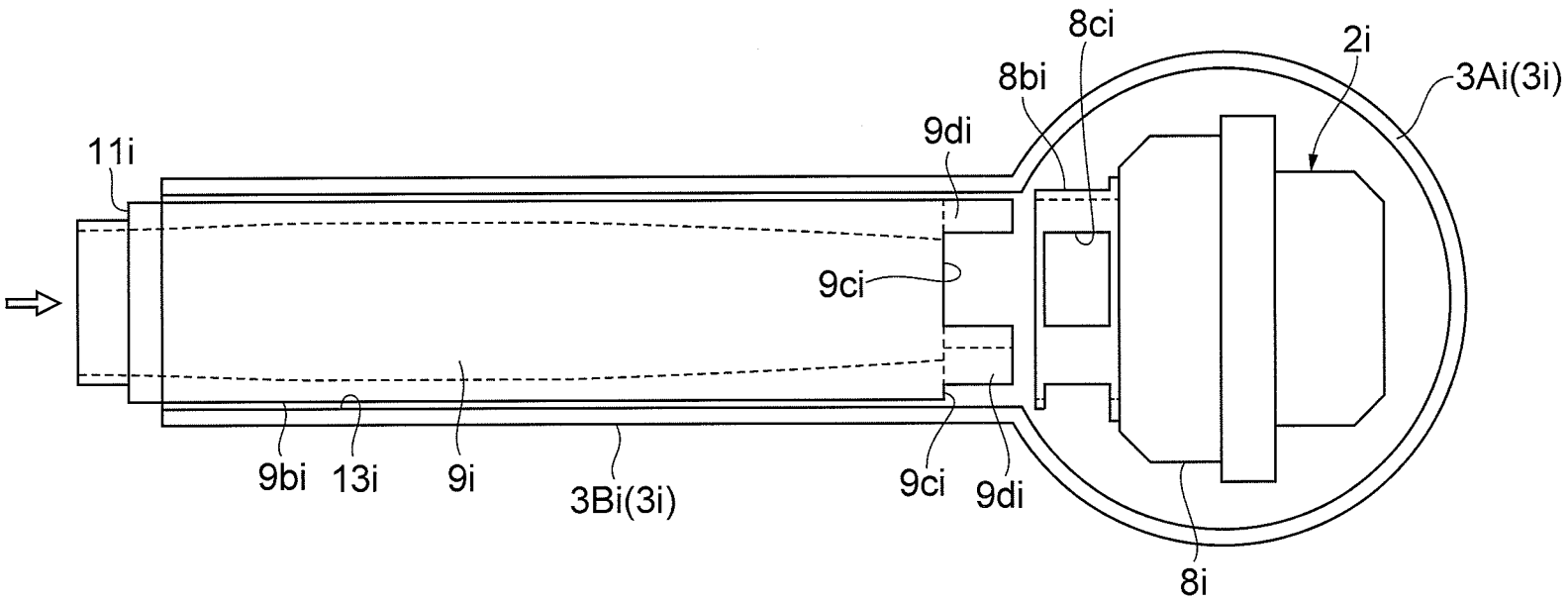
FIG. 28 is a side view showing an assembling state of the reflective cylinder in the deuterium lamp in FIG. 26.

For example, in a deuterium lamp 501*i* shown in FIGS. 26 to 28, apertures 9*ci* cut along the central axis of the reflective cylinder 9*i* are formed toward the exit window 4*i* side (the other end side) of the outer wall surface 9*bi*, in the edge region on the one end side of the outer wall surface 9*bi* of the reflective cylinder 9*i*. Particularly, the apertures 9*ci* are formed in three portions at equal intervals along the circumference on the one end side of the reflective cylinder 9*i*, and projections 9*di* to be fitted in the fixing ring 8*bi* of the luminescent part 2*i* are formed in three portions between the neighboring apertures 9*ci*. Furthermore, apertures 8*ci* are formed at positions corresponding to the apertures 9*ci* of the reflective cylinder 9*i*, in the fixing ring 8*bi* of the housing case 8*i*. In this structure, when the reflective cylinder 9*i* is fitted into the fixing ring 8*bi* of the housing case 8*i*, the plurality of apertures 9*ci* to penetrate to the reflective surface 9*ai* are arranged in communication with the interior space of the luminescent cylinder 3Ai through the apertures 8*ci*, at the end of the outer wall surface 9*bi* of the reflective cylinder 9*i* located in the luminescent cylinder 3Ai (FIG. 28).

In this deuterium lamp 501*i*, the sputtered substance generated in the luminescent part 2*i* can be discharged to the outside of the reflective cylinder 9*i*, whereby the sputtered substance can be prevented from adhering to the reflective surface 9*ai* of the reflective cylinder 9*i* or to the exit window 4*i* which is a part at low temperature. As a result, the optical transmittance is improved at the exit window 4*i*, while achieving extension of service life. Since the apertures 9*ci* are located in the luminescent cylinder 3Ai, the sputtered substance generated in the luminescent part 2*i* is more likely to be discharged in the luminescent cylinder 3Ai and captured in the luminescent cylinder 3Ai. As a result, it is feasible to further prevent scattering of the sputtered substance to the exit window 4*i* and thereby to more extend the service life. The apertures may also be formed in the end ring 314*i* in the structure in which the end ring 314*i* is forced onto the reflective cylinder 309*i* as shown in FIG. 22. In the structure in which the sheet material 715*i* is wound around the reflective cylinder 9*i* as shown in FIG. 24, the apertures may also be formed at the positions corresponding to the apertures 9*ci* of the reflective cylinder 9*i* in the sheet material 715*i*.

In the deuterium lamp 501*i* shown in FIGS. 26 to 28, the thermal radiation film 10*i* is formed on the longitudinal one end side of the outer wall surface 9*bi* of the reflective cylinder 9*i*. For this reason, a portion at lower temperature than the surroundings and the enclosed gas can be formed inside the reflective cylinder 9*i* in close proximity to the luminescent part 2*i* and the lower-temperature portion can capture the foreign matter such as the sputtered substance from the luminescent cylinder 3Ai, so as to prevent the diffusion of the foreign matter to the exit window 4*i* and the reduction of optical transmittance caused thereby. To the contrary, a material with the thermal emissivity lower than that of the material of the reflective cylinder 9*i* may be formed on the other end side of the outer wall surface 9*bi*. This configuration relatively enhances heat radiation on the one end side and is expected to achieve the same effect as the thermal radiation film 10*i*. Furthermore, the material of the metal block member forming the one end side of the reflective cylinder 9*i* may be comprised of a material with the thermal emissivity larger than that of the material of the metal block member forming the other end side.

Tenth Embodiment

Figure 30:
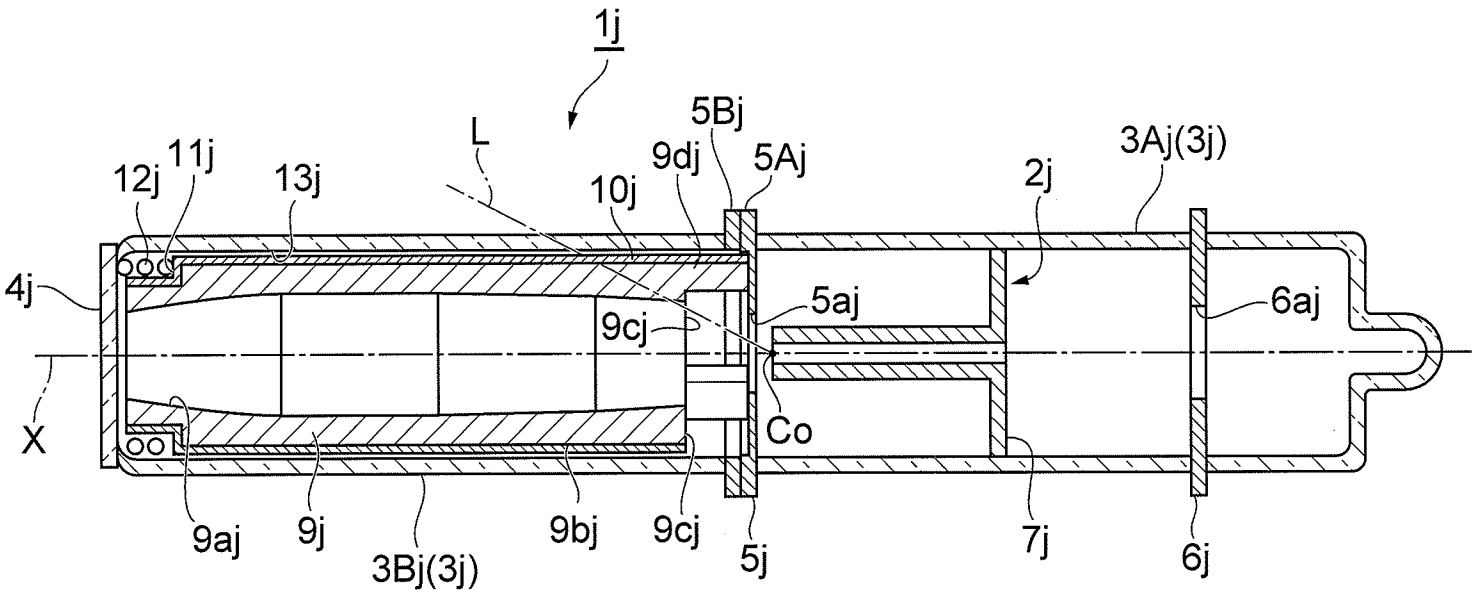
FIG. 30 is a sectional view showing a configuration of a light source according to the tenth embodiment of the present invention.

FIG. 30 is a sectional view showing a configuration of a light source according to the tenth embodiment of the present invention. The light source 1*j* shown in the same drawing is a so-called capillary discharge tube used as a light source for analytical equipment such as a photoionization source of a mass spectrometer or as a light source for vacuum electricity removal.

This light source 1*j* is provided with a hermetic container 3*j* of glass in which a luminescent cylinder (first housing) 3Aj of a substantially cylindrical shape housing a luminescent part 2*j* to induce discharge of gas to generate light, is integrally connected to a light guide cylinder (second housing) 3Bj of a substantially cylindrical shape kept in communication with the luminescent cylinder 3Aj and extending along the optical axis X of light emitted from the luminescent part 2*j* in the luminescent cylinder 3Aj. More particularly, the light guide cylinder 3Bj is connected to and kept in communication with the luminescent cylinder 3Aj on a one end side in the direction along the optical axis X and is sealed on the other end side by an exit window 4*j* to emit the light generated from the luminescent part 2*j*, to the outside. A material of this exit window 4*j* is, for example, $MgF_2$ (magnesium fluoride), LiF (lithium fluoride), or sapphire glass.

The luminescent part 2*j* housed in the luminescent cylinder 3Aj is composed of a cathode 5*j*, an anode 6*j*, and a capillary part 7*j* arranged between the anode 6*j* and the cathode 5*j*. An aperture 5*aj* and an aperture 6*aj* are formed in these cathode 5*j* and anode 6*j*, respectively. Then the cathode 5*j*, anode 6*j*, and capillary part 7*j* are held inside the luminescent cylinder 3Aj so that the central axes of these apertures 5*aj*, 6*aj* and the tube axis of the capillary part 7*j* agree with the tube axis of the luminescent cylinder 3Aj, i.e., with the optical axis X. Namely, the cathode 5*j*, anode 6*j*, and capillary part 7*j* are held so as to be arranged coaxially with each other by the luminescent cylinder 3Aj.

The cathode 5*j* also functions as a connection member as arranged at the position to separate the luminescent cylinder 3Aj and the light guide cylinder 3Bj from each other. Particularly, the cathode 5*j* has a double structure of a metal ring member 5Aj having the aperture 5*aj* formed therein and bonded as sealed to the luminescent cylinder 3Aj, and a metal ring member 5Bj bonded as sealed to the light guide cylinder 3Bj. This ring member 5Aj is provided with a receiving structure for positioning of reflective cylinder 9*j* by contact with an end of the reflective cylinder 9*j* as described below. The aperture 5*aj* of the ring member 5Aj herein serves as an exit port for extraction of the light generated in the luminescent part 2*j*, toward the light guide cylinder 3Bj and is provided so as to be opposed to the exit window 4*j* of the light guide cylinder 3Bj.

A gas such as hydrogen ($H_2$), xenon (Xe), argon (Ar), or krypton (Kr) is enclosed in the hermetic container 3*j* in which the luminescent cylinder 3Aj and the light guide cylinder 3Bj are connected. When a voltage is applied between the cathode 5*j* and the anode 6*j* in the luminescent part 2*j*, it induces ionization and discharge of the gas existing between them and resultant electrons are converged in the capillary part 7*j* to form a plasma state. This results in emitting light in the direction along the optical axis X toward the light guide cylinder 3Bj through the aperture 5*aj* from the interior of the capillary part 7*j*. For example, in the case where the enclosed gas is Kr and the material of the exit window 4*j* used is $MgF_2$, the light can be emitted at the wavelength of 117/122 nm; in the case where the enclosed gas is Ar and the material of the exit window 4*j* used is LiF, the light can be emitted at the wavelength of 105 nm.

A reflective cylinder (cylindrical member) 9*j* of a substantially cylindrical shape is inserted and fixed between the exit window 4*j* in the hermetic container 3*j* of this configuration and the cathode 5*j* connecting the luminescent cylinder 3Aj and the light guide cylinder 3Bj. This reflective cylinder 9*j* is a combination of metal block members of aluminum and is formed in a substantially cylindrical shape having an outside diameter smaller than an inside diameter of the light guide cylinder 3Bj.

Figure 31:
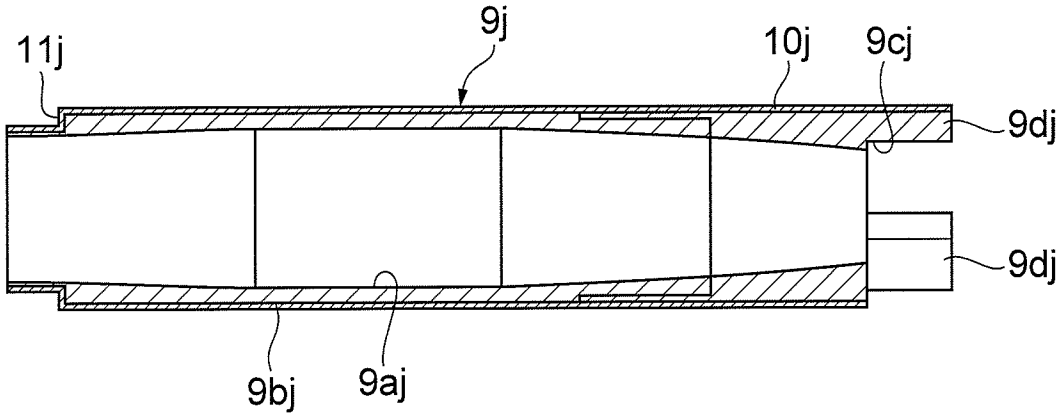
FIG. 31(*a*) is a sectional view of a reflective cylinder in FIG. 30 and FIG. 31(*b*) an end view of the reflective cylinder in FIG. 30.
Figure 31:
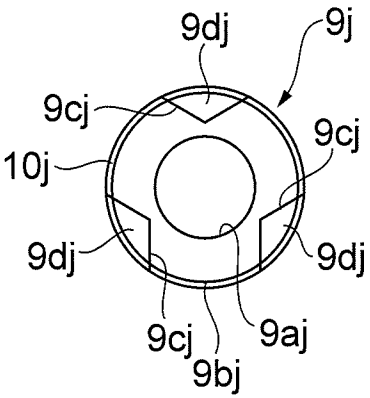

With reference to FIG. 31, an inner wall surface of the reflective cylinder 9*j* itself is formed as a reflective surface 9*aj* which is a curved surface along the central axis of the reflective cylinder 9*j*, or a multistep surface with inclination angles varying stepwise. Namely, this reflective surface 9*aj* is formed so that the two ends of the reflective cylinder 9*j* in the central-axis direction are tapered so as to be able to converge the light at a desired surface or point outside the exit window 4*j*. More specifically, the reflective surface 9*aj* is formed as inclined with respect to the central axis of the reflective cylinder 9*j*, i.e., with respect to the optical axis X so that the diameter of the space surrounded by the reflective surface 9*aj* gradually decreases from a longitudinal central region of the reflective cylinder 9*j* toward the end on the luminescent cylinder 3Aj side. Furthermore, the reflective surface 9*aj* is formed as inclined with respect to the central axis of the reflective cylinder 9*j* so that the diameter of the space surrounded by the reflective surface 9*aj* gradually decreases from the longitudinal central region of the reflective cylinder 9*j* toward the end on the exit window 4*j* side. The reflective surface 9*aj* is set at smaller angles of inclination to the optical axis X of the reflective surface 9*aj* than a line L connecting a luminescent center $C_0$ located at the center of the exit port of the capillary part 7*j* of the luminescent part 2*j*, and the end on the luminescent part 2*j* side of the reflective surface 9*aj* (FIG. 30). For example, the inclination angle of the reflective surface 9*aj* in the stage closest to the luminescent center $C_0$ side is set in the range of 2 to 15°, while the inclination angle of the line L to the optical axis X is in the range of 20 to 60°. The tapered structure of the reflective surface 9*aj* may be provided at either one of the two ends of the reflective cylinder 9*j* in the central-axis direction, instead of that at the two ends; for example, the reflective surface 9*aj* may be formed in the tapered shape as described above, only on the luminescent part 2*j* side (one end side), while the reflective surface 9*aj* is formed in parallel to the central axis of the reflective cylinder 9*j* on the exit window 4*j* side (the other end side).

This reflective surface 9*aj* is processed in a mirror surface state capable of regularly reflecting the light generated by the luminescent part 2*j* and is formed, for example, by cutting the metal block members, polishing an inner wall thereof by a polishing method such as buffing, chemical polishing, electropolishing, or a derivative thereof, or by a polishing method as a complex thereof, and thereafter subjecting the surface to a washing treatment or a vacuum treatment or the like to remove an impurity gas component. In the present embodiment the reflective cylinder 9*j* is composed of a combination of two members and, when the reflective surface 9*aj* is formed of a plurality of metal block members as in this configuration, a ratio of length and inside diameter (aspect ratio) of the reflective surface 9*aj* of each metal block member can be set smaller, so as to facilitate achievement of desired flatness during processing and shaping, thereby enhancing the mirror accuracy of the reflective surface 9*aj*.

Apertures 9*cj* cut along the central axis of the reflective cylinder 9*j* are formed toward the exit window 4*j* side (the other end side) of the outer wall surface 9*bj*, in the edge region on the luminescent cylinder 3Aj side (one end side) in the longitudinal direction of the outer wall surface 9*bj* of the reflective cylinder 9*j*. Particularly, the apertures 9*cj* are formed in three portions at equal intervals along the circumference on the one end side of the reflective cylinder 9*j*, and projections 9*dj* to be fitted in the receiving structure (which will be detailed later) provided in the cathode 5*j* of the luminescent part 2*j* are formed in three portions between the neighboring apertures 9*cj*.

Furthermore, a thermal radiation film 10*j* containing a material with high thermal emissivity is formed over almost the entire area of the outer wall surface 9*bj* of the reflective cylinder 9*j*. The material of this thermal radiation film 10*j* to be used is one with the thermal emissivity higher than that of the material of the reflective cylinder 9*j*, e.g., aluminum oxide. The thermal radiation film 10*j* is formed, for example, by depositing the material forming the thermal radiation film 10*j*, on the outer wall surface 9*bj* of the reflective cylinder 9*j* by evaporation, coating, or the like, but, particularly, in the case where the reflective cylinder 9*j* is made of aluminum as in the present embodiment, a layer of aluminum oxide as the thermal radiation film 10*j* may be formed by oxidizing the outer wall surface 9*bj* of the reflective cylinder 9*j*.

A cut portion 11*j* cut in a circular shape so as to form a stepped projection is formed along the outer wall surface 9*bj*, in a peripheral edge region on the longitudinal other end side of the outer wall surface 9*bj* of the reflective cylinder 9*j*. This cut portion 11*j* is provided for positioning the reflective cylinder 9*j* in the hermetic container 3*j*.

Figure 32:
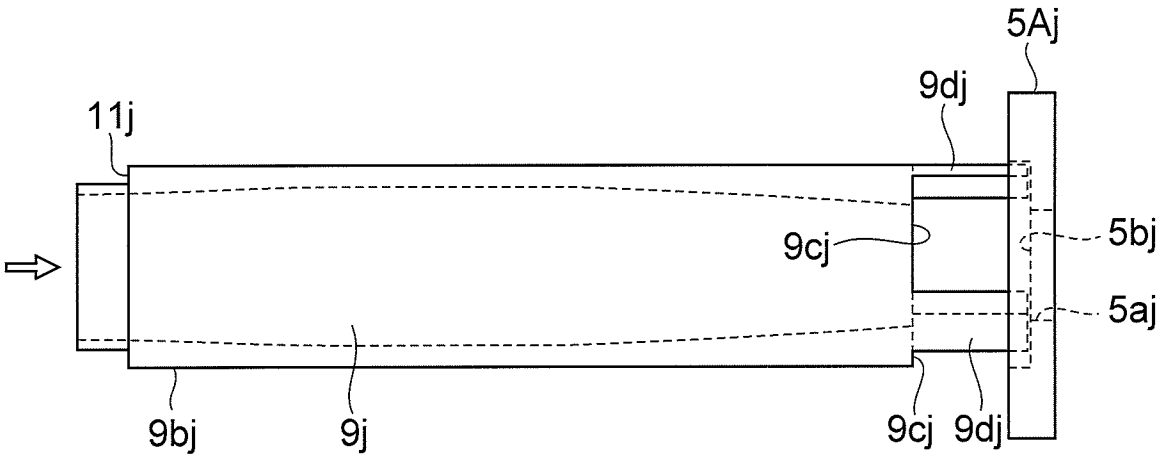
FIG. 32 is a side view showing a fixed state of the reflective cylinder to a cathode in the light source in FIG. 30.
Figure 33:
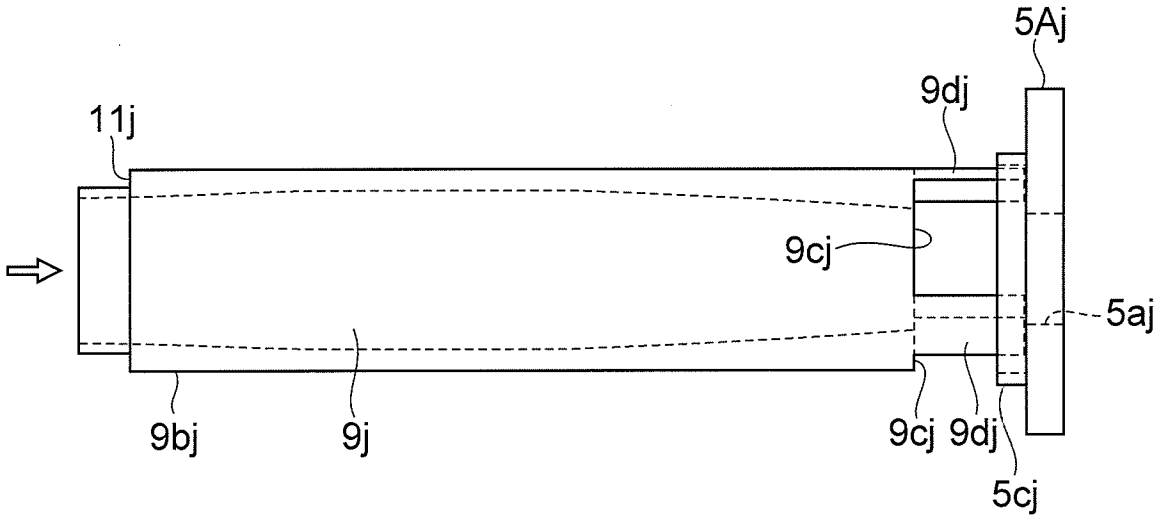
FIG. 33 is a side view showing another fixed state of the reflective cylinder to the cathode in the light source in FIG. 30.

Returning to FIG. 30, the reflective cylinder 9*j* of this configuration is inserted along the tube axis (optical axis X) into the light guide cylinder 3Bj in a state in which the projections 9*dj* are in contact with the ring member 5Aj of the cathode 5*j*, and a spring member 12*j* is attached along the outer wall surface 9*bj* between the cut portion 11*j* and the exit window 4*j*. This spring member 12*j* is a member for positioning of the reflective cylinder 9*j*, which is comprised of a metal member, e.g., stainless steel or an Inconel material with high heat resistance. The reflective cylinder 9*j* is fitted in the receiving structure of the ring member 5Aj in a state in which the outer wall surface 9*bj* thereof is separated from the inner wall surface 13*j* of the light guide cylinder 3Bj. FIGS. 32 and 33 show examples of the receiving structure of the ring member 5Aj. As shown, the ring member 5Aj can be provided with a hole 5*bj* having the same diameter as the outside diameter of the reflective cylinder 9*j* so as to be coaxial with the aperture 5*aj*, or another ring fixing member 5*cj* having the same inside diameter as the outside diameter of the reflective cylinder 9*j* can be fixed so as to be coaxial with the aperture 5*aj* on the surface of the ring member 5Aj.

In the positioning structure of the reflective cylinder 9*j* as described above, the reflective cylinder 9*j* is urged along the optical axis X from the exit window 4*j* side toward the luminescent part 2*j* side by the spring member 12*j* to be pressed against the receiving structure of the cathode 5*j*. This results in positioning the reflective cylinder 9*j* in a state in which the projections 9*dj* on the one end side are in contact with the ring member 5Aj of the cathode 5*j* and the other end side is set in the light guide cylinder 3Bj to be located in proximity to the exit window 4*j*, between the exit window 4*j* and the cathode 5*j* in the hermetic container 3*j*. When the reflective cylinder 9*j* is fitted in the receiving structure of the ring member 5Aj, the plurality of apertures 9*cj* to penetrate to the reflective surface 9*aj* are arranged at the end of the outer wall surface 9*bj* of the reflective cylinder 9*j* located inside the luminescent cylinder 3Aj.

In assembly of the light source 1*j*, the ring member 5Aj and the ring member 5Bj of the cathode 5*j* are bonded as sealed to the luminescent cylinder 3Aj and to the light guide cylinder 3Bj, respectively. Then the reflective cylinder 9*j* is fitted into the receiving structure of the ring member 5Aj and the spring member 12*j* is attached to the cut portion 11*j*; thereafter, the reflective cylinder 9*j* is inserted into the light guide cylinder 3Bj, and the ring member 5Aj and the ring member 5Bj are stacked and vacuum-welded, thereby assembling the light source 1*j*.

In the light source 1*j* described above, discharge caused between the cathode 5*j* and the anode 6*j* of the luminescent part 2*j* in the luminescent cylinder 3Aj is narrowed by the capillary part 7*j* to generate light, and the light emitted through the aperture 5*aj* of the cathode 5*j* from the luminescent part 2*j* is guided to the interior of the reflective cylinder 9*j* inserted from the exit window 4*j* of the light guide cylinder 3Bj in communication with the luminescent cylinder 3Aj, to the luminescent part 2*j*, to be emitted from the exit window 4*j*. Since the reflective surface 9*aj* is formed on the inner wall surface of the reflective cylinder 9*j*, the light emitted from the luminescent part 2*j* is guided from the one end side to the other end side of the light guide cylinder 3Bj while being reflected by the reflective surface 9*aj* inside the reflective cylinder 9*j*; as a result, the light emitted from the luminescent part 2*j* can be guided to the exit window 4*j* of the light guide cylinder 3Bj, without loss. In conjunction therewith, since the two ends of the reflective surface 9*aj* are formed in the taper shape, the light can be converged at the predetermined position outside the exit window 4*j*. Furthermore, it is feasible to increase the extraction efficiency of light from the exit window 4*j* and thereby to increase the total light amount of emitted light and the light amount on the illumination target surface. The light radiation pattern from the exit window in the conventional discharge tubes varies according to the distance from the exit window and tends to cause an omission where the radiant light is weak, whereas the light source 1*j* can reduce the occurrence of the omission of the light radiation pattern. As a result, it is feasible to efficiently extract the generated light.

Figure 34:
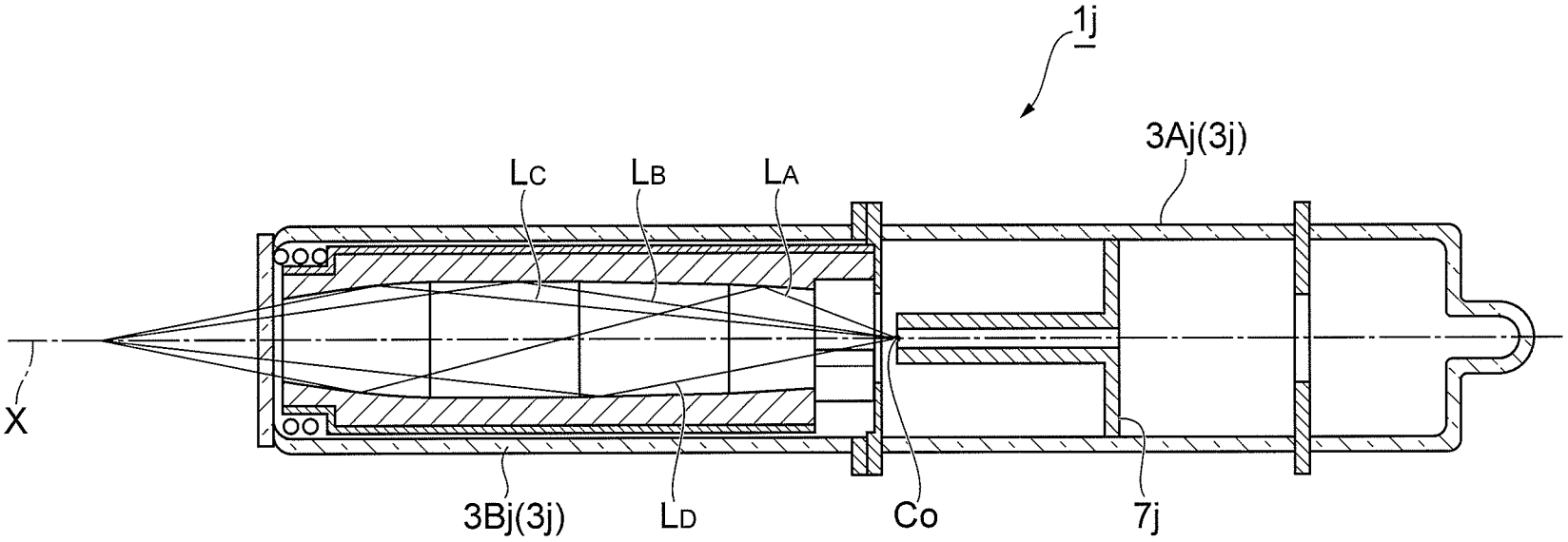
FIG. 34 is a drawing showing optical paths of light components in various light emission directions from a luminescent center in the light source in FIG. 30.
Figure 43:
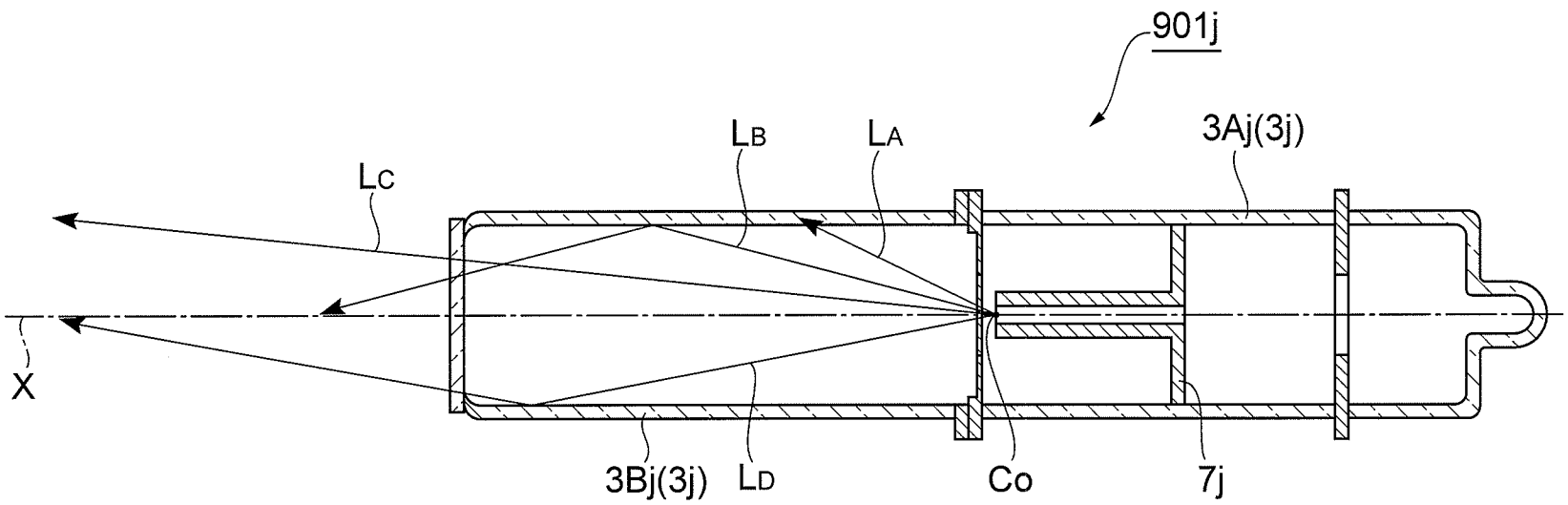
FIG. 43 is a drawing showing optical paths of light components in various light emission directions from a luminescent center in a light source according to a comparative example of the present invention.

FIG. 34 is a drawing showing optical paths of light components in various light emission directions from the luminescent center $C_0$ in the light source 1*j* and FIG. 43 a drawing showing optical paths of light components in various light emission directions from the luminescent center $C_0$ in a light source 901*j* obtained by removing the reflective cylinder 9*j* from the light source 1*j*.

As shown in FIG. 43, the light component $L_A$ with a large emission angle relative to the optical axis X is not totally reflected in the light source 901*j* but is transmitted or absorbed by the hermetic container 3*j*. In contrast to it, in the light source 1*j* as shown in FIG. 34, this light component $L_A$ is also totally reflected by the reflective surface 9*aj* to function as a forward irradiation component, increasing an amount of radiant light. Furthermore, since the reflective surface 9*aj* on the luminescent center $C_0$ side is tapered, reflected light can be converged around a desired position from the exit window 4*j* without forming diverging components.

The light components $L_B$, $L_D$, which are reflected by the hermetic container 3*j* to become diverging light in the case of the light source 901*j*, can also be converged around the desired position in the case of the light source 1*j*. Furthermore, since the reflective surface 9*ai* is tapered on the exit window 4*j* side in the light source 1*j*, the light component $L_C$, which diverges from the exit window 4*i* in the case of the light source 901*j* because of a small emission angle relative to the optical axis X, can be used as a converging component and the light component $L_D$ can be converged at an appropriate position around the desired position. As a result, the reflective surface 9*aj* of the reflective cylinder 9*j* can be formed in the structure capable of using many components of radiant light as converging components.

By adjusting the shape of the tapered portions in the reflective surface 9*aj* of the reflective cylinder 9*j*, the emitted light from the exit window 4*j* can also have a distribution with many parallel light components or a divergent distribution on the contrary, instead of the convergent distribution.

In addition, since the apertures 9*cj* are formed in the outer wall surface 9*bj* on the one end side of the reflective cylinder 9*j*, the sputtered substance generated in the luminescent part 2*j* can be discharged to the outside of the reflective cylinder 9*j*, which can prevent the sputtered substance from adhering to the reflective surface 9*aj* of the reflective cylinder 9*j* or to the exit window 4*j* which is a part at low temperature. As a result, the optical transmittance can be enhanced at the exit window 4*j*, while achieving extension of service life. Since the apertures 9*cj* are located near the luminescent cylinder 3Aj, the sputtered substance generated in the luminescent cylinder 3Aj becomes more likely to be discharged and captured near the luminescent cylinder 3Aj. As a result, it becomes feasible to further prevent scattering of the sputtered substance to the exit window 4*j* and thereby to further extend the service life.

Since the reflective cylinder 9*j* itself is comprised of the metal members such as the metal block members of aluminum to facilitate processing of the reflective surface with high mirror accuracy, the generated light can be effectively converged. Furthermore, for example, unlike the case where the reflective film of metal or the like is formed inside the reflective cylinder 9*j*, it is feasible to prevent the degradation of performance and the generation of foreign matter due to delamination or dropout or the like of the reflective surface 9*aj* caused by the difference between coefficients of expansion of the constituent materials with repetitions of increase and decrease of temperature, and thereby to achieve extension of service life.

Furthermore, since the outer wall surface 9*bj* of the reflective cylinder 9*j* is separated from the inner wall surface 13*j* of the light guide cylinder 3Bj and the axial length of the reflective cylinder 9*j* is shorter than the axial length of the light guide cylinder 3Bj, it is feasible to prevent breakage of the reflective cylinder 9*j*, the light guide cylinder 3Bj, the glass and window materials, and so on because of the difference of coefficients of thermal expansion between the reflective cylinder 9*j* and the light guide cylinder 3Bj.

Since the reflective cylinder 9*j* is urged into the receiving structure of the cathode 5*j* by the spring member 12*j* as the positioning member of the metal member to be positioned in the hermetic container 3*j*, it becomes easier to achieve the positioning and axial alignment of the reflective cylinder 9*j* relative to the capillary part 7*j* of the luminescent part 2*j*, so as to improve the position accuracy, which ensures sufficient extraction efficiency of light from the exit window 4*j*. Furthermore, by adopting the structure to push the reflective cylinder against the cathode 5*j* by the spring member 12*j*, the reflective cylinder 9*j* can be stably fixed relative to the hermetic container 3*j* and the spring member 12*j* can absorb positional deviation thereof relative to the luminescent cylinder 3Aj even with occurrence of thermal expansion along the central-axis direction of the reflective cylinder 9*j*. It can also be contemplated herein that the radiant light distribution is adjusted by aligning the positional and angular relations between the light guide cylinder 3Bj and the capillary part 7*j* during the sealing of the discharge tube, but it is difficult in this case to achieve position adjustment because of the large difference between the depth positions of the exit window 4*j* and the capillary part 7*j*. In the present embodiment, the reflective cylinder 9*j* is introduced to stably determine the positional relationship between the light guide cylinder 3Bj and the reflective cylinder 9*j* and the alignment between the reflective cylinder 9*j* and the cathode 5*j* results in also achieving alignment of the positional and angular relations between the reflective cylinder 9*j* and the capillary part 7*j*. Therefore, the positional relationship between the light guide cylinder 3Bj and the luminescent center is achieved with good accuracy.

Furthermore, since the thermal radiation film 10*j* is formed over almost the entire area of the outer wall surface 9*bj* of the reflective cylinder 9*j*, a region at lower temperature than the surroundings and the enclosed gas can be formed on the inner surface of the reflective cylinder 9*j* and the lower-temperature region can capture the foreign matter such as the sputtered substance from the luminescent cylinder 3Aj, so as to prevent the diffusion of the foreign matter to the exit window 4*j* and the reduction of optical transmittance caused thereby.

When the light source 1*j* of this configuration is used a photoionization source in a mass spectrometer (MS) such as a gas chromatography mass spectrometer (GC/MS) or a liquid chromatography mass spectrometer (LC/MS), it is feasible to achieve high sensitivity, prevent contamination of the window material, and achieve a good time response characteristic. Firstly, the light amount on the irradiation target surface can be drastically increased so as to improve a probability of contact with a sample, whereby the sensitivity can be improved to a large extent (nearly ten times) in comparison to the conventional photoionization sources. It also becomes feasible to achieve convergence of light suitable for a variety of MSs, and the measurement sensitivity is enhanced on the following points. Specifically, in the case of MS, the light can be focused on an effective portion of an electric field distribution for introducing ions to a discriminator in an ionization chamber. In the case of GC/MS, the light can be effectively focused and introduced through an aperture of about several mm of the ionization chamber. In the case of LC/MS, the light can be focused around an aperture to introduce ions into the discriminator, to enhance an ion density, and the window of the photoionization source can be located away from a sample ejection port to prevent contamination of the window, while avoiding degradation of sensitivity even at the distant location from the ionization source because of the enhancement of light convergence more than before. Namely, the high-density light is guided onto a high-density sample part to enhance ionization efficiency, thereby achieving high sensitivity; the window of the photoionization source is located away from the sample ejection port, thereby preventing contamination of the window; the light is focused on the sample ejection port, thereby increasing the response speed.

Eleventh Embodiment

Figure 35:
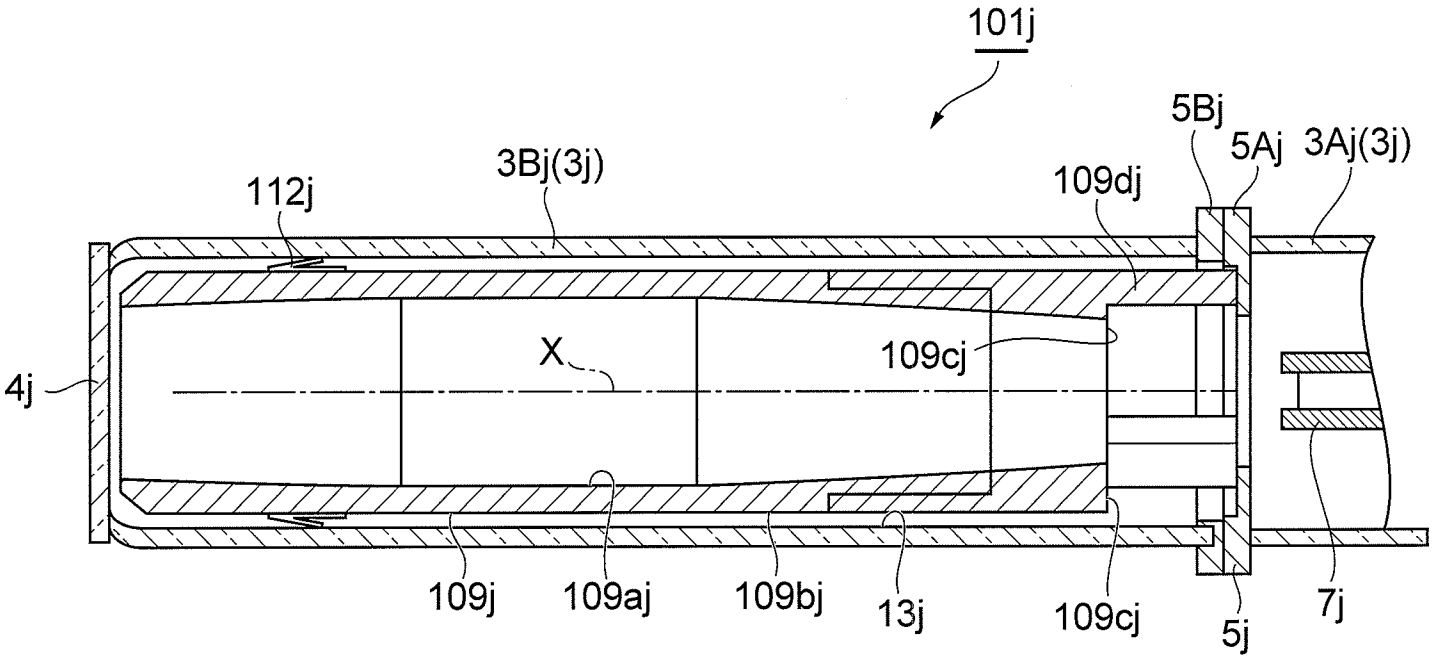
FIG. 35 is a sectional view showing a configuration of a light source according to the eleventh embodiment of the present invention.
Figure 36:
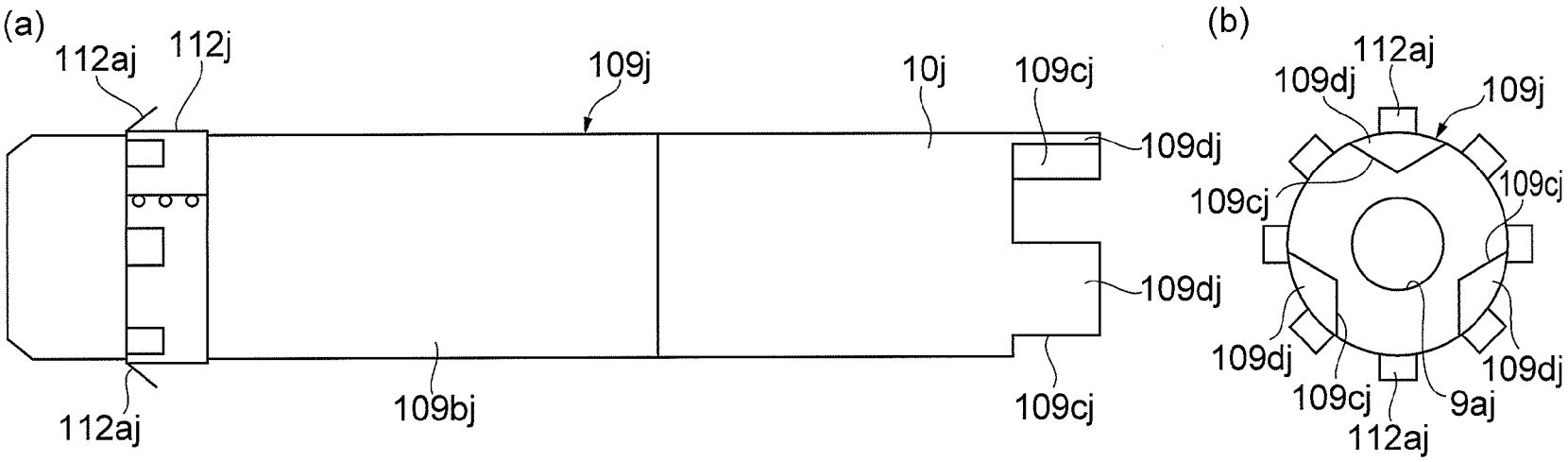
FIG. 36(*a*) is a side view of a reflective cylinder in FIG. 35 and FIG. 36(*b*) an end view of the reflective cylinder in FIG. 35.

FIG. 35 is a sectional view showing a configuration of a light source according to the eleventh embodiment of the present invention, FIG. 36(*a*) a side view of a reflective cylinder in FIG. 35, and FIG. 36(*b*) an end view of the reflective cylinder in FIG. 35. The light source 101*j* shown in the same drawings is different mainly in the positioning structure of the reflective cylinder 109*j* from that in the tenth embodiment.

Specifically, a metal band 112*j* as a positioning member is fixed to the reflective cylinder 109*j* set inside the light source 101*j*, at an end of its outer wall surface 109*bj* on the exit window 4*j* side. In this metal band 112*j*, a plurality of claws 112*aj* with spring action are formed along the outer periphery of the reflective cylinder 109*j*, and the metal band 112*j* is welded at its end by lap welding to be fixed on the outer wall surface 109*bj*. This metal band 112*j* imparts a spring force along the central axis of the reflective cylinder 109*j* to the claws 112*aj* and the claws 112*aj* themselves also have spring forces in directions perpendicular to the central axis of the reflective cylinder 109*j*. The reflective cylinder 109*j* with the metal band 112*j* fixed thereto in this configuration is inserted into the hermetic container 3*j* along the inner wall surface 13*j* of the light guide cylinder 3Bj and is fixed so that the outer wall surface 109*bj* is separated from the inner wall surface 13*j* except for the metal band 112*j*.

In this structure, the reflective cylinder 109*j* is urged by the spring forces along the optical axis X of the claws 112*aj* of the metal band 112*j* so that the projections 109*dj* formed in its edge region are pressed against the ring member 5Aj of the cathode 5*j*, to be positioned in the direction along the optical axis X in the hermetic container 3*j*. In conjunction therewith, the reflective cylinder 109*j* is also positioned in the directions perpendicular to the optical axis X in a state in which the outer wall surface 109*bj* thereof and the inner wall surface 13*j* of the light guide cylinder 3Bj are separated from each other at a fixed distance, by the spring forces in the directions perpendicular to the optical axis X, of the claws 112*aj* of the metal band 112*j*. If a groove is formed in the width of the metal band in the region of the reflective cylinder 109*j* where the metal band 112*j* is mounted, the distance from the metal band 112*j* to the inner wall surface 13*j* of the light guide cylinder 3Bj can be set larger without increase in the inside diameter of the light guide cylinder 3Bj and angles of the claws 112*aj* can be increased, with the result of increase in the spring forces of the claws 112*aj*.

The light source 101*j* of this configuration can also prevent the positional deviation of the reflective cylinder 109*j* and the breakage of the reflective cylinder 109*j* or the light guide cylinder 3Bj, because of the difference of coefficients of thermal expansion between the reflective cylinder 109*j* and the light guide cylinder 3Bj. Since the reflective cylinder 109*j* is urged into the receiving structure of the cathode 5*j* by the metal band 112*j* as the positioning member to be positioned in the hermetic container 3*j*, it becomes easier to achieve the positioning and axial alignment of the reflective cylinder 9*j* relative to the capillary part 7*j* of the luminescent part 2*j*, so as to improve the position accuracy, which can ensure sufficient extraction efficiency of light from the exit window 4*j*. Particularly, in the present embodiment, the coaxiality of the reflective cylinder 9*j* and the light guide cylinder 3Bj can be maintained on a stable basis.

Since the two ends of the reflective surface 9*aj* are formed in the taper shape, the light can be efficiently extracted from the exit window 4*j* so as to be converged at the predetermined position outside the exit window 4*j*, and the light amount of emitted light can be increased on the illumination target surface. Since the thermal radiation film 10*j* is formed in part on the one end side of the outer wall surface 109*bj* of the reflective cylinder 109*j*, a portion at lower temperature than the surroundings and the enclosed gas can be formed inside the reflective cylinder 9*j* in close proximity to the luminescent part 2*j* and the lower-temperature portion can capture the foreign matter such as the sputtered substance from the luminescent cylinder 3Aj, so as to prevent the diffusion of the foreign matter to the exit window 4*j* and the reduction of optical transmittance caused thereby.

The present invention does not have to be limited to the above-described embodiments. For example, the reflective surface 9*aj* or 109*aj* was formed on the reflective cylinder 9*j* or 109*j* by polishing the inner wall of the metal members, but the reflective surface may be formed by evaporation or sputtering. Particularly, the reflective surface can be formed by preparing a base by cutting or molding of a metal member such as aluminum, or a member of glass, ceramic, or the like, polishing the base if necessary, and thereafter depositing an aluminum, rhodium, or dielectric multilayer film or the like on a mirror surface of the base by evaporation or sputtering. The reflective cylinder 9*j* or 109*j* was formed of a plurality of metal block members, but it may be formed as an integral body.

In the foregoing embodiments, the reflective cylinder 9*j* or 109*j* was fixed by pressing it against the receiving structure of the cathode 5*j*, but it may be fixed directly to the receiving structure by laser welding, spot welding, or the like. In this case, if it is difficult to weld the reflective cylinder directly to the fixing member, it is possible to adopt a method of fixing a weldable structure to the reflective cylinder by engagement or the like and welding the structure to the fixing member. In the case of the laser welding, it is also possible to perform the welding through the glass member of the luminescent cylinder 3Aj.

Figure 37:
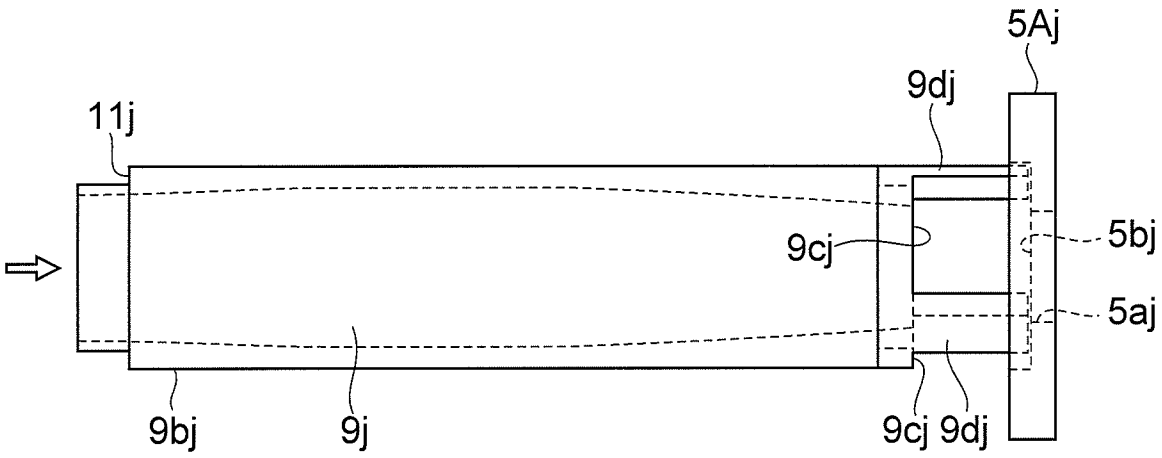
FIG. 37 is a side view showing a fixed state of the reflective cylinder to the cathode according to a modification example of the present invention.
Figure 38:
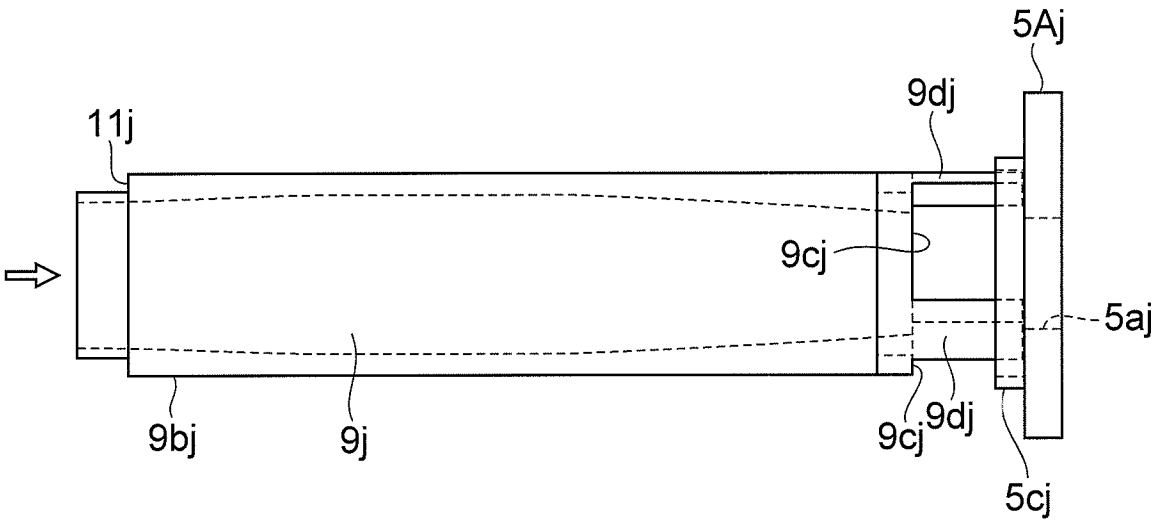
FIG. 38 is a side view showing a fixed state of the reflective cylinder to the cathode according to a modification example of the present invention.

For example, FIGS. 37 and 38 show structures in which the reflective cylinder 9*j* is fixed to the receiving structure of the cathode 5*j* by laser welding or spot welding. Particularly, a tubular member of stainless steel with projections 9*dj* is fixed by press fitting or the like to one end side of the main body of the reflective cylinder 9*j* of aluminum and contact portions of the tubular member with the hole 5*bj* of the cathode 5*j* or with the fixing member 5*cj* are fused and secured to each other by laser welding or spot welding.

A variety of shapes can be adopted for the structure for welding fixed at the tip of the reflective cylinder 9*j*.

Figure 39:
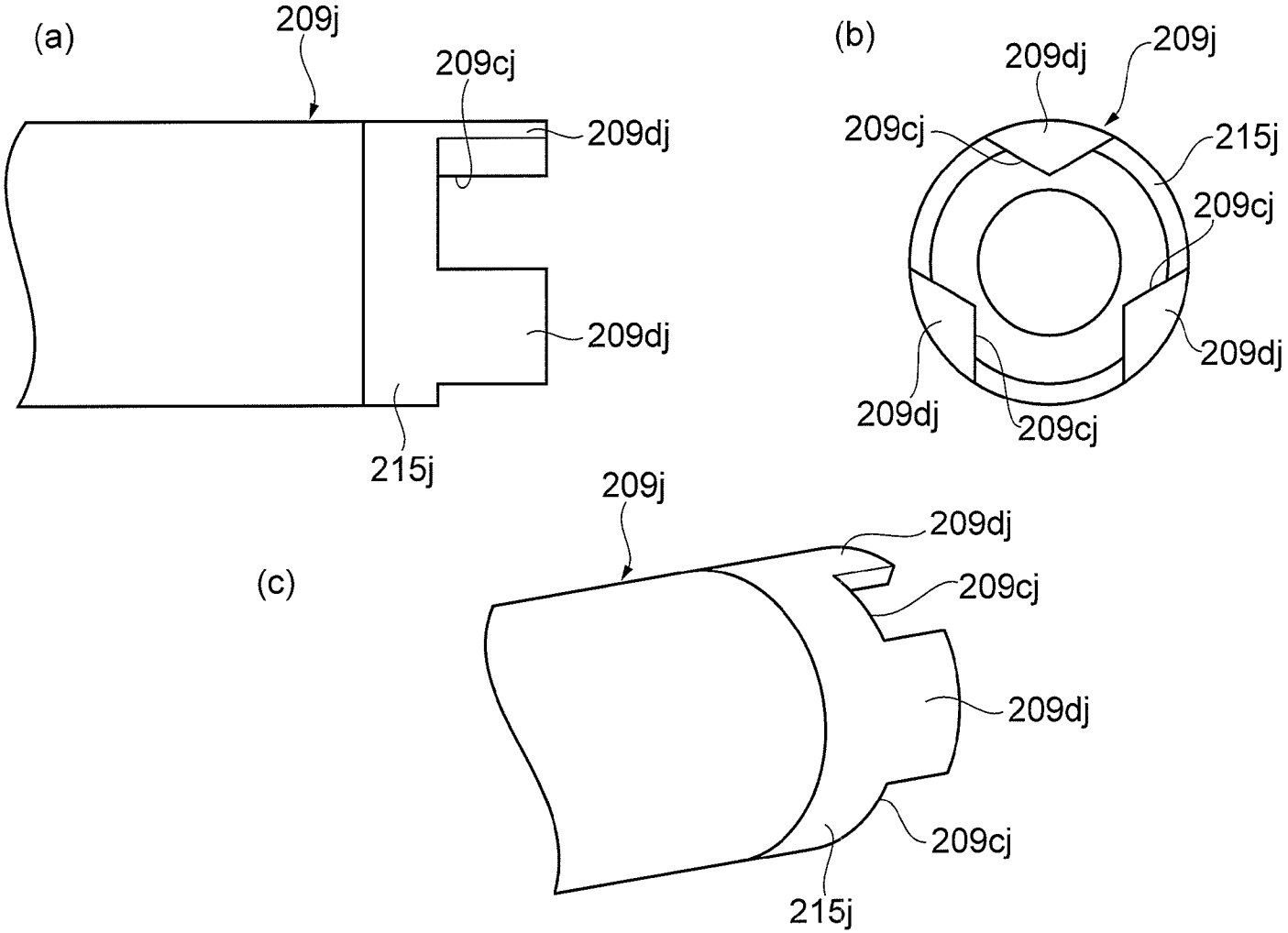
FIG. 39(*a*) is a side view of a reflective cylinder according to a modification example of the present invention, FIG. 39(*b*) an end view of the reflective cylinder in FIG. 39(*a*), and FIG. 39(*c*) a perspective view of the reflective cylinder in FIG. 39(*a*).
Figure 40:
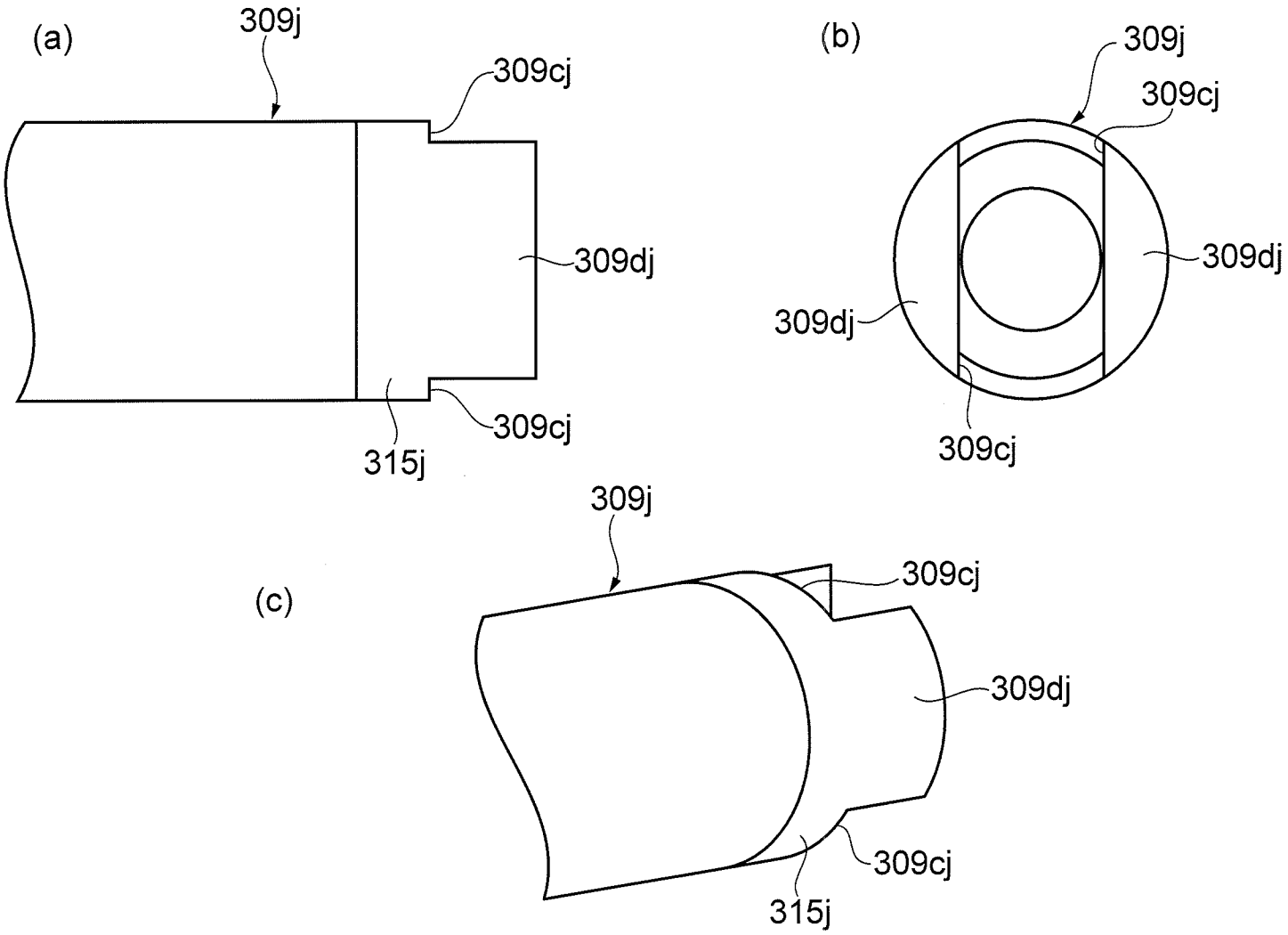
FIG. 40(*a*) is a side view of a reflective cylinder according to a modification example of the present invention, FIG. 40(*b*) an end view of the reflective cylinder in FIG. 40(*a*), and FIG. 40(*c*) a perspective view of the reflective cylinder in FIG. 40(*a*).
Figure 41:
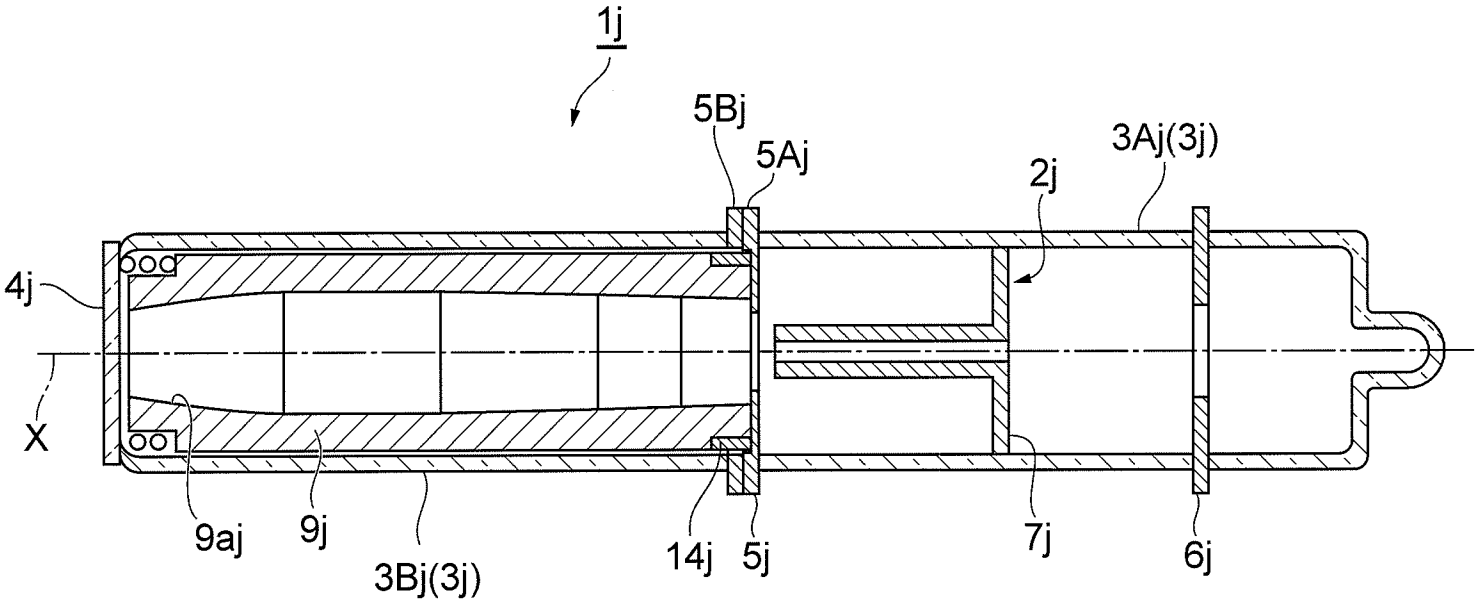
FIG. 41 is a sectional view showing a configuration of a light source according to a modification example of the present invention.
Figure 42:
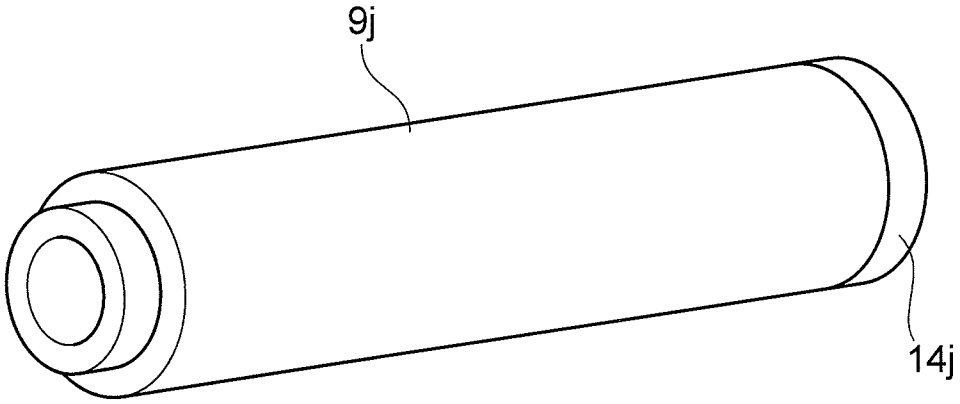
FIG. 42 is a perspective view of a reflective cylinder in FIG. 41.

For example, like reflective cylinders 209*j*, 309*j* according to modification examples of the present invention shown in FIGS. 39 and 40, a stainless steel structure 215*j* or 315*j* with apertures 209*cj*, 309*cj* and projections 209*dj*, 309*dj* is forced into and fixed to the main body part of the reflective cylinder 209*j*, 309*j* and it is welded to the receiving structure of the cathode 5*j*. In another example, as shown in FIGS. 41 and 42, where the reflective cylinder 9*j* has no apertures, only an end ring 14*j* of stainless steel similarly without apertures is pressed thereinto and contact portions between the end ring 14*j* and the hole 5*bj* of the cathode 5*j* or the fixing member 5*cj* are welded to be fixed.

Instead of the fixing method by the welding between the cathode 5*j* and the receiving structure as described above, it is also possible to adopt a method of directly tapping the receiving structure and the reflective cylinder and screwing them, a method of tapping the receiving structure in the peripheral direction thereof and fixing them with screws.

The thermal radiation film 10*j* is formed in part or in whole of the outer wall surface 9*bj* or 109*bj* of the reflective cylinder 9*j* or 109*j* in the light source 1*j* or 101*j*, but, conversely, a material with the thermal emissivity lower than that of the material of the reflective cylinder 9*j* or 109*j* may be formed on the other end side of the outer wall surface 9*bj* or 109*bj*. This configuration relatively enhances heat radiation on the one end side and is expected to provide the same effect as the thermal radiation film 10*j*. The material of the metal block member forming the one end side of the reflective cylinder 9*j* or 109*j* may be comprised of a material with the thermal emissivity larger than that of the material of the metal block member forming the other end side.

Twelfth Embodiment

Figure 44:
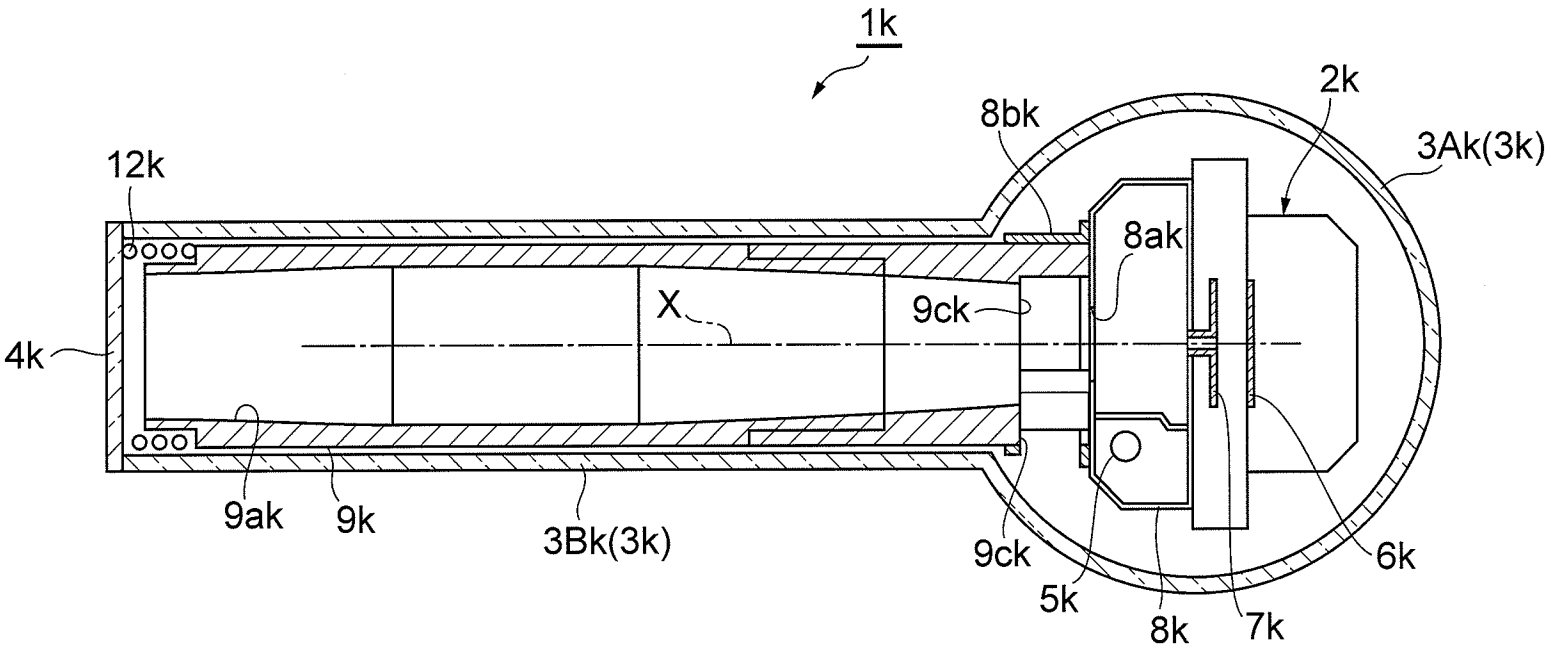
FIG. 44 is a sectional view showing a configuration of a light source according to the twelfth embodiment of the present invention.

FIG. 44 is a sectional view showing a configuration of a light source according to the twelfth embodiment of the present invention. The light source 1*k* shown in the same drawing is a so-called deuterium lamp used as a light source for analytical equipment such as a photoionization source of a mass spectrometer or as a light source for vacuum electricity removal.

This light source 1*k* is provided with a hermetic container 3*k* of glass in which a luminescent cylinder (first housing) 3Ak of a substantially cylindrical shape housing a luminescent part 2*k* to induce discharge of deuterium gas to generate light, is integrally connected to a light guide cylinder (second housing) 3Bk of a substantially cylindrical shape kept in communication with the luminescent cylinder 3Ak and projecting along the optical axis X of light generated by the luminescent part 2*k*, from the side wall of the luminescent cylinder 3Ak. In this hermetic container 3*k* deuterium gas is enclosed under the pressure of about several hundred Pa. More specifically, the light guide cylinder 3Bk is integrated in communication with the luminescent cylinder 3Ak on a one end side in the direction along the optical axis X and is sealed on the other end side by an exit window 4*k* to emit the light generated from the luminescent part 2*k*, to the outside. A material of this exit window 4*k* is, for example, $MgF_2$ (magnesium fluoride), LiF (lithium fluoride), silica glass, or sapphire glass.

The luminescent part 2*k* housed in the luminescent cylinder 3Ak is composed of a cathode 5*k*, an anode 6*k*, a discharge path limiter 7*k* arranged between the anode 6*k* and the cathode 5*k* and having an aperture formed in a central region, and a housing case 8*k* arranged so as to surround these. In a surface of this housing case 8*k* on the light guide cylinder 3Bk side, a light passage port Bak of a rectangular shape for extraction of the light generated by the luminescent part 2*k* is formed so as to face the exit window 4*k* of the light guide cylinder 3Bk and, a fixing ring 8*bk* consisting of a wall part extending in a circular shape along the side wall of the light guide cylinder 3Bk is fixed so as to surround the light passage port 8*ak*. When a voltage is applied between the cathode 5*k* and the anode 6*k*, the luminescent part 2*k* induces ionization and discharge of the deuterium gas existing between them, to form a plasma state and the discharge path limiter 7*k* narrows it into a high-density plasma state, thereby to generate light (ultraviolet light), which is emitted from the light passage port Bak of the housing case 8*k* into the direction along the optical axis X.

The foregoing luminescent part 2*k* is held in the luminescent cylinder 3Ak by a stem pin (not shown) standing on a stem part disposed on an end face of the luminescent cylinder 3Ak. Namely, this light source 1*k* is a side-on type light source in which the optical axis X intersects with the tube axis of the luminescent cylinder 3Ak.

Figure 45:
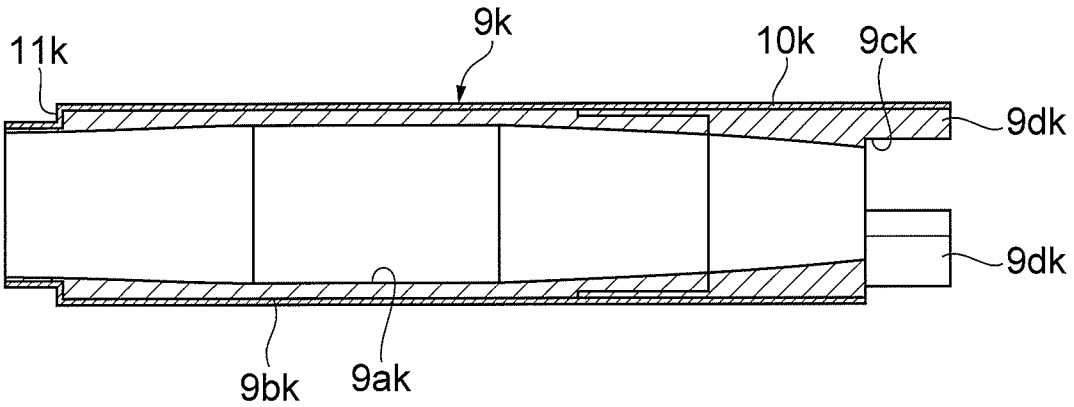
FIG. 45(*a*) is a sectional view of a reflective cylinder in FIG. 44 and FIG. 45(*b*) an end view of the reflective cylinder in FIG. 44.
Figure 45:
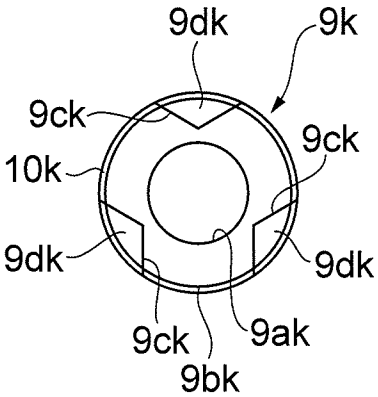

A reflective cylinder (cylindrical member) 9*k* of a substantially cylindrical shape is inserted and fixed between the exit window 4*k* in the hermetic container 3*k* of this configuration and a portion connecting the luminescent cylinder 3Ak and the light guide cylinder 3Bk. This reflective cylinder 9*k* is, as shown in FIG. 45, a combination of metal block members of aluminum and is formed in a substantially cylindrical shape having an outside diameter smaller than an inside diameter of the light guide cylinder 3Bk.

An inner wall surface of the reflective cylinder 9*k* itself is formed as a reflective surface 9*ak* which is a curved surface along the central axis of the reflective cylinder 9*k*, or a multistep surface with inclination angles varying stepwise. Namely, this reflective surface 9*ak* is formed so that the two ends of the reflective cylinder 9*k* in the central-axis direction are tapered so as to be able to converge the light at a desired surface or point outside the exit window 4*k*. More specifically, the reflective surface 9*ak* is formed as inclined with respect to the central axis of the reflective cylinder 9*k*, i.e., with respect to the optical axis X so that the diameter of the space surrounded by the reflective surface 9*ak* gradually decreases from a longitudinal central region of the reflective cylinder 9*k* toward the end on the luminescent cylinder 3Ak side. Furthermore, the reflective surface 9*ak* is formed as inclined with respect to the central axis of the reflective cylinder 9*k* so that the diameter of the space surrounded by the reflective surface 9*ak* gradually decreases from the longitudinal central region of the reflective cylinder 9*k* toward the end on the exit window 4*k* side. The tapered structure of the reflective surface 9*ak* may be provided at either one of the two ends of the reflective cylinder 9*k* in the central-axis direction, instead of that at the two ends; for example, the reflective surface 9*ak* may be formed in the tapered shape as described above, only on the luminescent part 2*k* side (one end side), while the reflective surface 9*ak* is formed in parallel to the central axis of the reflective cylinder 9*k* on the exit window 4*k* side (the other end side). This reflective surface 9*ak* is set so as to be able to converge the light at the desired surface or point or diverge the light. This reflective surface 9*ak* is processed in a mirror surface state capable of regularly reflecting the light generated by the luminescent part 2*k* and is formed, for example, by cutting the metal block members, polishing an inner wall thereof by a polishing method such as buffing, chemical polishing, electropolishing, or a derivative thereof, or by a polishing method as a complex thereof, and thereafter subjecting the surface to a washing treatment or a vacuum treatment or the like to remove an impurity gas component. In the present embodiment the reflective cylinder 9*k* is composed of a combination of two members and, when the reflective surface 9*ak* is formed of a plurality of metal block members as in this configuration, a ratio of length and inside diameter (aspect ratio) of each metal block member can be set smaller, so as to facilitate achievement of desired flatness during processing and shaping, thereby enhancing the mirror accuracy of the reflective surface 9*ak*.

Apertures 9*ck* cut along the central axis of the reflective cylinder 9*k* are formed toward the other end side of the outer wall surface 9*bk*, in the edge region on the longitudinal one end side of the outer wall surface (side face) 9*bk* of the reflective cylinder 9*k*. Since the apertures 9*ck* are made by cutting in this manner, it is easy to process the apertures. Particularly, the apertures 9*ck* are formed in three portions at equal intervals along the peripheral edge on the one end side of the reflective cylinder 9*k* and projections 9*dk* to be fitted in the fixing ring 8*bk* of the luminescent part 2*k* are formed in three portions between the neighboring apertures 9*ck*. Since the projections 9*dk* are also disposed at equal intervals as a result of the formation of the apertures 9*ck* at equal intervals, it is also feasible to ensure the strength of the projections 9*dk* themselves and the strength during fixing as well.

Furthermore, a thermal radiation film 10*k* containing a material with high thermal emissivity is formed over almost the entire area of the outer wall surface 9*bk* of the reflective cylinder 9*k*. The material of this thermal radiation film 10*k* to be used is one with the thermal emissivity higher than that of the material of the reflective cylinder 9*k*, e.g., aluminum oxide. The thermal radiation film 10*k* is formed, for example, by depositing the material forming the thermal radiation film

10*k*, on the outer wall surface 9*bk* of the reflective cylinder 9*k* by evaporation, coating, or the like, but, particularly, in the case where the reflective cylinder 9*k* is made of aluminum as in the present embodiment, a layer of aluminum oxide as the thermal radiation film 10*k* may be formed by oxidizing the outer wall surface 9*bk* of the reflective cylinder 9*k*.

A cut portion 11*k* cut in a circular shape so as to form a stepped projection is formed along the outer wall surface 9*bk*, in a peripheral edge region on the longitudinal other end side of the outer wall surface 9*bk* of the reflective cylinder 9*k*. This cut portion 11*k* is provided for positioning the reflective cylinder 9*k* in the hermetic container 3*k*.

Figure 46:
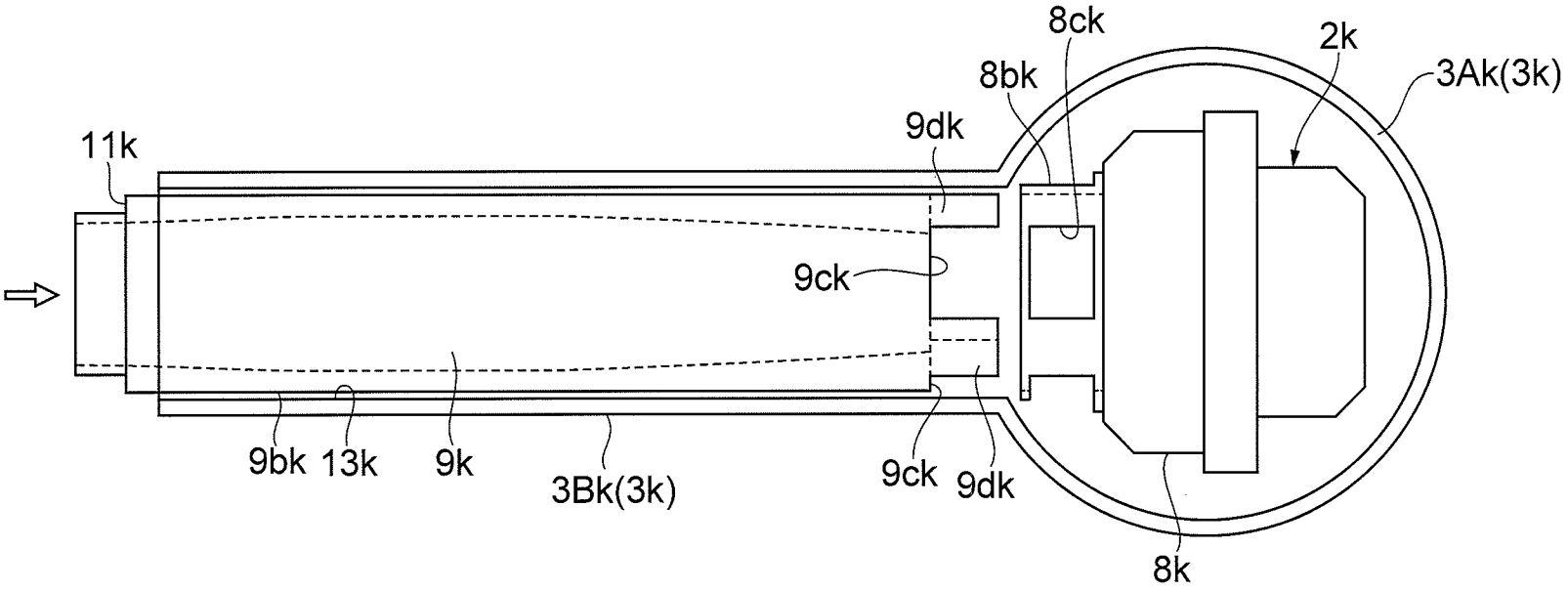
FIG. 46 is a side view showing an assembling state of the reflective cylinder in the light source in FIG. 44.

The reflective cylinder 9*k* of this configuration is inserted along the tube axis (optical axis X) of the light guide cylinder 3Bk from the edge region on the one end side where the apertures 9*ck* are formed, until the projections 9*dk* come into contact with the housing case 8*k* of the luminescent part 2*k* and, after a spring member 12*k* is attached along the outer wall surface 9*bk* to the cut portion 11*k*, the other end side of the light guide cylinder 3Bk is sealed by the exit window 4*k* (FIG. 44 and FIG. 46). At this time, the reflective cylinder 9*k* is fitted into the fixing ring 8*bk* of the housing case 8*k* in a state in which the outer wall surface 9*bk* thereof is separated from the inner wall surface 13*k* of the light guide cylinder 3Bk (FIG. 46). This spring member 12*k* is a member for positioning of the reflective cylinder 9*k*, which is comprised of a metal member, e.g., stainless steel or an Inconel material with high thermal resistance, and which is arranged between the cut portion Ilk and the exit window 4*k*, with a function to urge the reflective cylinder 9*k* from the exit window 4*k* side toward the luminescent part 2*k* along the optical axis X, thereby to press the reflective cylinder 9*k* against the housing case 8*k*. By this, the reflective cylinder 9*k* is positioned in a state in which the projections 9*dk* on the one end side are in contact with the housing case 8*k* of the luminescent part 2*k* and the other end side is inserted in the light guide cylinder 3Bk and located in close proximity to the exit window 4*k*, between the exit window 4*k* and the luminescent part 2*k* in the hermetic container 3*k*. Furthermore, apertures 8*ck* are formed at positions corresponding to the apertures 9*ck* of the reflective cylinder 9*k*, in the fixing ring 8*bk* of the housing case 8*k* and, when the reflective cylinder 9*k* is fitted into the fixing ring 8*bk* of the housing case 8*k*, the plurality of apertures 9*ck* to penetrate to the reflective surface 9*ak* are arranged in communication with the interior space of the luminescent cylinder 3Ak through the apertures 8*ck*, at the end of the outer wall surface 9*bk* of the reflective cylinder 9*k* located in the luminescent cylinder 3Ak.

In the light source 1*k* described above, the light emitted from the luminescent part 2*k* in the luminescent cylinder 3Ak is guided to the interior of the cylindrical reflective cylinder 9*k* inserted from the light guide cylinder 3Bk in communication with the luminescent cylinder 3Ak to the luminescent part 2*k*, thereby to be emitted from the exit window 4*k* provided in the light guide cylinder 3Bk. Since the reflective surface 9*ak* is formed on the inner wall surface of the reflective cylinder 9*k* herein, the light emitted from the luminescent part 2*k* is guided from the one end side to the other end side of the light guide cylinder 3Bk while being reflected by the reflective surface 9*ak* inside the reflective cylinder 9*k*, so that the light emitted from the luminescent part 2*k* can be guided to the exit window 4*k* of the light guide cylinder 3Bk, without loss. At this time, by properly setting the inclination angles of the reflective surface 9*ak*, the output light outside the exit window 4*k* can be distributed as any of parallel light, diverging light, and converging light and uniformity of light intensity can be enhanced on a predetermined illumination target surface. In conjunction therewith, the efficiency of extraction of the light from the exit window 4*k* improves, so as to increase the total light amount of the output light and the light amount on the illumination target surface. In the case of the conventional deuterium lamps, the light radiation pattern from the exit window tends to vary according to the distance from the exit window to cause an omission where radiant light is weak, whereas the light source 1*k* achieves reduction in occurrence of such an omission of the light radiation pattern.

In addition, since the apertures 9*ck* are formed in the outer wall surface 9*bk* (side face) on the one end side of the reflective cylinder 9*k* and the apertures 8*ck* are also formed at the corresponding positions in the fixing ring 8*bk*, the sputtered substance generated in the luminescent part 2*k* can be discharged to the outside of the reflective cylinder 9*k*, which can prevent the sputtered substance from adhering to the reflective surface 9*ak* of the reflective cylinder 9*k* and to the exit window 4*k* which is a part at low temperature. As a result, the optical transmittance can be enhanced at the exit window 4*k*, while achieving extension of service life. Since the apertures 9*ck* are located in the luminescent cylinder 3Ak, the sputtered substance generated in the luminescent part 2*k* becomes more likely to be discharged and captured in the luminescent cylinder 3Ak. As a result, it becomes feasible to further prevent scattering of the sputtered substance to the exit window 4*k* and thereby to further extend the service life.

Since the reflective cylinder 9*k* itself is comprised of the metal members such as the metal block members of aluminum, it becomes easier to process the reflective surface with high mirror accuracy and thus the generated light can be effectively converged. Furthermore, for example, unlike the case where a reflective film of metal or the like is formed inside the reflective cylinder 9*k*, it is feasible to prevent degradation of performance and generation of foreign matter due to delamination or dropout or the like of the reflective surface 9*ak* caused by a difference between coefficients of expansion of the constituent materials with repetitions of increase and decrease of temperature, and thereby to achieve extension of service life. In addition, the generated ultraviolet light is not transmitted, and deterioration due to the ultraviolet light is not caused, thereby achieving more efficient extraction of the generated light.

Furthermore, since the outer wall surface 9*bk* of the reflective cylinder 9*k* is separated from the inner wall surface 13*k* of the light guide cylinder 3Bk, it is feasible to prevent the positional deviation of the reflective cylinder 9*k* and breakage of the reflective cylinder 9*k* or the light guide cylinder 3Bk, because of a difference of coefficients of thermal expansion between the reflective cylinder 9*k* and the light guide cylinder 3Bk.

Since the reflective cylinder 9*k* is urged by the spring member 12*k* as the positioning member of the metal member to be fitted into the fixing ring 8*bk* of the housing case 8*k* so as to be positioned in the hermetic container 3*k*, it is not deteriorated by the generated ultraviolet light, whereby the position of the reflective cylinder 9*k* is kept stable relative to the hermetic container 3*k*, so as to maintain the extraction efficiency of light from the exit window 4*k*. By adopting the structure to push the reflective cylinder against the housing case 8*k* by the spring member 12*k*, it is feasible to stably fix the reflective cylinder 9*k* relative to the hermetic container 3*k* and to absorb positional deviation thereof relative to the luminescent cylinder 3Ak by the spring member 12*k* even with occurrence of thermal expansion along the central-axis direction of the reflective cylinder 9*k*.

Furthermore, since the thermal radiation film 10*k* is formed over almost the entire area of the outer wall surface 9*bk* of the reflective cylinder 9*k*, as shown in FIG. 45, a region at lower temperature than the surroundings and the enclosed gas can be formed on the inner surface of the reflective cylinder 9*k*, and the lower-temperature region can capture the foreign matter such as sputtered substance from the luminescent cylinder 3Ak, so as to prevent the foreign matter from diffusing and attaching to the exit window 4*k* and prevent reduction of optical transmittance caused thereby.

When the light source 1*k* of this configuration is used a photoionization source in a mass spectrometer (MS) such as a gas chromatography mass spectrometer (GC/MS) or a liquid chromatography mass spectrometer (LC/MS), it is feasible to achieve high sensitivity, prevent contamination of the window material, and achieve a good time response characteristic. Firstly, the light amount on the irradiation target surface can be drastically increased so as to improve a probability of contact with a sample, whereby the sensitivity can be improved to a large extent (nearly ten times) in comparison to the conventional photoionization sources. It also becomes feasible to achieve convergence of light suitable for a variety of MSs, and the measurement sensitivity is enhanced on the following points. Specifically, in the case of MS, the light can be focused on an effective portion of an electric field distribution for introducing ions to a discriminator in an ionization chamber. In the case of GC/MS, the light can be effectively focused and introduced through an aperture of about several mm of the ionization chamber. In the case of LC/MS, the light can be focused around an aperture to introduce ions into the discriminator, to enhance an ion density, and the window of the photoionization source can be located away from a sample ejection port to prevent contamination of the window, while avoiding degradation of sensitivity even at the distant location from the ionization source because of the enhancement of light convergence more than before. Namely, the high-density light is guided onto a high-density sample part to enhance ionization efficiency, thereby achieving high sensitivity; the window of the photoionization source is located away from the sample ejection port, thereby preventing contamination of the window; the light is focused on the sample ejection port, thereby increasing the response speed.

Thirteenth Embodiment

Figure 47:
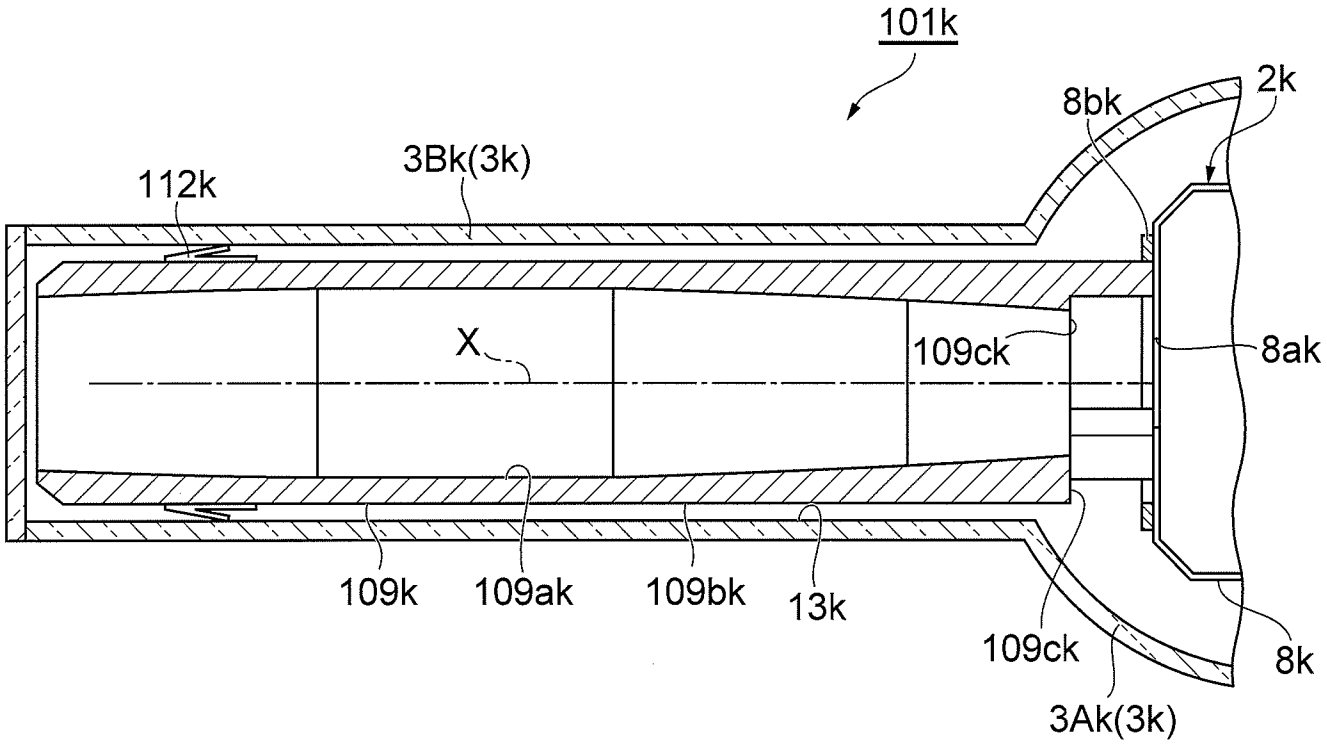
FIG. 47 is a sectional view showing a configuration of a light source according to the thirteenth embodiment of the present invention.
Figure 48:
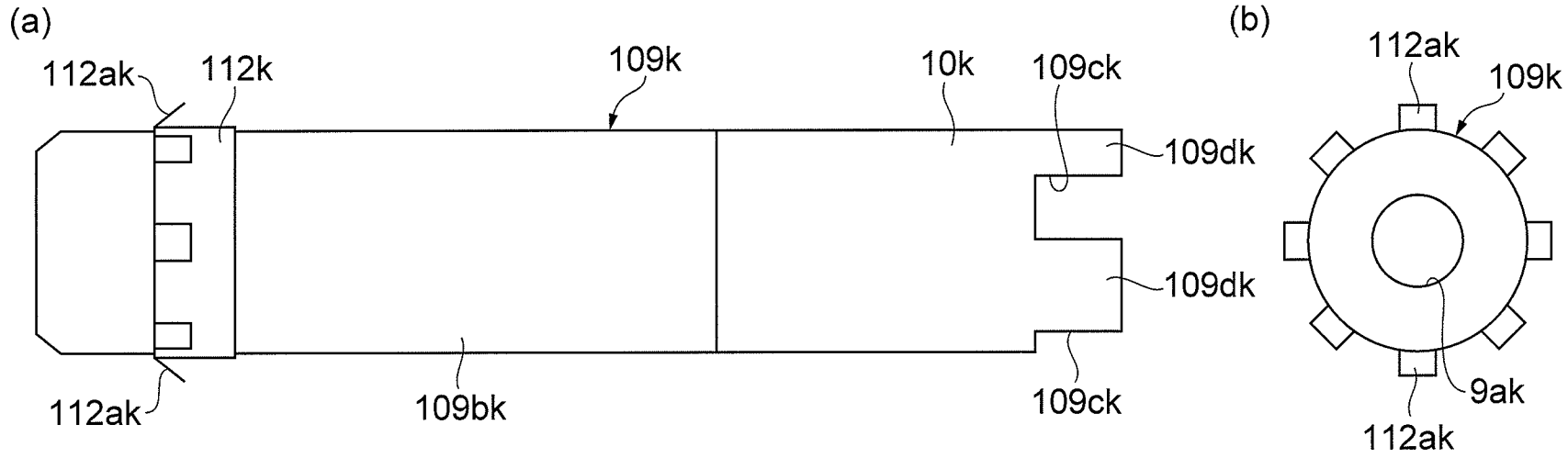
FIG. 48(*a*) is a side view of a reflective cylinder in FIG. 47 and FIG. 48(*b*) an end view of the reflective cylinder in FIG. 47.

FIG. 47 is a sectional view showing a configuration of a light source according to the thirteenth embodiment of the present invention, FIG. 48(*a*) a side view of a reflective cylinder in FIG. 47, and FIG. 48(*b*) an end view of the reflective cylinder in FIG. 47. The light source 101*k* shown in the same drawings is different mainly in the positioning structure of the reflective cylinder 109*k* from that in the twelfth embodiment.

Specifically, a metal band 112*k* as a positioning member is fixed to the reflective cylinder 109*k* set inside the light source 101*k*, at an end of its outer wall surface 109*bk* on the exit window 4*k* side. In this metal band 112*k*, a plurality of claws 112*ak* with spring action are formed along the outer periphery of the reflective cylinder 109*k*, and the metal band 112*k* is welded at its end by lap welding to be fixed on the outer wall surface 109*bk*. The reflective cylinder 109*k* of this configuration is inserted into the hermetic container 3*k* along the inner wall surface 13*k* of the light guide cylinder 3Bk and is fixed so that the outer wall surface 109*bk* is separated from the inner wall surface 13*k* except for the metal band 112*k*. In this structure, the reflective cylinder 109*k* is urged against the housing case 8*k* by spring forces of the claws 112*ak* of the metal band 112*k* in a state in which the projections 109*dk* formed at the end thereof are fitted in the aperture of the fixing ring 8*bk* of the flat plate shape welded to the housing case 8*k*, to be positioned in the direction along the optical axis X in the hermetic container 3*k*. In conjunction therewith, the reflective cylinder 109*k* is also positioned in the directions perpendicular to the optical axis X in a state in which the outer wall surface 109*bk* thereof and the inner wall surface 13*k* of the light guide cylinder 3Bk are separated from each other at a fixed distance, by the claws 112*ak* of the metal band 112*k*. If a groove is formed in the width of the metal band in the region of the reflective cylinder 109*k* where the metal band 112*k* is mounted, the distance from the metal band 112*k* to the inner wall surface 13*k* of the light guide cylinder 3Bk can be set larger without increase in the inside diameter of the light guide cylinder 3Bk and angles of the claws 112*ak* can be increased, with the result of increase in the spring forces of the claws 112*ak*.

The light source 101*k* of this configuration can also prevent the positional deviation of the reflective cylinder 109*k* and the breakage of the reflective cylinder 109*k* or the light guide cylinder 3Bk, because of the difference of coefficients of thermal expansion between the reflective cylinder 109*k* and the light guide cylinder 3Bk. Since the reflective cylinder 109*k* is urged into the fixing ring 8*bk* of the housing case 8*k* by the metal band 112*k* as the positioning member to be positioned in the hermetic container 3*k*, it becomes feasible to stabilize the position of the reflective cylinder 109*k* relative to the hermetic container 3*k* and thereby to ensure sufficient extraction efficiency of light from the exit window 4*k*.

Moreover, since the apertures 109*ck* are formed in the outer wall surface 109*bk* (side face) on the one end side of the reflective cylinder 109*k* and the apertures are exposed without being blocked by the fixing ring 8*bk*, the sputtered substance generated in the luminescent cylinder 3Ak can be discharged to the outside of the reflective cylinder 109*k*, which can prevent the sputtered substance from adhering to the reflective surface 109*ak* of the reflective cylinder 109*k* and to the exit window 4*k* which is a part at low temperature.

Fourteenth Embodiment

Figure 49:
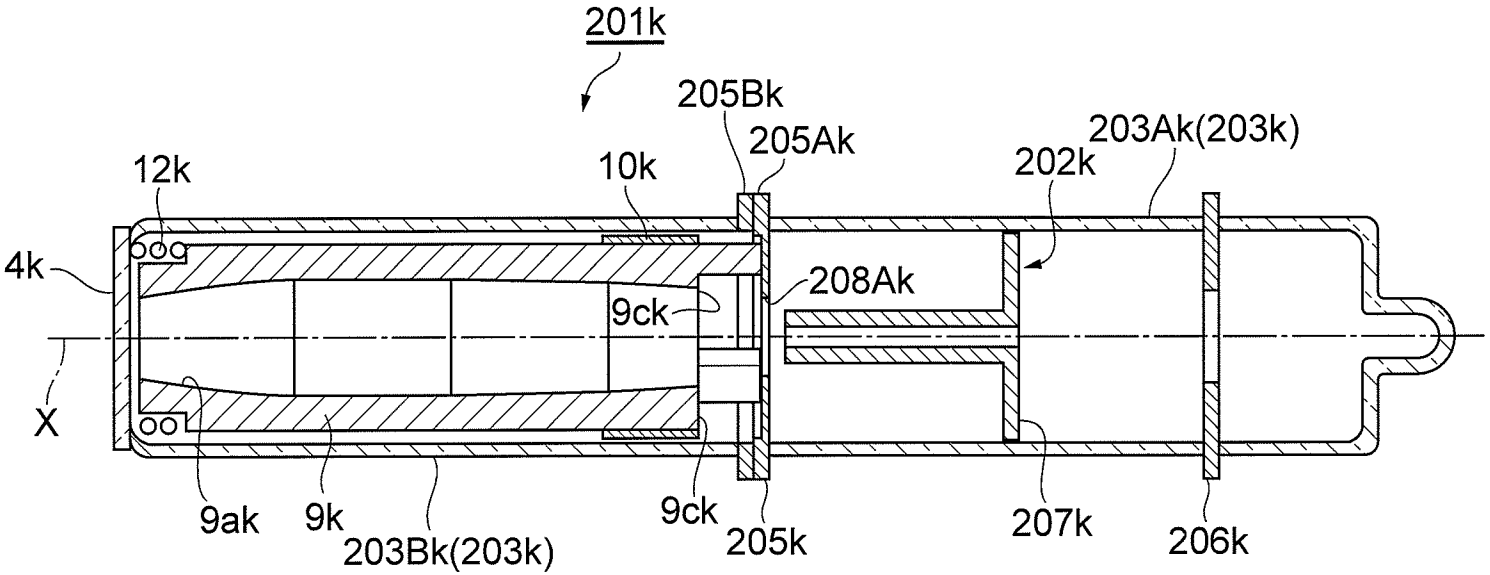
FIG. 49 is a sectional view showing a configuration of a light source according to the fourteenth embodiment of the present invention.

FIG. 49 is a sectional view showing a configuration of a light source according to the fourteenth embodiment of the present invention. The light source 201*k* shown in the same drawing is an example of application of the present invention to a capillary discharge tube.

The light source 201*k* is provided with a hermetic container 203*k* of glass in which a luminescent cylinder 203Ak and a light guide cylinder 203Bk are connected. Enclosed in this luminescent cylinder 203Ak is a luminescent part 202*k* composed of a cathode 205*k*, an anode 206*k*, and a capillary 207*k* arranged between the anode 206*k* and the cathode 205*k*. A gas such as hydrogen ($H_2$), xenon (Xe), argon (Ar), or krypton (Kr) is enclosed in the hermetic container 203*k*. When a voltage is applied between the cathode 205*k* and the anode 206*k*, the luminescent part 202*k* of this configuration induces ionization and discharge of the gas existing between them, and electrons are converged in the capillary 207*k* to form a plasma state, whereby light is emitted along the optical axis X toward the light guide cylinder 203Bk. For example, in the case where the enclosed gas is Kr and the material of the exit window 4*k* used is $MgF_2$, the light can be emitted at the wavelength of 117/122 nm; in the case where the enclosed gas is Ar and the material of the exit window 4*k* used is LiF, the light can be emitted at the wavelength of 105 nm.

This cathode 205*k* also functions as a connection member arranged at the part to separate the luminescent cylinder 203Ak and the light guide cylinder 203Bk from each other. Particularly, the cathode 205*k* consists of a double structure of a fixing ring member 205Ak formed so as to be opposed to the exit window 4*k* of the light guide cylinder 203Bk and provided with a depression of a size matched with the outside diameter shape of the reflective cylinder 9*k*, for positioning of the reflective cylinder 9*k*, and a sealing ring 205Bk bonded as sealed to the light guide cylinder 203Bk and engaged with the fixing ring 205Ak to be joined in a vacuum-retainable state. Another member may be attached as a member for positioning of the reflective cylinder 9*k*, to the cathode 205*k*.

For incorporating the reflective cylinder 9*k* into the hermetic container 203*k* of the light source 201*k* as described above, the fixing ring member 205Ak and the sealing ring 205Bk of the cathode 205*k* are joined to the luminescent cylinder 203Ak and to the light guide cylinder 203Bk, respectively. Then the reflective cylinder 9*k* is inserted so as to be separated from the inner wall surface of the light guide cylinder 203Bk while being fitted into the fixing ring 205Ak, and thereafter the fixing ring member 205Ak and the sealing ring 205Bk are stacked and joined in a vacuum-retainable state to be assembled. Another available assembly method is such that after the reflective cylinder 9*k* is welded and fixed to the cathode 205*k*, the light guide cylinder 203Bk is joined in a vacuum-retainable state to the cathode 205*k*.

The light source 201*k* of this configuration can also prevent the positional deviation of the reflective cylinder 9*k* and the breakage of the reflective cylinder 9*k* or the light guide cylinder 203Bk, because of the difference of coefficients of thermal expansion between the reflective cylinder 9*k* and the light guide cylinder 203Bk. Since the reflective cylinder 9*k* is urged into the fixing ring 205Ak of the cathode 205*k* by the spring member 12*k* as the positioning member to be positioned in the hermetic container 203*k*, it is feasible to stabilize the position of the reflective cylinder 9*k* relative to the hermetic container 203*k* and ensure sufficient extraction efficiency of light from the exit window 4*k*.

Furthermore, since the apertures 9*ck* are formed on the one end side of the reflective cylinder 9*k*, the sputtered substance generated in the luminescent cylinder 203Ak can be discharged to the outside of the reflective cylinder 9*k*, which can prevent the sputtered substance from adhering to the reflective surface 9*ak* of the reflective cylinder 9*k* and to the exit window 4*k* which is a part at low temperature.

Moreover, since the thermal radiation film 10*k* is formed on the longitudinal one end side of the outer wall surface 9*bk* of the reflective cylinder 9*k*, a portion at lower temperature than the surroundings and the enclosed gas can be formed inside the reflective cylinder 9*k* in close proximity to the luminescent part 202*k*, and the lower-temperature portion can capture the foreign matter such as sputtered substance from the luminescent cylinder 203Ak, so as to prevent the foreign matter from diffusing to the exit window 4*k* and prevent the reduction of optical transmittance caused thereby. Particularly, when the thermal radiation film 10*k* is formed in part of the outer wall surface 9*bk* near the luminescent cylinder 203Ak, the thermal emissivity on the one end side of the outer wall surface 9*bk* becomes larger than that on the other end side of the outer wall surface 9*bk*, and as a result, the sputtered substance becomes likely to be deposited on the side nearer the luminescent cylinder 203Ak side, i.e., at positions away from the exit window 4*k*, which further reduces contamination of the exit window 4*k*.

The present invention does not have to be limited to the above-described embodiments. For example, the reflective surface 9*ak* or 109*ak* was formed on the reflective cylinder 9*k* or 109*k* by polishing the inner wall of the metal members, but the reflective surface may be formed by evaporation or sputtering. Particularly, the reflective surface can be formed by preparing a base by cutting or molding of a metal member such as aluminum, or a member of glass, ceramic, or the like, polishing the base if necessary, and thereafter depositing an aluminum, rhodium, or dielectric multilayer film or the like on a mirror surface of the base by evaporation or sputtering. The reflective cylinder 9*k* or 109*k* was formed of a plurality of metal block members, but it may be formed as an integral body.

Figure 50:
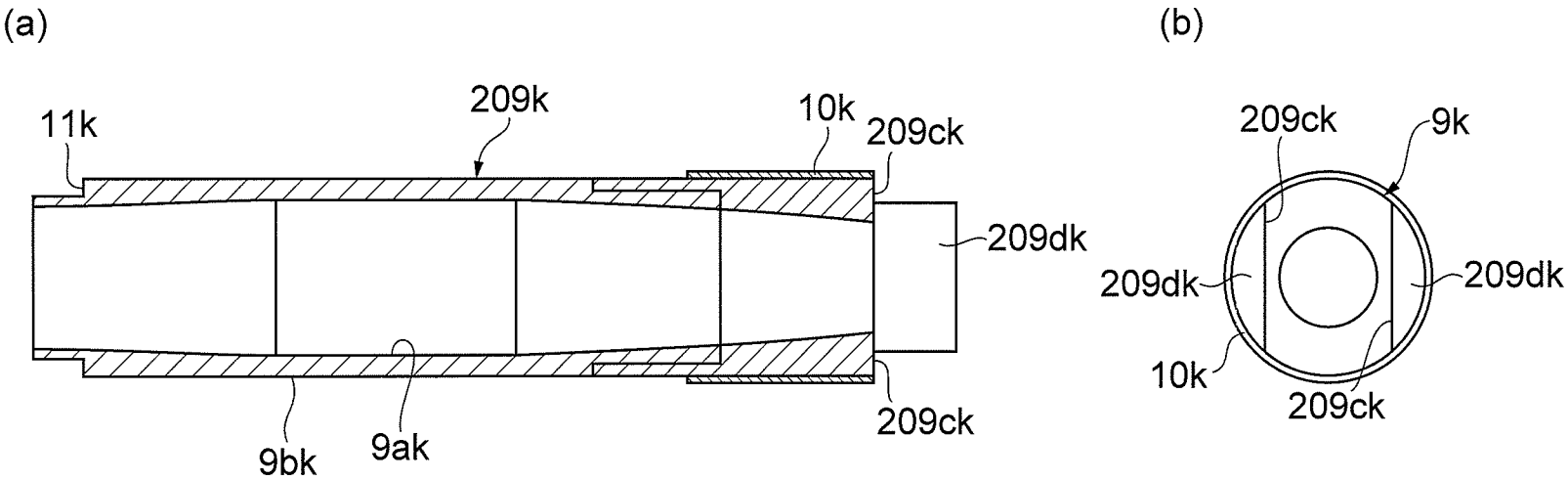
FIG. 50(*a*) is a sectional view of a reflective cylinder according to a modification example of the present invention and FIG. 50(*b*) an end view of the reflective cylinder in FIG. 50(*a*).

A variety of shapes can be adopted for the shapes of the apertures 9*ck*, 109*ck* and the projections 9*dk*, 109*dk* of the reflective cylinder 9*k*, 109*k*. For example, as in the case of the reflective cylinder 209*k* according to a modification example of the present invention shown in FIG. 50, it is possible to adopt a configuration wherein there are apertures 209*ck* formed at two locations along the peripheral edge on the one end side of the outer wall surface 9*bk* and projections 209*dk* formed at two locations so as to sandwich the apertures at the two locations in between.

In the foregoing embodiments, the reflective cylinder 9*k* or 109*k* was fixed by pressing it against the fixing member provided on the luminescent cylinder 3Ak or 203Ak side, but it may be fixed directly to the fixing member by laser welding, spot welding, or the like. In this case, if it is difficult to weld the reflective cylinder directly to the fixing member, it is possible to adopt a method of fixing a weldable structure to the reflective cylinder by engagement or the like and welding the structure to the fixing member. In the case of the laser welding, it is also possible to perform the welding through the glass member of the luminescent cylinder 3Ak, 203Ak.

Figure 51:
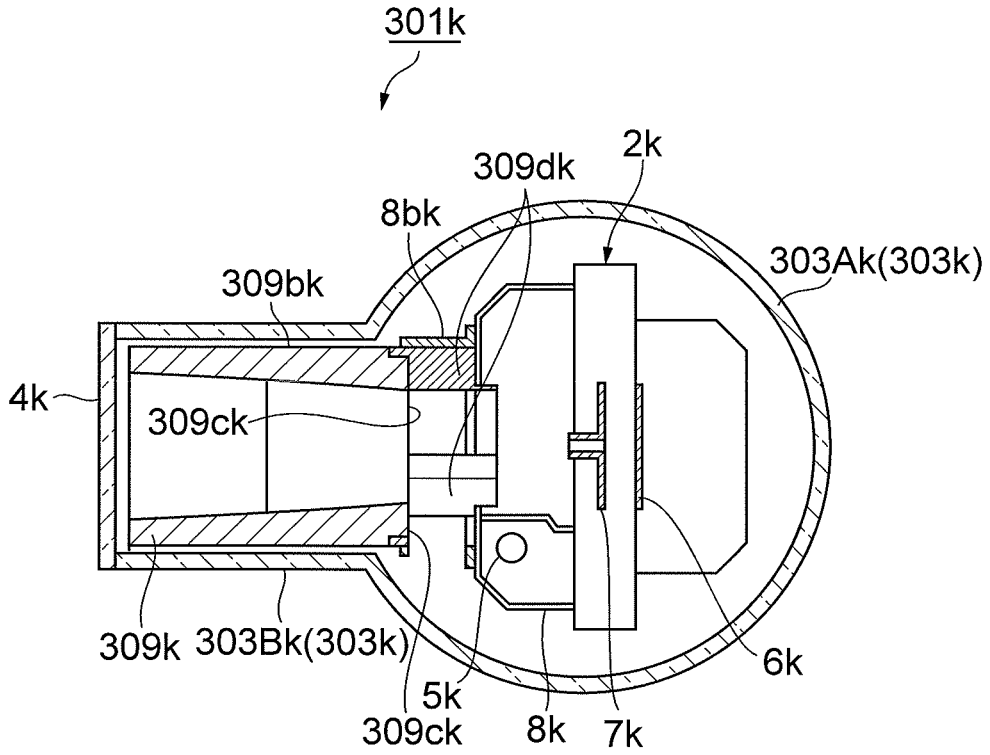
FIG. 51 is a sectional view showing a configuration of a light source according to a modification example of the present invention.

FIG. 51 shows a structure in which a reflective cylinder 309*k* comprised of metal members of two different materials is fixed to the housing case 8*k* of the luminescent part 2*k* by laser welding or spot welding, as a light source 301*k* which is a modification example of the present invention. Particularly, a fixing part of stainless steel with apertures 309Ck is forced onto and fixed to the end on the luminescent part 2*k* side of the main body part of the reflective cylinder 309*k* of aluminum and contact portions between the fixing part and the fixing ring 8*bk* of the housing case 8*k* are welded and secured to each other by laser welding or spot welding. In the light source 301*k* shown in the same drawing, the light guide cylinder 303Bk is set shorter, but the distribution of emitted light can also be parallel light or diverging light by designing the reflective cylinder 309*k* so as to match it, and the uniformity of light intensity can also be enhanced on the illumination target surface. Furthermore, as in the case of the light source 301*k*, projections 309*dk* of the reflective cylinder 309*k* may be arranged to extend into the housing case 8*k* so as to be located near the discharge path limiter 7*k* within the range not to impede the current of charged particles. In this configuration, the reflective cylinder 309*k* can capture the sputtered substance from the interior of the luminescent part 2*k*, whereby the sputtered substance can be prevented more from adhering to the exit window 4*k* as the low-temperature part. Furthermore, when the inner wall surface of the fixing part including the projections 309*dk* of the reflective cylinder 309*k* is formed to be a reflective surface, the light emitted from the luminescent part 2*k* can be guided to the exit window 4*k*, without loss.

A variety of shapes can be adopted for the structure for welding to be fixed to the one end side of the reflective cylinder 309*k*.

Figure 52:
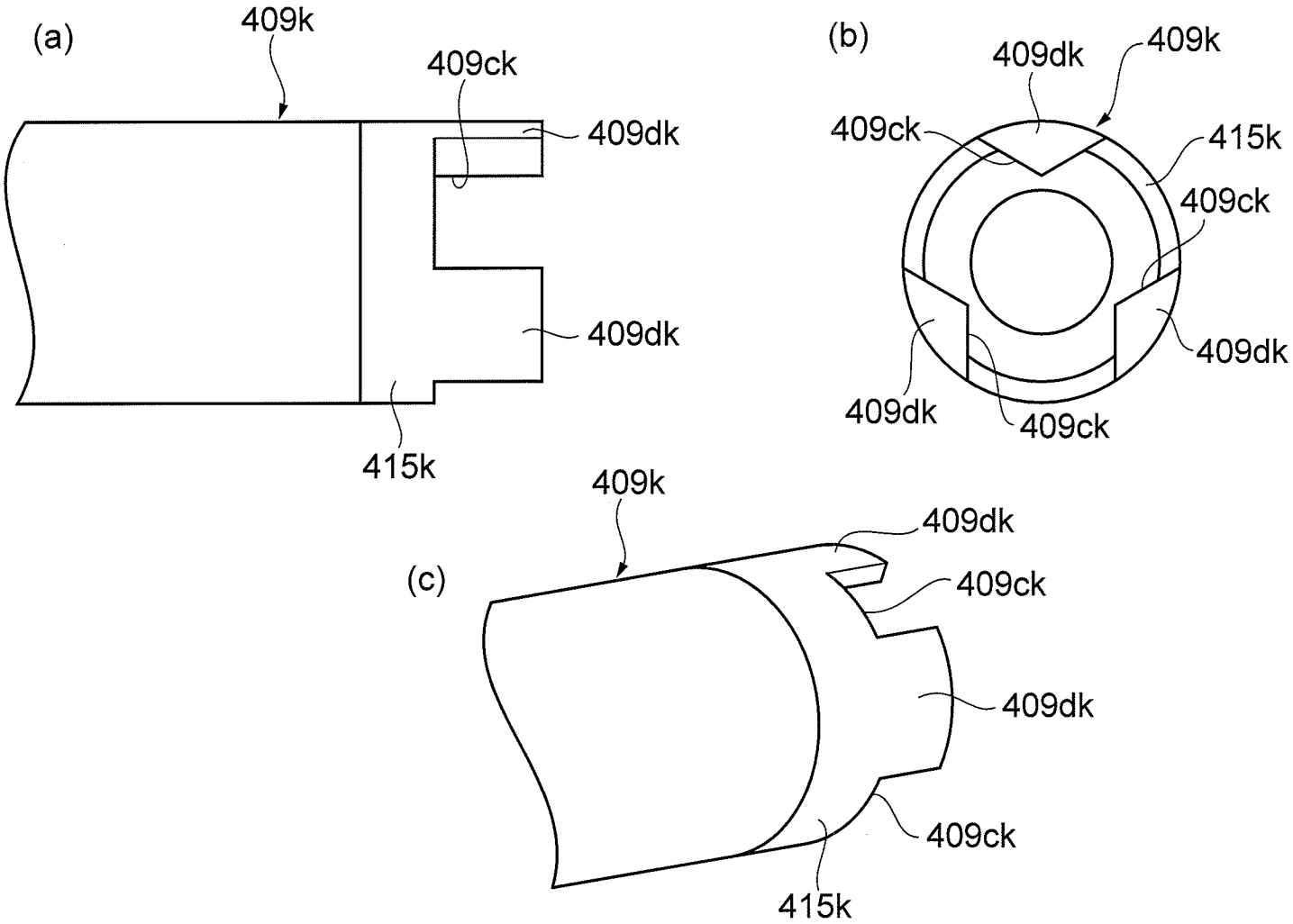
FIG. 52(*a*) is a side view showing a part of a reflective cylinder according to a modification example of the present invention, FIG. 52(*b*) an end view of the reflective cylinder in FIG. 52(*a*), and FIG. 52(*c*) a perspective view of the reflective cylinder in FIG. 52(*a*).
Figure 53:
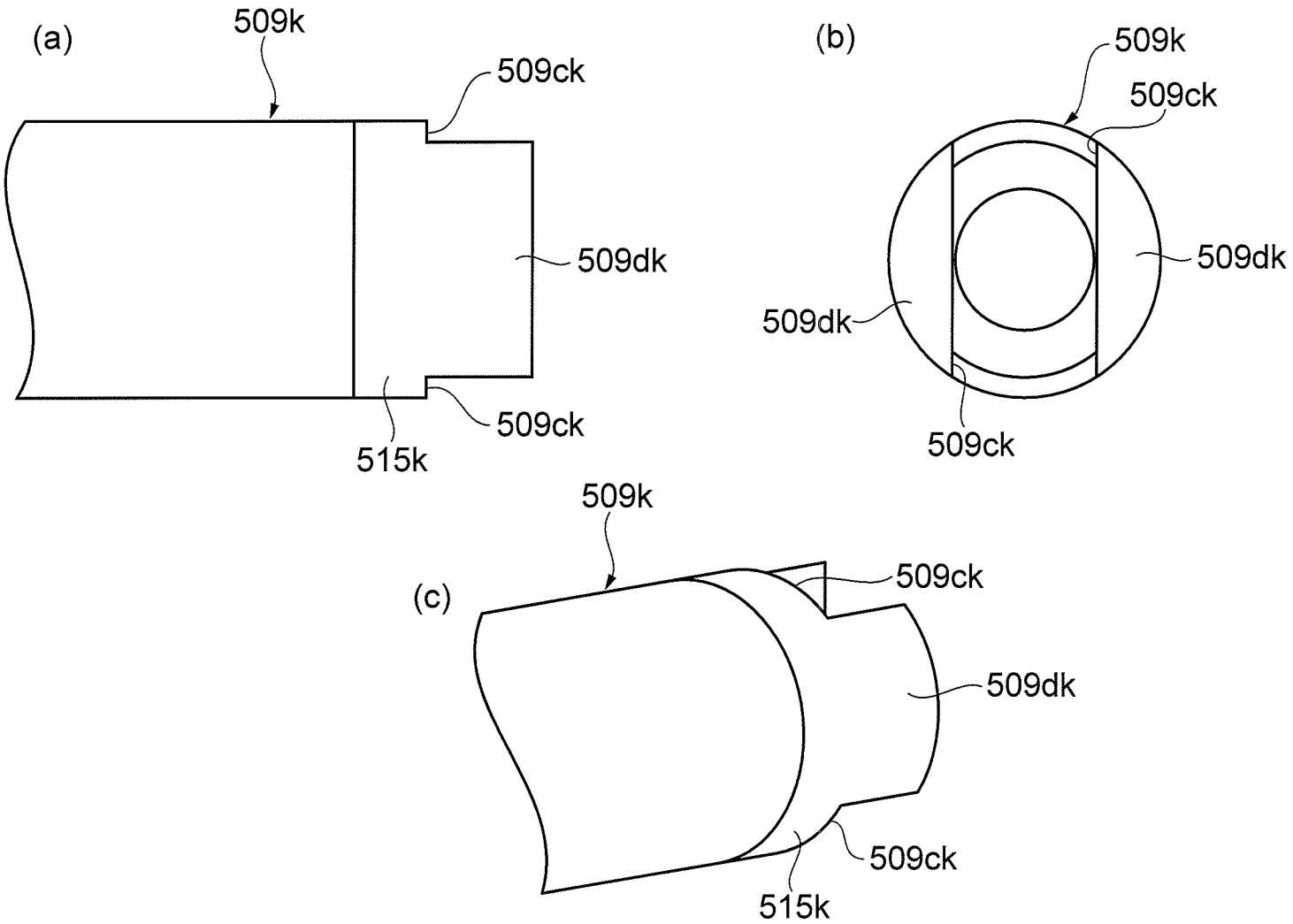
FIG. 53(*a*) is a side view showing a part of a reflective cylinder according to a modification example of the present invention, FIG. 53(*b*) an end view of the reflective cylinder in FIG. 53(*a*), and FIG. 53(*c*) a perspective view of the reflective cylinder in FIG. 53(*a*).

For example, FIGS. 52 and 53 show only metal block members as the fixing part to be welded and fixed directly to the fixing ring 8*bk* of the housing case 8*k*, out of the metal block members forming the reflective cylinder 309*k* in FIG. 51, as modification examples of the present invention. As in the case of reflective cylinders 409*k*, 509*k* shown in these drawings, the fixing part 415*k* of stainless steel with apertures 409*ck* and projections 409*dk* formed like the apertures 9*ck* and projections 9*dk* of the reflective cylinder 9*k*, or the fixing part 515*k* of stainless steel with apertures 509*ck* and projections 509*dk* formed like the apertures 209*ck* and projections 209*dk* of the reflective cylinder 209*k* can be forced onto and fixed to the main body part of the reflective cylinder 409*k* and it can be welded to the fixing ring 8*bk* of the housing case 8*k*.

Figure 54:
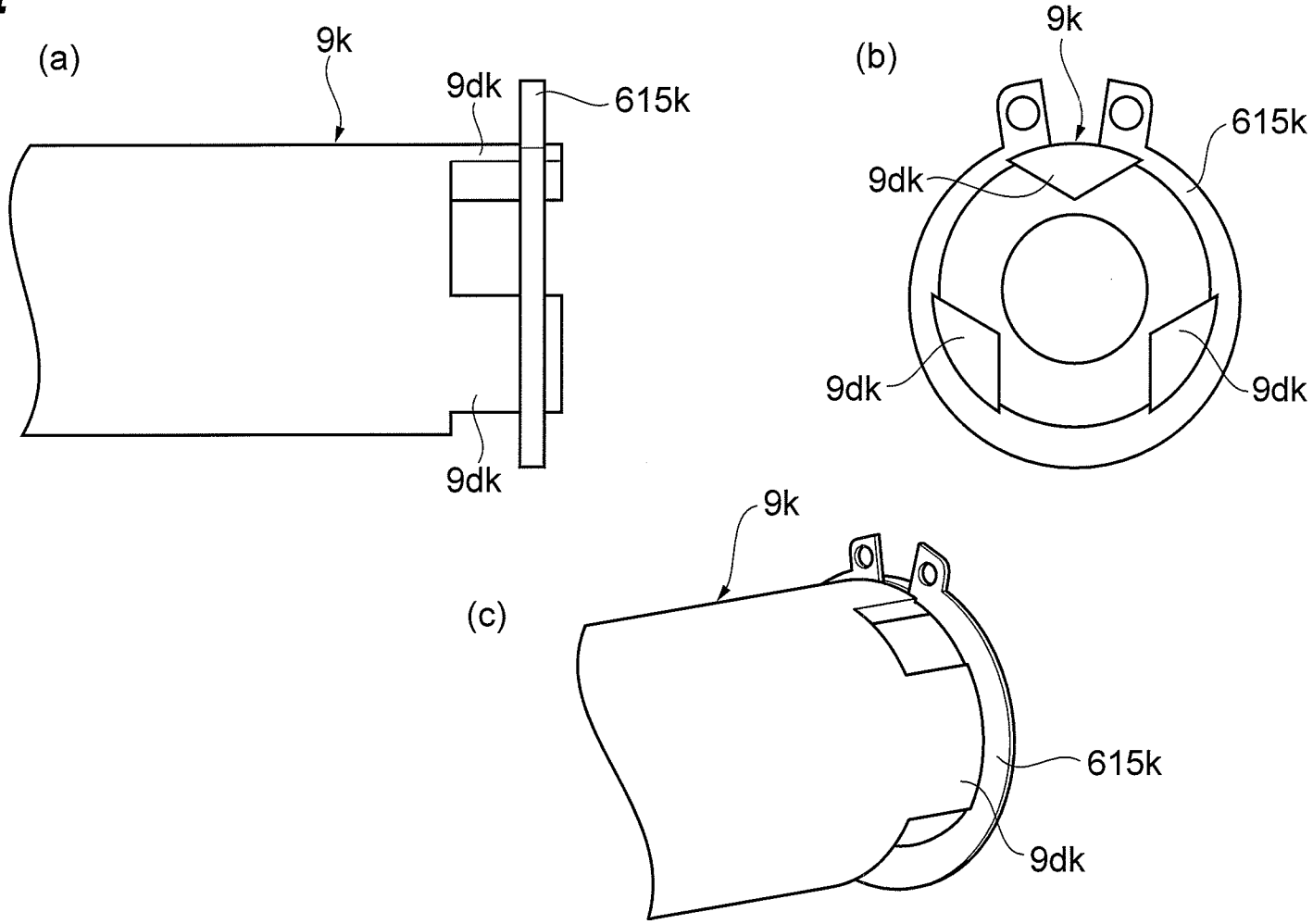
FIG. 54(*a*) is a side view showing a part of a reflective cylinder according to a modification example of the present invention, FIG. 54(*b*) an end view of the reflective cylinder in FIG. 54(*a*), and FIG. 54(*c*) a perspective view of the reflective cylinder in FIG. 54(*a*).
Figure 55:
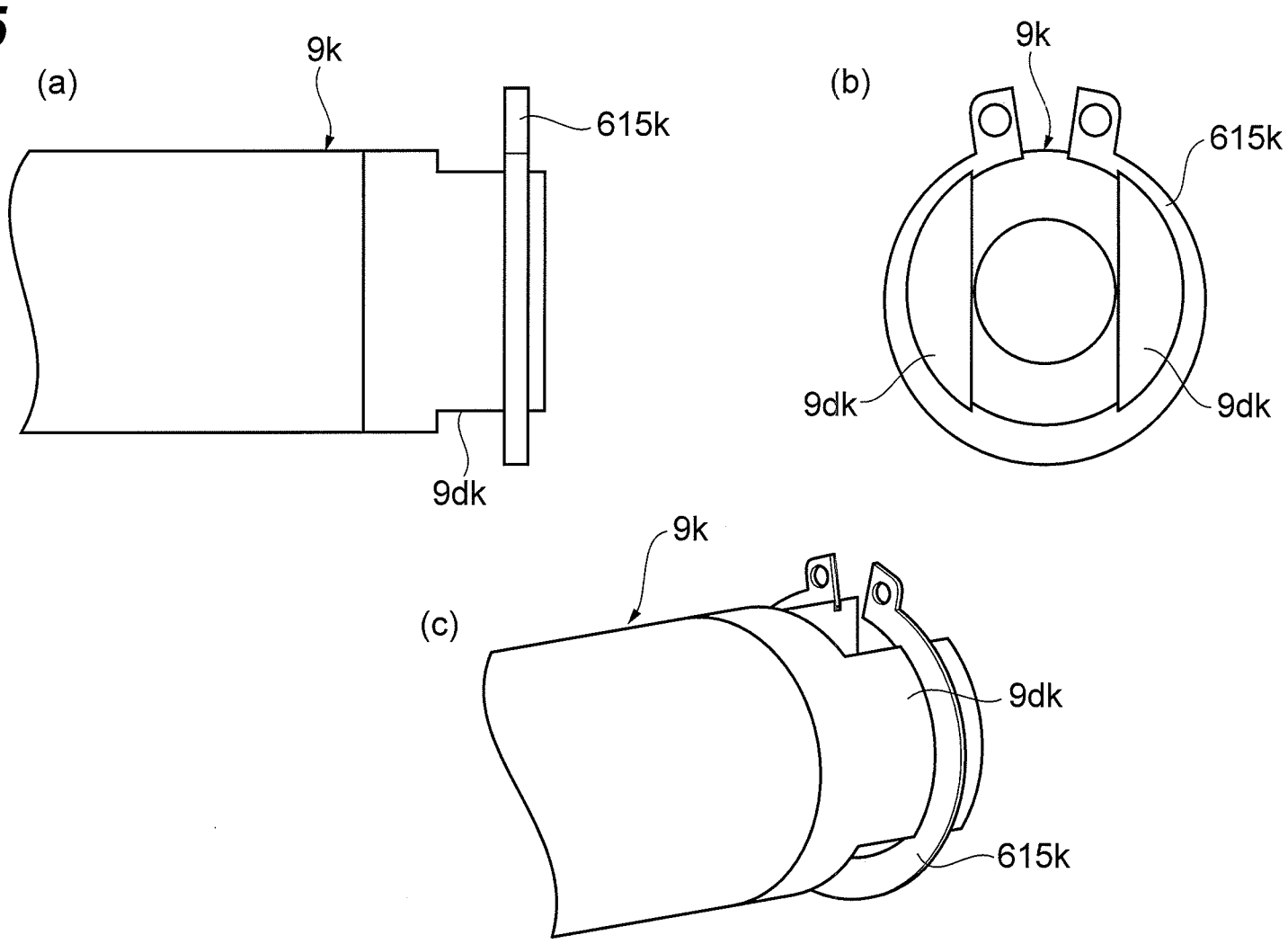
FIG. 55(*a*) is a side view showing a part of a reflective cylinder according to a modification example of the present invention, FIG. 55(*b*) an end view of the reflective cylinder in FIG. 55(*a*), and FIG. 55(*c*) a perspective view of the reflective cylinder in FIG. 55(*a*).

Moreover, as shown in FIGS. 54 and 55, the reflective cylinder 9*k* may be fixed to the luminescent part 2*k* by fixing a retaining ring 615*k* such as a stainless steel C-shaped retaining ring to the outer periphery at the tip of the projections 9*dk* of the reflective cylinder 9*k* so that the tip of the projections 9*dk* projects out, and welding the surface on the projection 9*dk* side of the retaining ring 615*k* to the fixing member for the reflective cylinder which is provided in the housing case 8*k*.

Figure 56:
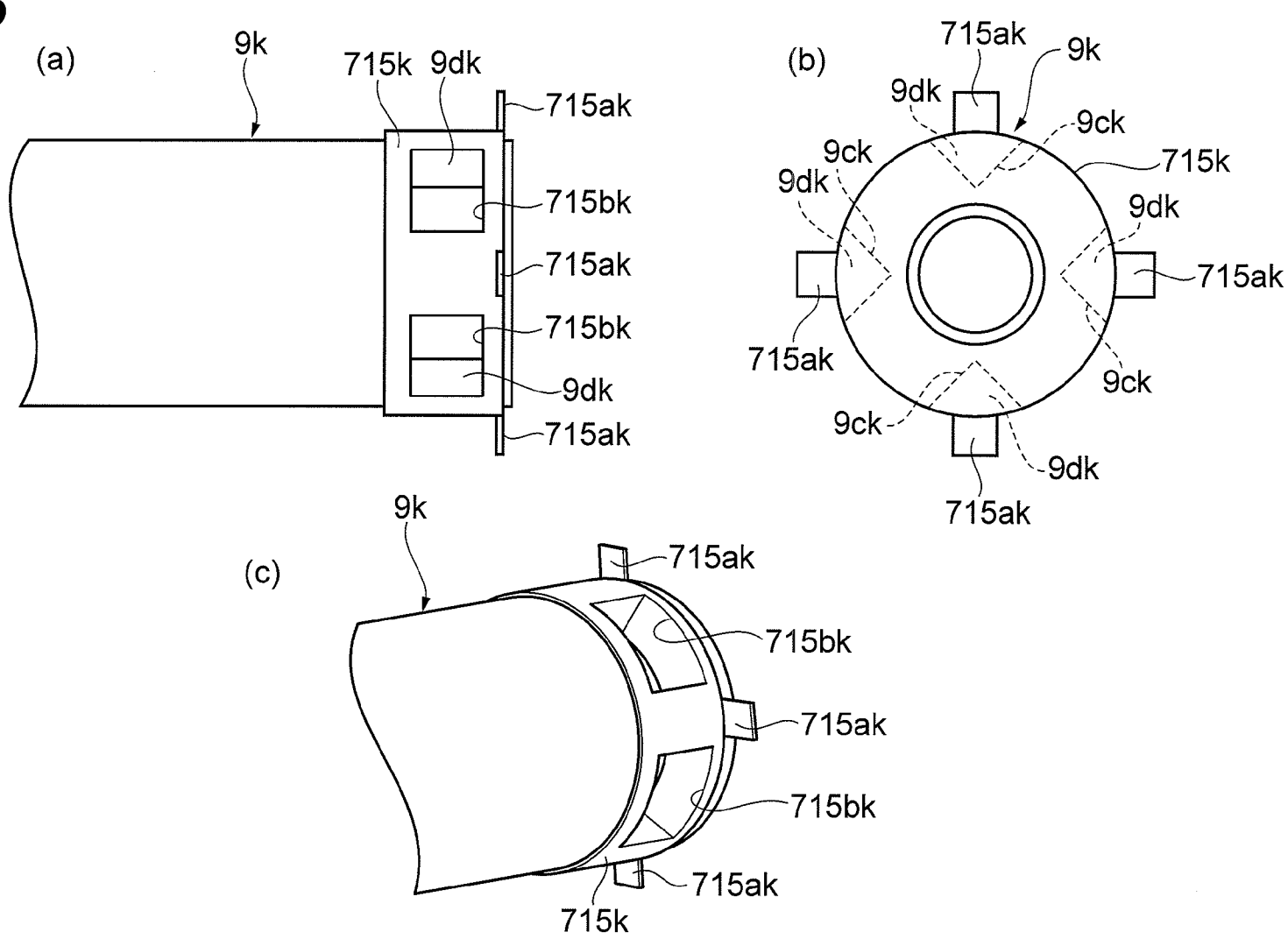
FIG. 56(*a*) is a side view showing a part of a reflective cylinder according to a modification example of the present invention, FIG. 56(*b*) an end view of the reflective cylinder in FIG. 56(*a*), and FIG. 56(*c*) a perspective view of the reflective cylinder in FIG. 56(*a*).

Furthermore, as shown in FIG. 56, it is also possible to adopt a configuration wherein a stainless steel sheet material 715*k* is wound in a belt shape around the outer periphery of the projections 9*dk* of the reflective cylinder 9*k* and their terminal ends are stacked and welded to be fixed. This sheet material 715*k* is provided with a plurality of flange portions 715*ak* extending perpendicularly to the central axis of the reflective cylinder 9*k*, on the tip side of the projections 9*dk* and the flange portions 715*ak* and the fixing member for the reflective cylinder in the housing case 8*k* are welded to fix the reflective cylinder 9*k*. It is also possible to fix the reflective cylinder 9*k* by welding proximate portions between the sheet material 715*k* and the fixing member for the reflective cylinder in the housing case 8*k*, without provision of the flange portions 715*ak*. This sheet material 715*k* is provided with a plurality of holes 715*bk* capable of discharging the sputtered substance, in alignment with the locations corresponding to the apertures 9*ck*.

The thermal radiation film 10*k* is formed in part or in whole of the outer wall surface 9*bk* or 109*bk* of the reflective cylinder 9*k* or 109*k* in the light source 1*k*, 101*k*, or 201*k*, but, conversely, a material with the thermal emissivity lower than that of the material of the reflective cylinder 9*k* or 109*k* may be formed on the other end side of the outer wall surface 9*bk* or 109*bk*. This configuration relatively enhances heat radiation on the one end side and is expected to provide the same effect as the thermal radiation film 10*k*. The material of the metal block member forming the one end side of the reflective cylinder 9*k* or 109*k* may be comprised of a material with the thermal emissivity larger than that of the material of the metal block member forming the other end side.

It is noted herein that the outer wall surface of the cylindrical member is preferably separated from the inner wall surface of the second housing. In this case, it is feasible to prevent the positional deviation of the cylindrical member and the breakage of the cylindrical member or the second housing, because of the difference of coefficients of thermal expansion between the cylindrical member and the second housing, whereby the extraction efficiency of light from the exit window can be improved on a stable basis.

The reflective surface on the first housing side of the cylindrical member is preferably formed in the taper shape. In this case, the reflection angles of the light on the reflective surface become large, so as to reduce the number of reflections, whereby the extraction efficiency of the light from the exit window can be improved on a stable basis.

It is also preferred to further provide the positioning member for positioning of the cylindrical member. With provision of this positioning member, the position of the cylindrical member becomes stabilized relative to the first housing and the second housing, whereby the extraction efficiency of the light from the exit window can be improved on a stable basis.

Another preferred configuration is such that the positioning member includes the spring member to urge the cylindrical member from the other end side toward the one end side of the second housing, and the fixing member against which the cylindrical member urged by the spring member is pressed. By adopting this configuration, the cylindrical member can be stably fixed relative to the first housing and the second housing, whereby the extraction efficiency of the light from the exit window can be improved on a stable basis.

Furthermore, still another preferred configuration is such that the positioning member is provided on the connection member connecting the first housing and the second housing. This configuration also allows the cylindrical member to be stably fixed relative to the first housing and the second housing, whereby the extraction efficiency of the light from the exit window can be improved on a stable basis.

Still another preferred configuration is as follows: the light source of the present invention further comprises the deuterium gas enclosed in the first housing and the second housing; the luminescent part has the cathode, the anode, and the discharge path limiter and generates light by discharge; the second housing is connected so as to be in communication with the first housing on the one end side; the cylindrical member is in contact with the luminescent part in the first housing on the one end side and is inserted in the second housing on the other end side; at least a part of the reflective surface of the cylindrical member is formed in the taper shape.

In the light source of this configuration, the discharge path limiter narrows the discharge caused between the cathode and the anode of the luminescent part in the first housing to generate light, and the light generated in the luminescent part is guided into the cylindrical member inserted from the exit window of the second housing in communication with the first housing to the luminescent part, to be emitted from the exit window. Since the reflective surface is formed on the inner wall surface of the cylindrical member herein, the light emitted from the luminescent part is guided from the one end side to the other end side of the second housing while being reflected by the reflective surface inside the cylindrical member, so that the light generated from the luminescent part can be guided to the exit window of the second housing, without loss. In addition, since at least a part of the reflective surface is formed in the taper shape, the light can be converged at the predetermined position outside the exit window. As a result, the generated light can be extracted efficiently.

The cylindrical member is preferably comprised of the metal material. With provision of this cylindrical member, it becomes easier to process the reflective surface with high mirror accuracy, and the generated light can be extracted more efficiently.

Another preferred configuration is such that the one end side and the other end side of the reflective surface of the cylindrical member are formed in the taper shape. In this case, the irradiation intensity of light can be further enhanced at the desired position and the generated light can be extracted more efficiently.

Another preferred configuration is such that the light source further comprises the spring member of the metal material to urge the cylindrical member from the other end side to the one end side of the second housing, and the fixing member in which the cylindrical member urged by the spring member is fitted, and which is provided so as to surround the aperture of the luminescent part. By adopting this configuration, the cylindrical member can be stably fixed relative to the first housing and the second housing, without deterioration due to the generated ultraviolet light. Furthermore, since the cylindrical member is fitted in the fixing member of the luminescent part, the light from the luminescent part is certainly guided into the cylindrical member, whereby the generated light can be extracted more efficiently.

Furthermore, another preferred configuration is such that the hole in which the end of the cylindrical member is inserted is formed in the luminescent part. With provision of the hole, the cylindrical member is arranged in closer proximity to the interior of the luminescent part, so that the generated light can be extracted more efficiently.

Furthermore, another preferred configuration is such that the aperture to penetrate to the reflective surface is formed in the side face on the one end side of the cylindrical member. This configuration allows the sputtered substance generated in the luminescent part to be discharged to the outside of the cylindrical member, whereby the sputtered substance can be prevented from adhering to the reflective surface of the cylindrical member and to the exit window. As a result, the generated light can be extracted more efficiently.

Another preferred configuration is such that the outer wall surface of the cylindrical member is comprised of the material with the thermal emissivity larger than that of the material of the cylindrical member. By adopting this configuration, the cylindrical member becomes likely to dissipate more heat, so as to further prevent the adhesion of the sputtered substance on the exit window, whereby the generated light can be extracted more efficiently. Furthermore, the thermal radiation film containing the material with the thermal emissivity larger than that of the material of the cylindrical member may be formed on the substantially entire area of the outer wall surface of the cylindrical member, and in this case, it is easy to enhance the thermal emissivity of the outer wall surface of the cylindrical member and the cylindrical member becomes more likely to dissipate heat; it can further prevent the adhesion of the sputtered substance on the exit window, whereby the generated light can be extracted more efficiently.

Another preferred configuration is such that the thermal emissivity on the one end side of the cylindrical member is larger than that on the other end side of the cylindrical member. By adopting this configuration, the sputtered substance can be captured on the portion closer to the luminescent part, so as to further prevent the adhesion of the sputtered substance on most of the reflective surface in the cylindrical member and on the exit window, whereby the generated light can be extracted more efficiently. Furthermore, the thermal radiation film containing the material with the thermal emissivity larger than that of the material of the outer wall surface on the other end side of the cylindrical member may be formed on the outer wall surface on the one end side of the cylindrical member, and in this case, it is easy to make the thermal emissivity of the outer wall surface on the one end side larger than that of the outer wall surface on the other end side and the sputtered substance can be captured on the portion closer to the luminescent part; therefore, it is feasible to further prevent the adhesion of the sputtered substance on most of the reflective surface in the cylindrical member and on the exit window, whereby the generated light can be extracted more efficiently.

Another preferred configuration is as follows: in the light source of the present invention, the luminescent part has the cathode and the anode with their respective apertures, and the capillary part arranged between the cathode and the anode, and generates light by discharge; the first housing holds the luminescent part inside so that the apertures of the cathode and the anode and the capillary part are coaxially arranged; the second housing is connected so as to be in communication with the first housing on the one end side; the cylindrical member is in contact with the cathode in the first housing on the one end side and is inserted in the second housing on the other end side; at least a part of the reflective surface of the cylindrical member is formed in the taper shape.

In the light source of this configuration, the capillary part narrows the discharge caused between the cathode and the anode of the luminescent part in the first housing to generate light, and the light emitted through the aperture of the cathode from the luminescent part is guided into the cylindrical member inserted from the exit window of the second housing in communication with the first housing to the luminescent part, to be emitted from the exit window. Since the reflective surface is formed on the inner wall surface of the cylindrical member herein, the light emitted from the luminescent part is guided from the one end side to the other end side of the second housing while being reflected by the reflective surface inside the cylindrical member, so that the light generated from the luminescent part can be guided to the exit window of the second housing, without loss. In addition, since at least a part of the reflective surface is formed in the taper shape, the light can be converged at the predetermined position outside the exit window. As a result, the generated light can be extracted more efficiently.

The cylindrical member is preferably comprised of the metal material. With provision of this cylindrical member, it becomes easier to process the reflective surface with high mirror accuracy and the light from the luminescent part can be effectively converged.

A preferred configuration is such that the one end side and the other end side of the reflective surface of the cylindrical member are formed in the taper shape. In this case, the irradiation intensity of light can be further enhanced at the desired position and the generated light can be efficiently extracted.

Furthermore, another preferred configuration is such that the light source further comprises the spring member to urge the cylindrical member from the other end side to the one end side of the second housing. By adopting this configuration, the cylindrical member can be stably fixed relative to the cathode. As a result, the light from the luminescent part is certainly guided to the interior of the cylindrical member and the generated light can be extracted more efficiently.

Still another preferred configuration is such that the hole in which the end of the cylindrical member is inserted is formed in the luminescent part. With provision of this hole, the cylindrical member is arranged in closer proximity to the interior of the luminescent part, whereby the generated light can be extracted more efficiently.

Furthermore, still another preferred configuration is such that the aperture to penetrate to the reflective surface is formed in the side face on the one end side of the cylindrical member. This allows the sputtered substance generated in the luminescent part to be discharged to the outside of the cylindrical member, so as to prevent the adhesion of the sputtered substance on the reflective surface of the cylindrical member and on the exit window. As a result, the generated light can be extracted more efficiently.

The outer wall surface of the cylindrical member is preferably comprised of the material with the thermal emissivity larger than that of the material of the cylindrical member. By adopting this configuration, the cylindrical member becomes likely to dissipate more heat, so as to further prevent the adhesion of the sputtered substance on the exit window, whereby the generated light can be extracted more efficiently.

Furthermore, the thermal radiation film containing the material with the thermal emissivity larger than that of the material of the cylindrical member may be formed on the substantially entire area of the outer wall surface of the cylindrical member, and in this case, it is easy to enhance the thermal emissivity of the outer wall surface of the cylindrical member and the cylindrical member becomes more likely to dissipate heat; it can further prevent the adhesion of the sputtered substance on the exit window and the generated light can be extracted more efficiently.

Another preferred configuration is such that the thermal emissivity on the one end side of the cylindrical member is larger than that on the other end side of the cylindrical member. By adopting this configuration, the sputtered substance can be captured on the portion closer to the luminescent part, so as to further prevent the adhesion of the sputtered substance on most of the reflective surface in the cylindrical member and on the exit window, whereby the generated light can be extracted more efficiently. Furthermore, the thermal radiation film containing the material with the thermal emissivity larger than that of the material of the outer wall surface on the other end side of the cylindrical member may be formed on the outer wall surface on the one end side of the cylindrical member, and in this case, it is easy to make the thermal emissivity of the outer wall surface on the one end side larger than that of the outer wall surface on the other end side, and the sputtered substance can be captured on the portion closer to the luminescent part, so as to further prevent the adhesion of the sputtered substance on most of the reflective surface in the cylindrical member and on the exit window, whereby the generated light can be extracted more efficiently.

Still another preferred configuration is as follows: in the light source of the present invention, the luminescent part generates light by discharge; the second housing is connected so as to be in communication with the first housing on the one end side; the cylindrical member is in contact with the luminescent part in the first housing on the one end side and is inserted in the second housing on the other end side; the aperture to penetrate to the reflective surface is formed in the side face on the one end side of the cylindrical member.

In the light source of this configuration, the light generated from the luminescent part in the first housing is guided into the cylindrical member inserted from the interior of the second housing in communication with the first housing to the luminescent part, so as to be emitted from the exit window provided in the second housing. Since the reflective surface is formed on the inner wall surface of the cylindrical member herein, the light emitted from the luminescent part is guided from the one end side to the other end side of the second housing while being reflected by the reflective surface inside the cylindrical member, so that the light generated from the luminescent part can be guided to the exit window of the second housing, without loss. In addition, since the aperture is formed in the side face on the one end side of the cylindrical member, the sputtered substance generated in the luminescent part can be discharged to the outside of the cylindrical member, so as to prevent the adhesion of the sputtered substance on the reflective surface of the cylindrical member and on the exit window. As a result, the extraction efficiency of light from the exit window can be improved while achieving extension of service life.

The aperture of the cylindrical member is preferably arranged in the first housing. In this case, the sputtered substance generated in the luminescent part is discharged to the interior of the first housing, so as to further prevent scattering thereof to the exit window, whereby the service life can be further extended.

The aperture of the cylindrical member is also preferably formed by cutting the edge region on the one end side of the cylindrical member. With provision of this aperture, the sputtered substance can be discharged in the portion closer to the luminescent part, so as to further prevent the adhesion of the sputtered substance on most of the reflective surface in the cylindrical member and on the exit window, whereby the service life can be further extended.

Another preferred configuration is such that a plurality of apertures are formed at equal intervals along the peripheral edge on the one end side of the cylindrical member. By adopting this configuration, the sputtered substance can be efficiently discharged, so as to further prevent the scattering thereof to the exit window, whereby the service life can be further extended.

Another preferred configuration is such that the outer wall surface of the cylindrical member is comprised of the material with the thermal emissivity larger than that of the material of the cylindrical member. By adopting this configuration, the cylindrical member becomes likely to dissipate more heat, so as to further prevent the adhesion of the sputtered substance on the exit window, whereby the service life can be further extended. Furthermore, the thermal radiation film containing the material with the thermal emissivity larger than that of the material of the cylindrical member may be formed on the substantially entire area of the outer wall surface of the cylindrical member, and in this case, it is easy to enhance the thermal emissivity of the outer wall surface of the cylindrical member, and the cylindrical member becomes more likely to dissipate heat, so as to further prevent the adhesion of the sputtered substance on the exit window, whereby the service life can be further extended.

Another preferred configuration is such that the thermal emissivity on the one end side of the cylindrical member is larger than that on the other end side of the cylindrical member. By adopting this configuration, the sputtered substance can be captured on the portion closer to the luminescent part, so as to further prevent the adhesion of the sputtered substance on most of the reflective surface in the cylindrical member and on the exit window, whereby the service life can be further extended. Furthermore, the thermal radiation film containing the material with the thermal emissivity larger than that of the material of the outer wall surface on the other end side of the cylindrical member may be formed on the outer wall surface on the one end side of the cylindrical member, and in this case, it is easy to make the thermal emissivity of the outer wall surface on the one end side larger than that of the outer wall surface on the other end side, and the sputtered substance can be captured on the portion closer to the luminescent part, so as to further prevent the adhesion of the sputtered substance on most of the reflective surface in the cylindrical member and on the exit window, whereby the service life can be further extended.

INDUSTRIAL APPLICABILITY

The present invention is applicable to the light sources to emit light generated inside, with stable improvement in extraction efficiency of light from the exit window.

LIST OF REFERENCE SIGNS

1, 101, 201, 301, 401, 501, 601, 701 light source; 2, 202, 302 luminescent part; 3A, 203A, 303A, 403A, 503A, 603A, 703A luminescent cylinder (first housing); 3B, 203B, 303B, 403B, 503B, 603B, 703B light guide cylinder (second housing); 8*b*, 205A, 308A, 408A, 508B fixing ring member (positioning member or fixing member); 9, 109, 609 reflective cylinder (metal member); 9*a*, 609*a* reflective surface; 9*b*, 109*b*, 609*b* outer wall surface; 12 spring member (positioning member); 13 inner wall surface; 112 metal band (positioning member);

1*i*, 101*i*, 201*i*, 301*i*, 401*i*, 501*i* deuterium lamp; 2*i*, 202*i* luminescent part; 3Ai, 303Ai, 403Ai luminescent cylinder (first housing); 3Bi, 303Bi, 403Bi light guide cylinder (second housing); 4*i* exit window; 5*i* cathode; 6*i* anode; 7*i* discharge path limiter; 8*ai* light passage port; 8*bi* fixing ring (fixing member); 208*bi* claws (fixing member); 9*i*, 109*i*, 309*i* reflective cylinder (cylindrical member); 9*ai*, 109*ai* reflective surface; 9*bi*, 109*bi* outer wall surface (side face); 9*ci* apertures; 10*i* thermal radiation film; 12*i*, 112*i* spring member; 308*ei* hole;

1*j*, 101*j* light source; 2*j* luminescent part; 3Aj luminescent cylinder (first housing); 3Bj light guide cylinder (second housing); 4*j* exit window; 5*j* cathode; 6*j* anode; 5*aj*, 6*aj* apertures; 7*j* capillary part; 9*j*, 109*j*, 209*j*, 309*j* reflective cylinder (cylindrical member); 9*aj*, 109*aj* reflective surface; 9*bj*, 109*bj* outer wall surface (side face); 9*cj*, 109*cj*, 209*cj*, 309*cj* apertures; 10*j* thermal radiation film; 12*j*, 112*j*, 112*aj* spring member; X optical axis;

1*k*, 101*k*, 201*k*, 301*k* light source; 2*k*, 202*k* luminescent part; 3Ak, 203Ak, 303Ak luminescent cylinder (first housing); 3Bk, 203Bk, 303Bk light guide cylinder (second housing); 4*k* exit window; 9*k*, 109*k*, 209*k*, 309*k*, 409*k*, 509*k* reflective cylinder (cylindrical member); 9*ak*, 109*ak* reflective surface; 9*bk*, 109*bk* outer wall surface (side face); 9*ck*, 109*ck*, 209*ck*, 309*ck*, 409*ck*, 509*ck* apertures; 10*k* thermal radiation film.

The invention claimed is:

1. A light source comprising:

a first housing which forms a space enclosing gas for discharging and housing a luminescent part to generate light within the space;

a second housing which is connected to the first housing on a one end side and configured to guide the light generated from the luminescent part, to an exit window provided on the other end side; and a cylindrical member which is fixed so as to be inserted between the exit window of the second housing and a portion connecting the first housing and the second housing, and which has an inner wall surface formed as a reflective surface to reflect the light, wherein the second housing is connected so as to be in communication with the first housing on the one end side, and wherein the cylindrical member is in contact with the luminescent part in the first housing on the one end side and is inserted in the second housing on the other end side.

2. The light source according to claim 1, wherein an outer wall surface of the cylindrical member is separated from an inner wall surface of the second housing.

3. The light source according to claim 1, wherein the reflective surface on the first housing side of the cylindrical member is formed in a taper shape.

4. The light source according to claim 1, further comprising a positioning member for positioning of the cylindrical member.

5. The light source according to claim 4, wherein the positioning member includes:

a spring member which urges the cylindrical member from the other end side to the one end side of the second housing; and a fixing member against which the cylindrical member urged by the spring member is pressed.

6. The light source according to claim 4, wherein the positioning member is provided on a connection member connecting the first housing and the second housing.

7. The light source according to claim 1, further comprising a deuterium gas enclosed in the first housing and the second housing, wherein the luminescent part has a cathode, an anode, and a discharge path limiter and generates light by discharge, and wherein at least a part of the reflective surface of the cylindrical member is formed in a taper shape.

8. The light source according to claim 7, wherein the cylindrical member is comprised of a metal material.

9. The light source according to claim 7, wherein the one end side and the other end side of the reflective surface of the cylindrical member are formed in a taper shape.

10. The light source according to claim 7, further comprising:

a spring member of a metal material which urges the cylindrical member from the other end side to the one end side of the second housing; and a fixing member in which the cylindrical member urged by the spring member is fitted, and which is provided so as to surround an aperture of the luminescent part.

11. The light source according to claim 7, wherein a hole in which an end of the cylindrical member is inserted is formed in the luminescent part.

12. The light source according to claim 7, wherein an aperture to penetrate to the reflective surface is formed in a side face on the one end side of the cylindrical member.

13. The light source according to claim 7, wherein an outer wall surface of the cylindrical member is comprised of a material with a thermal emissivity larger than that of a material of the cylindrical member.

14. The light source according to claim 13, wherein a thermal radiation film containing the material with the thermal emissivity larger than that of the material of the cylindrical member is formed on a substantially entire area of the outer wall surface of the cylindrical member.

15. The light source according to claim 7, wherein a thermal emissivity on the one end side of the cylindrical member is larger than a thermal emissivity on the other end side of the cylindrical member.

16. The light source according to claim 15, wherein a thermal radiation film containing a material with the thermal emissivity larger than that of a material of the outer wall surface on the other end side of the cylindrical member is formed on the outer wall surface on the one end side of the cylindrical member.

17. The light source according to claim 1, wherein the luminescent part generates light by discharge, and wherein an aperture to penetrate to the reflective surface is formed in a side face on the one end side of the cylindrical member.

18. The light source according to claim 17, wherein the aperture of the cylindrical member is arranged in the first housing.

19. The light source according to claim 17, wherein the aperture of the cylindrical member is formed by cutting an edge region on the one end side of the cylindrical member.

20. The light source according to claim 17, wherein a plurality of said apertures are formed at equal intervals along a peripheral edge on the one end side of the cylindrical member.

21. The light source according to claim 17, wherein an outer wall surface of the cylindrical member is comprised of a material with a thermal emissivity larger than that of a material of the cylindrical member.

22. The light source according to claim 21, wherein a thermal radiation film containing the material with the thermal emissivity larger than that of the material of the cylindrical member is formed in a substantially entire area of the outer wall surface of the cylindrical member.

23. The light source according to claim 17, wherein a thermal emissivity on the one end side of the cylindrical member is larger than a thermal emissivity on the other end side of the cylindrical member.

24. The light source according to claim 23, wherein a thermal radiation film containing a material with the thermal emissivity larger than that of a material of an outer wall surface on the other end side of the cylindrical member is formed on the outer wall surface on the one end side of the cylindrical member.

* * * * *